US005703286A

United States Patent [19]

Proett et al.

[11] Patent Number: 5,703,286

[45] Date of Patent: Dec. 30, 1997

[54] METHOD OF FORMATION TESTING

[75] Inventors: Mark A. Proett, Missouri City; Wilson C. Chin, Houston; Chih C. Chen, Plano, all of Tex.

[73] Assignee: Halliburton Energy Services, Inc., Houston, Tex.

[21] Appl. No.: 546,251

[22] Filed: Oct. 20, 1995

[51] Int. Cl.[6] ..... E21B 49/00

[52] U.S. Cl. ..... 73/152.05; 73/152.24

[58] Field of Search ..... 73/152, 155, 152.05, 73/152.24; 364/422

[56] References Cited

U.S. PATENT DOCUMENTS

| | | | |
|---|---|---|---|
| 3,858,445 | 1/1975 | Urbanosky . | |
| 3,859,851 | 1/1975 | Urbanosky . | |
| 4,434,653 | 3/1984 | Montgomery . | |
| 4,607,524 | 8/1986 | Gringarten | 73/152 |
| 4,843,878 | 7/1989 | Purfurst et al. | 73/155 |
| 4,890,487 | 1/1990 | Dussan V. et al. | 73/155 X |
| 5,056,595 | 10/1991 | Desbrandes . | |
| 5,165,276 | 11/1992 | Thiercelin . | |
| 5,233,866 | 8/1993 | Desbrandes . | |
| 5,269,180 | 12/1993 | Dave et al. . | |
| 5,279,153 | 1/1994 | Dussan V. et al. . | |

*Primary Examiner*—Michael Brock

[57] ABSTRACT

A new technique for interpreting pressure data measured during a formation test. The new technique uses an exact spherical flow model that considers the effects of flow line storage and that can be solved in closed, analytical form. This technique generates a type-curve that matches the entire measured pressure plot and that can accurately predict ultimate formation pressure during formation testing from a pressure plot that has not achieved steady state values near the formation pressure.

7 Claims, 11 Drawing Sheets

METHOD OF FORMATION TESTING

BACKGROUND OF THE INVENTION

1. Field of the Invention

The present invention relates generally to the field of oil and gas exploration and, more particularly, to a method and apparatus for performing pressure tests in an underground formation containing oil and/or gas.

2. Description of the Related Art

Hollywood leads one to believe that the exploration and production of oil and gas is a trivial matter, based largely on luck. One merely erects a derrick on a piece of arid Texas land and drills an oil well. The ensuing gusher creates a festival-like atmosphere among the workers and makes the owner an instant millionaire.

However, the exploration and production of oil and gas is serious business. Over the past several decades, those skilled in the art have developed highly sophisticated techniques for finding and producing oil and gas (commonly referred to as "hydrocarbons") from underground formations. These techniques facilitate the discovery of underground hydrocarbon-producing formations and the subsequent assessment and production of such formations.

When a formation containing hydrocarbons is discovered, a borehole is drilled into the formation from the surface so that tests may be performed on the formation. Typically, samples of the penetrated formations are tested to determine whether hydrocarbons are indeed present, whether the penetrated formation is similar to nearby formations, and whether the formation is likely to be of commercial value. As part of these preliminary tests, wireline logging tools may be lowered into the borehole to determine various characteristics of the formation, such as the porosity and size of the formation.

One such wireline logging tool is generically referred to as a formation tester. Known wireline formation testers are slender tools that are positioned at a depth in a borehole adjacent a location in the formation for which data is desired. After the formation tester is lowered into a borehole via the wireline, it sealingly contacts the borehole wall with a probe or snorkel to collect data from the formation. The formation tester collects samples of formation fluid to determine fluid properties, such as viscosity. The formation tester also measures the fluid pressure of the formation over a selected period of time to determine the permeability of the formation and the fluid pressure in the formation. The type of fluid found in the formation and the permeability and pressure of the formation are important factors in determining the commercial usefulness of the well and the manner in which the fluid should be removed from the well.

A formation tester typically performs a pretest sequence that includes a "drawdown" cycle and a "buildup" cycle. During a drawdown cycle, the tester draws in fluid from the formation. To draw the fluid into the tester, a pressure drop is created at the probe by retracting a piston in the tester's pretest chamber. Once the piston stops retracting the drawdown cycle ends and the buildup cycle begins. During the buildup cycle, fluid continues to enter the tester, and the pressure in the tester begins to increase. The fluid continues to enter the tester until the fluid pressure within the tester equals the formation pressure, or until the differential pressure between the tester and the formation becomes insufficient to drive connate fluids into the tester. The operator monitors the pressure at a console while the logging system simultaneously records the pressure data. When the operator determines that the buildup cycle has ended, he begins another drawdown cycle or moves the tester to a different location. The data recorded during the drawdown and buildup cycles may be later interpreted to determine crucial parameters related to the formation, such as fluid pressure in the formation and permeability of the formation.

The value of analyzing the pressure response of a formation was recognized by those skilled in the art shortly after World War II. Over the years, talented engineers have continually revised and built upon these pressure analysis techniques in an effort to improve the determination of the characteristics of the formation, such as pressure and permeability. In 1970, these techniques were greatly enhanced by the introduction of type-curve matching techniques, which, simply put, attempt to match the data (or curve) of pressure vs. time measured by the formation tester with a like curve of pressure vs. time determined from a mathematical model of fluid flow. This approximate curve is then used to determine the characteristics of the formation. In fact, in the 25 years since the introduction of type-curve matching, many skilled in the an have concentrated on developing a multitude of approximate curves and analysis techniques to take into account different formation characteristics, such as different geometries, anisotropic porosity, fractures, and boundaries.

Traditional techniques for interpreting the pressure data compiled by a formation tester are typically performed on the recorded data after the test has been completed. Although the interpretation may be performed at the well site, the pressure test is terminated and all testing suspended in order to interpret the data. Typical type-curve matching requires that the actual pressure change vs. time be plotted in any convenient units on log-log tracing paper, using the same scale as the type curve. Then, points plotted on the tracing paper are placed over the type curve. Keeping the two coordinate axes parallel, the measured curve is shifted to a position on the type curve that represents the best fit of the measurements. To evaluate reservoir constants, a match point is selected anywhere on the overlapping portion of the curves, and the coordinates of the common point on both sheets of paper are recorded. Once the match is obtained, the coordinates of the match point are used to compute formation flow capacity, kh, and storativity-thickness, $\phi c_t h$.

Not only are these traditional type-curve matching techniques laborious, the type-curve matching does not necessarily render accurate information. Many factors influence the accuracy of the measured pressure data and of the interpretation techniques. For instance, the internal volume of known wireline formation testing tools can act as a fluid "cushion," which tends to alter measured data from theoretically ideal data. Thus, this cushioning effect leads to significant errors in the rates of drawdown and buildup detected by such tools, resulting in unreliable estimates of important parameters of earth formations. These errors are due primarily to the compressibility of the fluid contained in the tester's flow lines and chambers. Such compressibility, referred to herein as the "flow line storage effect," generally slows the rate of pressure drawdown and buildup. In subsequent analysis of the measured data, it is very difficult to distinguish between pressure changes resulting from the formation and those due to flow line storage effects. Ultimately, the flow line storage effects create serious problems in data interpretation and can lead to large errors in estimated characteristics of the formation, such as permeability.

Thus, traditional techniques use "late time data", i.e., data collected near the end of the buildup cycle, to estimate permeability and pressure, because the flow line storage effects distort the early time data and make it unusable by these techniques. Using these techniques, radial time, spherical time, and derivative plots are used to select a small portion of late time data to fit a straight line. The slope of the line determines the permeability of the formation, and the intercept determines the pressure. As a result, most of the recorded pressure data is unusable. Also, the buildup cycle cannot be terminated until the buildup pressure substantially reaches the formation pressure.

In high permeability formations, continuing the buildup cycle until the buildup pressure substantially reaches the formation pressure poses few problems. The drawdown and buildup cycles usually require a short period of time, typically about five minutes. After the desired measurements are made, the formation tester may be raised or lowered to a different depth within the formation to take another series of tests. However, formations having low permeabilities in the range of 0.001 to 1 millidarcy, commonly referred to as "tight zones," require a considerably greater time for the buildup pressure to occur, often hours and sometimes days. Thus, because the operator cannot terminate the buildup cycle until the measured pressure substantially reaches the formation pressure, testing may take considerable time. Also, tight zones tend to magnify the effects of flow line distortion.

Although some more recent methods are capable of interpreting early time data, these methods require numerical rather than analytical solutions. For example, some numerical solutions include storage effects, but the results are presented in voluminous plotted charts; this impedes the interpretation process, which is also disadvantaged by the inability to interpolate results to parameters not plotted. Such numerical solutions are not amenable to simple physical interpretation, and, thus, cannot be used in real time, i.e., during the formation test, to facilitate the testing.

The present invention is directed to overcoming, or at least reducing the effects of, one or more of the problems set forth above.

SUMMARY OF THE INVENTION

In accordance with one aspect of the present invention, there is provided a method of testing an underground formation. The method may include the following steps. A formation testing device is disposed within a borehole adjacent a portion of the underground formation to be tested. The formation testing device includes a probe for collecting fluid from the formation and a transducer for measuring fluid pressure. The transducer is fluidically coupled to the probe by a flow line. Fluid is drawn from the underground formation through the probe and into the formation testing device. The fluid pressure within the formation testing device is permitted to build toward the pressure of fluid within the underground formation. An electrical signal from the transducer is delivered to a signal processor that is electrically coupled to the formation testing device. The electrical signal is correlative to fluid pressure of the fluid in the formation testing device. An electrical plot is generated in response to receiving the electrical signal. The electrical plot is correlative to fluid pressure of the fluid in the formation testing device over time. An electrical type-curve is generated that approximates the electrical plot.

Additionally, the method may include the following steps. The electrical plot and the electrical type-curve may be displayed on a monitor. Also, the testing of the underground formation may be terminated when the electrical type-curve provides a substantially unchanging estimate of fluid pressure in the underground formation.

In accordance with another aspect of the present invention, there is provided a method of testing an underground formation. The method may include the following steps. A borehole is drilled into the underground formation. A formation testing device is disposed within a borehole adjacent a portion of the underground formation to be tested. The formation testing device includes a probe for collecting fluid from the formation and a transducer for measuring fluid pressure. The transducer is fluidically coupled to the probe by a flow line. Fluid is drawn from the underground formation through the probe and into the formation testing device. An electrical signal P from the transducer is delivered to a signal processor that is electrically coupled to the formation testing device. The electrical signal P is correlative to fluid pressure of fluid in the formation testing device. The electrical signal P is recorded over time t to generate an electrical plot that is correlative to fluid pressure of the fluid in the formation testing device over time. Electrical signals $R_w$, V, $Q_o$, $\mu$, and $\phi$, corresponding to radius of the borehole, volume of the flow line, rate of fluid flow into the formation testing device, viscosity of the fluid, and porosity of the formation, respectively, are delivered to the signal processor. The compressibility of the fluid in the flowline C and the compressibility of the formation fluid c are determined, and correlative electrical signals C and c are delivered. The permeability of the formation is estimated, and a correlative electrical signal k is delivered. The permeability of the formation and pressure of the formation are determined by altering the electrical signals P, $R_w$, V, $Q_o$, $\mu$, $\phi$, C, c, and k according to:

$$P(R_w,t) - P_0 = p(r_w,t)\left(\frac{VCQ_0\mu}{16\pi^2 R_w^4 k\phi c}\right)$$

where:

$$p(r_w,t) = \left(\frac{1}{\beta_1-\beta_2}\right)\left(\begin{array}{l} +\beta_1^{-1} - \beta_1^{-1}\, e^{(\beta_1^2 t)}\, erfc(\beta_1\sqrt{t}) \\ -\beta_2^{-1} + \beta_2^{-1}\, e^{(\beta_2^2 t)}\, erfc(\beta_2\sqrt{t}) \end{array}\right)$$

$$\beta_1 = +\frac{1}{2} - \frac{1}{2}\sqrt{1-\frac{4}{r_w}}$$

$$\beta_2 = +\frac{1}{2} + \frac{1}{2}\sqrt{1-\frac{4}{r_w}}$$

$$r_w = 4\pi\frac{R_w^3\phi c}{VC}$$

$$t = t\left(16\pi^2\frac{R_w^4 k\phi c}{V^2C^2\mu}\right)$$

and c is approximately equal to C.

BRIEF DESCRIPTION OF THE DRAWINGS

The foregoing and other advantages of the invention will become apparent upon reading the following detailed description and upon reference to the drawings in which.

Figure 1:
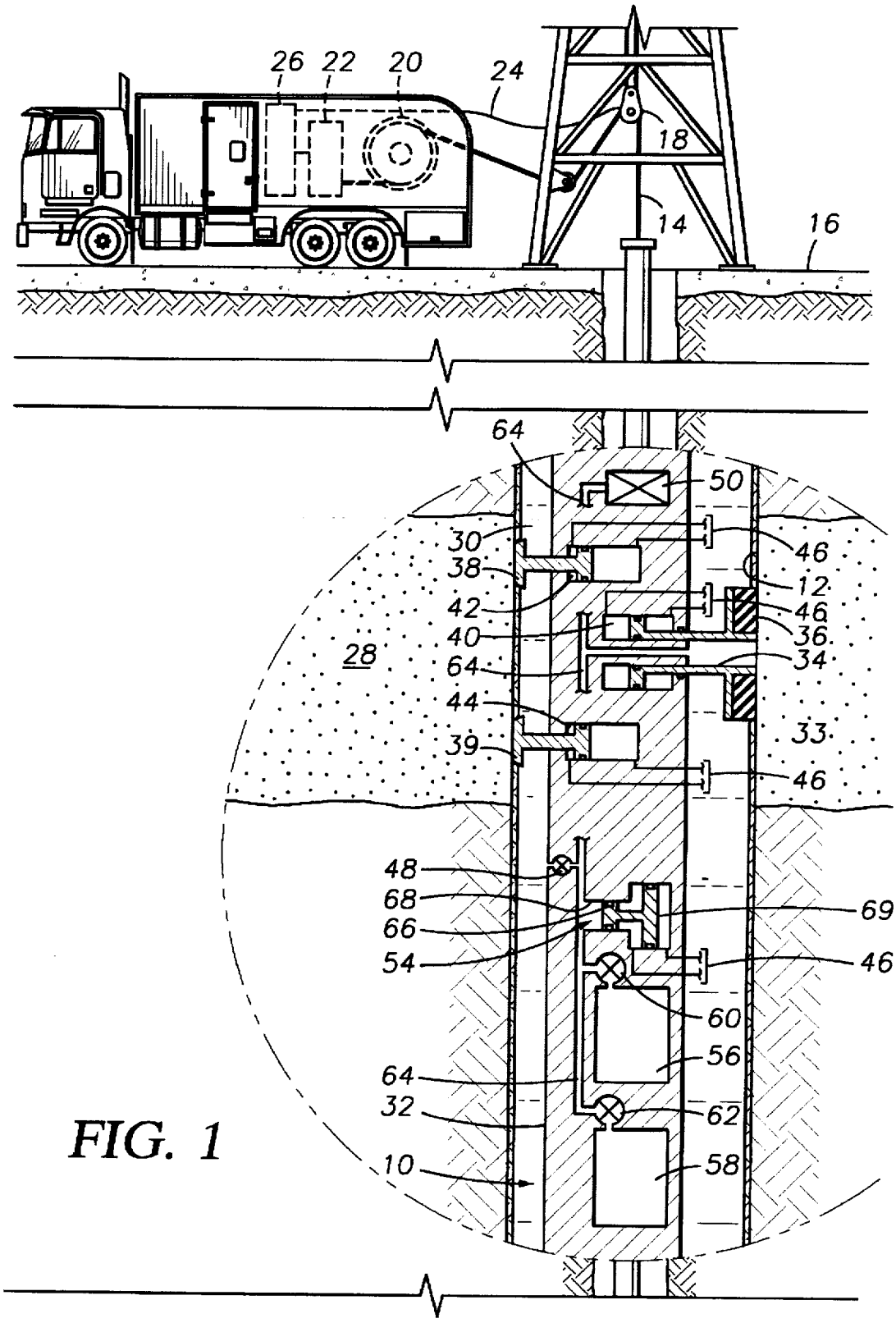
FIG. 1 is a schematic representation of the primary components of a wireline formation tester positioned in a borehole to collect data relating to parameters of the surrounding earth formation.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DESCRIPTION OF THE PREFERRED EMBODIMENTS

Turning now to the drawings and referring initially to FIG. 1, an exemplary wireline formation tester 10 is schematically depicted as deployed in an uncased ("open hole") well borehole 12. Although the preferred analysis method described herein may be utilized with a variety of formation testers, a preferred formation tester is a model SFFT-B tool available from Halliburton Logging Services, Inc. The tester 10 is suspended on a wireline 14. At the earth's surface 16, the wireline 14 passes over a sheave 18 before entering the borehole 12 and is stored on a drum 20.

The wireline 14 is operatively coupled to a central processing unit ("CPU") 22 which processes data communicated from the tester 10 via the wireline 14. One preferred processor is an XL2000 real time computer used by Halliburton Logging Services, Inc., but those skilled in the art will readily recognize suitable alternatives. One preferred processor is an IBM 7006 Graphics Work Station 41T. This IBM work station uses an 80 megahertz power PC 601 processor with an optional L2 cache. It further includes a graphics adaptor, 540 megabyte disk drive, and 16 megabyte memory.

The wireline 14 preferably includes a data communication line coupled to a recording unit 26 that records the depth of penetration of the tester 10 in the borehole 12, by known techniques. An operator (not shown) controls the formation tester 10 via a console and monitor (not shown) operatively associated with the CPU 22, as is well known in the art.

The borehole 12 contains well fluid 30, which is typically a combination of drilling fluid that has been pumped into the borehole 12 and connate fluid that has seeped into the borehole 12 from the formation 28. The drilling fluid may be water or a water-based or oil-based drilling fluid. The density of the drilling fluid is usually increased by adding certain types of solids, such as barite and other viscosifiers, that are suspended in solution. Such fluids are often referred to as "drilling muds." The solids increase the hydrostatic pressure of the well fluid 30 to help maintain the well and keep fluids from surrounding formations from flowing into the well.

The solids within the drilling fluid create a "mudcake" 33 as they flow into the formation 28 by depositing solids on the inner wall of the borehole 12. Conventional mudcakes are typically between about 0.25 and 0.5 inch thick, and polymeric mudcakes are often about 0.1 inch thick. The wall of the borehole 12, along with the mudcake 33 of deposited solids, tends to act like a filter. The mudcake 33 also helps prevent excessive loss of drilling fluid into the formation 28. The fluid pressure in the borehole 12 and the surrounding formation 28 is typically referred to as "hydrostatic pressure." Relative to the hydrostatic pressure in the borehole 12, the hydrostatic pressure in the mudcake 33 decreases rapidly with increasing radial distance. Pressure in the formation 28 beyond the mudcake 33 gradually tapers off with increasing radial distance outward from the wellbore.

Once the wireline formation tester 10 is deployed in the borehole 12 adjacent an earth formation 28 of interest, the tester 10 may be used to collect pressure data concerning the earth formation 28, to collect samples of connate fluids within the formation, and to gather other data on downhole conditions. Since such tests are generally performed in the presence of the well fluid 30 that fills the borehole 12 to a certain depth, the formation tester 10 is preferably constructed within an elongated, sealed sonde 32 of sufficient strength to withstand hydrostatic pressures prevailing in the borehole 12 at the depths of the formations of interest.

Considering the formation tester 10 in greater detail, still referring to FIG. 1, the formation tester 10 includes a laterally extendable probe 34 surrounded by an isolation packer 36. The tester 10 also includes one or more back-up pads or shoes 38 and 39 preferably arranged to extend laterally in a direction diametrically opposed to the probe 34. The extended pads 38 and 39 stabilize the tester 10 and ensure proper sealing of the isolation packer 36 against the mudcake 33 of the borehole 12 during test periods. The probe 34, the isolation packer 36, and the back-up pads 38 and 39 are advantageously arranged to extend laterally from the sonde 32 when the tester 10 is properly positioned adjacent a formation 28 of interest, as known to those skilled in the art.

Internally, the tester 10 includes an equalization valve 48, a pressure sensor 50, and a pretest chamber 54. The tester 10 may also include one or more fluid storage tanks 56 and 58 to collect connate fluids from the earth formation 28. Other components may also be advantageously provided in the tester 10, such as instruments for measuring flow rate, temperature, conductivity, and so on, as generally known to those skilled in the art. However, while an exemplary arrangement of the elements of the tester 10 is described herein, various other physical configurations may be used.

The equalization valve 48, the pressure sensor 50, the probe 34, the pretest chamber 54, and the storage tanks 56, 58 are all interconnected by a flow line 64 of predetermined, or known, volume. Although the particular dimensions and positions of the primary components of the tester 10 will influence the volume of the flow line 64, this volume will be known when the particular tester 10 is constructed.

The equalization valve 48 selectively enables fluid communication between the well fluid 30 and the flow line 64. Such communication allows the probe 34 to seal properly against the formation 28 prior to testing and facilitates the retraction of the probe 34 at the end of the test. The equalization valve 48 is capable of remote actuation by the hydraulic system 46 or an electrical system, such as solenoid or motor (not shown), in response to a signal transmitted from the CPU 22 through the wireline 14.

The pressure sensor 50 preferably comprises a transducer capable of generating an electrical output signal proportional to fluid pressure, such as a quartz pressure transducer. The pressure sensor 50 may be used to detect and measure pressures near the probe 34 during the drawdown and buildup phases of testing, as will be described. Although the sensor 50 is shown schematically at some distance from the probe 34, the location of the sensor in an actual physical embodiment is preferably as close to the probe 34 as practically possible. This placement of the sensor 50 ensures accurate readings of the pressures caused by fluid flow from the earth formation 28.

The present chamber 54 includes a piston 66, a cylinder 68, and a hydraulically operated actuator 69 responsive to the hydraulic system 46 and to control signals transmitted through the wireline 14 from the CPU 22. As described in greater detail below, the retraction of the piston 66 in the test chamber 54 decreases the pressure in the tester 10 during a drawdown phase of a formation test, thereby increasing the volume of the chamber 54 in communication with the flow line 64. The number and volume of the chamber(s) 54 and of storage tanks 56 and 58 may be selected depending upon the test data to be collected and upon the number and volume of fluid samples to be collected. The valves 60 and 62 associated with the storage tanks 56 and 58 respectively may be electrically or hydraulically operated and are responsive to control signals from the CPU 22 transmitted through the wireline 14.

Figure 2:
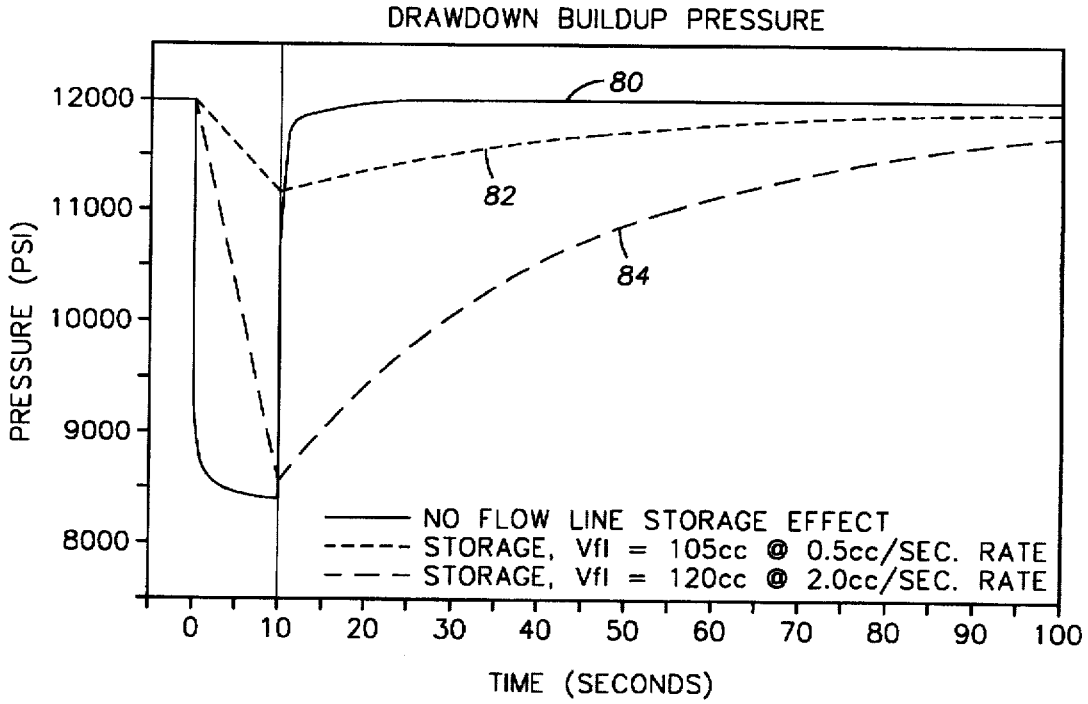
FIG. 2 is a graphical representation of expected pressure measurements vs. time during the drawdown and buildup cycles of a formation test, illustrating the variation of pressure measurements as a function of the flow line storage effects in three exemplary cases.

Various drawdown/buildup pressure curves 80, 82, and 84 are illustrated in FIG. 2 to show the manner in which flow line storage effects influence the pressure measurements taken by a traditional formation tester. The curve 80 represents an ideal drawdown/buildup pressure vs. time curve representative of data taken by a formation tester having no flow line storage effect. In this ideal case, the pressure at the probe drops very rapidly from the prevailing well fluid pressure of 12,000 pounds per square inch (psi) upon initiation of the drawdown phase, and the pressure rises rapidly to the formation pressure during the buildup phase. By contrast, the curve 82 represents the flow line storage effect's influence on data taken by a formation tester having a flow line storage capacity of 105 cc and a pretest chamber volume of 5 cc, where the flow rate into the probe from the formation is 0.5 cc/see. As can be seen, the pressure drops less and much more slowly during the drawdown phase, and the pressure rises much more slowly during the buildup phase. Finally, the curve 84 represents the flow line storage effect 's influence on data taken by a formation tester having a flow line storage capacity of 120 cc and a pretest chamber volume of 20 cc, where the flow rate into the probe from the formation is 2.0 cc/sec. Here, the pressure at the probe drops rapidly, though not as rapidly as the ideal case, during the drawdown phase, but rises much more slowly during the buildup phase.

In the illustrative embodiment, the wireline formation tester 10 may be operated as follows. The sonde 32 is lowered within the borehole 12 to a depth corresponding to the location of an earth formation 28 from which data is desired. The sonde's depth of penetration is indicated by a counter (not shown) associated with the sheave 18 and recorded by the recording unit 26. During this deployment period, the equalization valve 48 is open to equalize pressures within the sonde 32 with the hydrostatic pressure of the surrounding well fluid 30.

Figure 3:
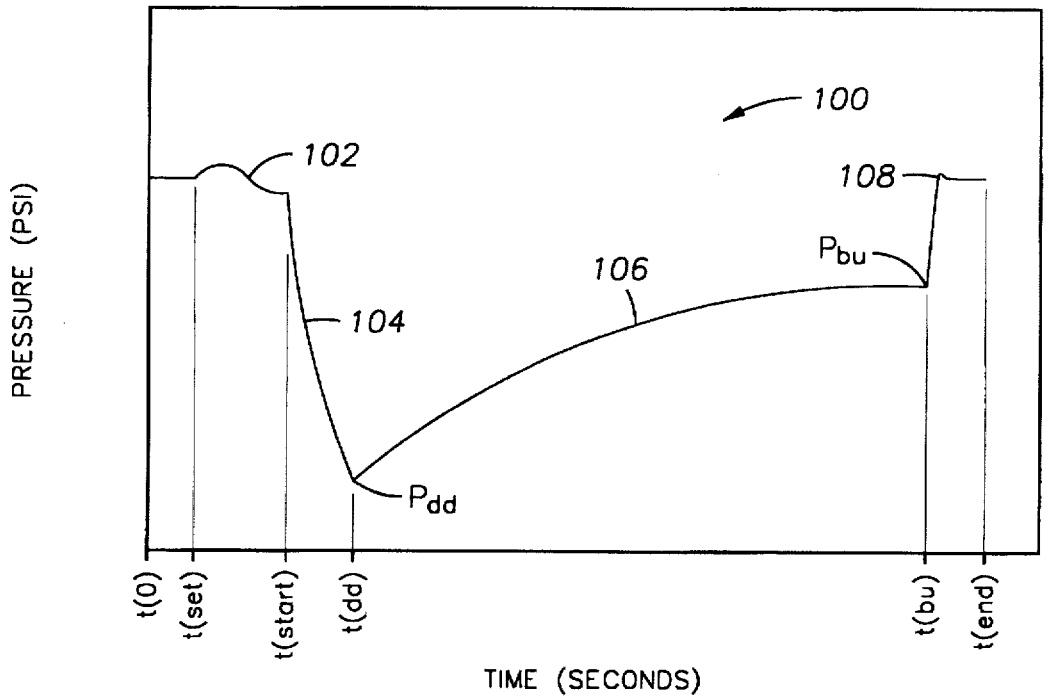
FIG. 3 is a graphical representation of pressure measurements vs. time of a typical pretest sequence performed by the formation tester.

With the sonde positioned adjacent the formation 28, the CPU 22 transmits signals via the wireline 14 causing the equalization valve 48 to close and causing the back-up pads 38 and 39 and the probe 34 to extend and contact the formation 28. Initially, as the isolation packer 36 is extended against the borehole wall, the pressure inside the probe 34 slightly increases, as shown beginning at $t_{set}$ by the pressure vs. time curve 100 in FIG. 3. This pressure increase followed by a decrease is illustrated in FIG. 3 by the curve portion 102 prior to the start of the pretest. After the probe 34 is in firm contact with the formation 28, and after a seal is established by the isolation packer 36, the desired formation test sequence may begin.

It should be appreciated that the isolation packer 36 helps prevent the well fluid 30 from flowing outward through the mudcake 33 and circling back into the probe 34 and the pretest chamber 54. Thus, the isolation packer 36 "isolates" the probe 34 from the well fluids 30 in the borehole 12, helping to ensure that the measurements of the probe 34 are representative of the pressure of the connate fluid in the formation 28.

An exemplary drawdown phase of the formation test may proceed as follows. Formation fluid is drawn into the tester 10 by decreasing the pressure in the tester 10, as shown by the curve portion 104 beginning at $t_{start}$. The pressure is reduced by retracting the piston 66 within the cylinder 68, thus expanding the test chamber 54. When the pressure within the tester 10 has been sufficiently reduced to the drawdown pressure $P_{dd}$, the pretest piston is stopped 54 causing the buildup phase to begin.

During the build-up phase, the reduced pressure in the tester 10 in the vicinity of the probe 34 continues to draw connate fluids or mud filtrate from the formation 28 into the tester 10 through the probe 34. As these fluids enter and fill the tester 10, the pressure detected by the sensor 50, as shown by the curve portion 106, rises to $p_{bu}$ which approaches equilibrium with the formation pressure. This final buildup pressure $p_{bu}$ is frequently referred to as the "sandface pressure." It is usually assumed that the sandface pressure is close to the formation pressure. This equilibrium marks the close of the buildup phase of the test. When the formation tester 10 is disengaged from the borehole wall at $t_{bu}$, the detected formation pressure increases rapidly from $p_{bu}$, as shown by the curve portion 108, due to the removal of pressure applied by the isolation packer 36.

During both the drawdown and buildup phases, the pressure sensor 50 measures the pressure prevailing near the probe 34 and transmits output signals corresponding to this pressure to the CPU 22 through the wireline 14. The CPU 22 in turn causes the pressure readings to be stored in the recording unit 26, along with the time at which the readings were taken, the depth of the formation 28, and other data produced by the tester 10.

When the formation test is complete, a sample of the fluids may be stored in one or more of the storage tanks 56 or 58 by opening the valve 60 or 62. When this operation is complete, the equalization valve 48 is opened and the probe 34 and back-up pads 38 and 39 are retracted. The tester 10 may then be repositioned at another depth, or it may be removed from the borehole 12.

The drawdown and buildup pressures $p_{dd}$ and $p_{bu}$ are used in determining formation permeability. The rate of the pressure buildup to $p_{bu}$ is slowed, however, primarily due to the cushion effect of the flowline 64 volume, which is generally greater than the volume of pretest chamber 54. This flowline cushion effect renders much of the buildup cycle unusable for known pressure/flow analysis techniques, such as the radial or "Horner" analysis or spherical models. This flowline distortion in the buildup pressure does not dissipate until the difference in the recorded pressure and the final buildup pressure is small.

Figure 4:
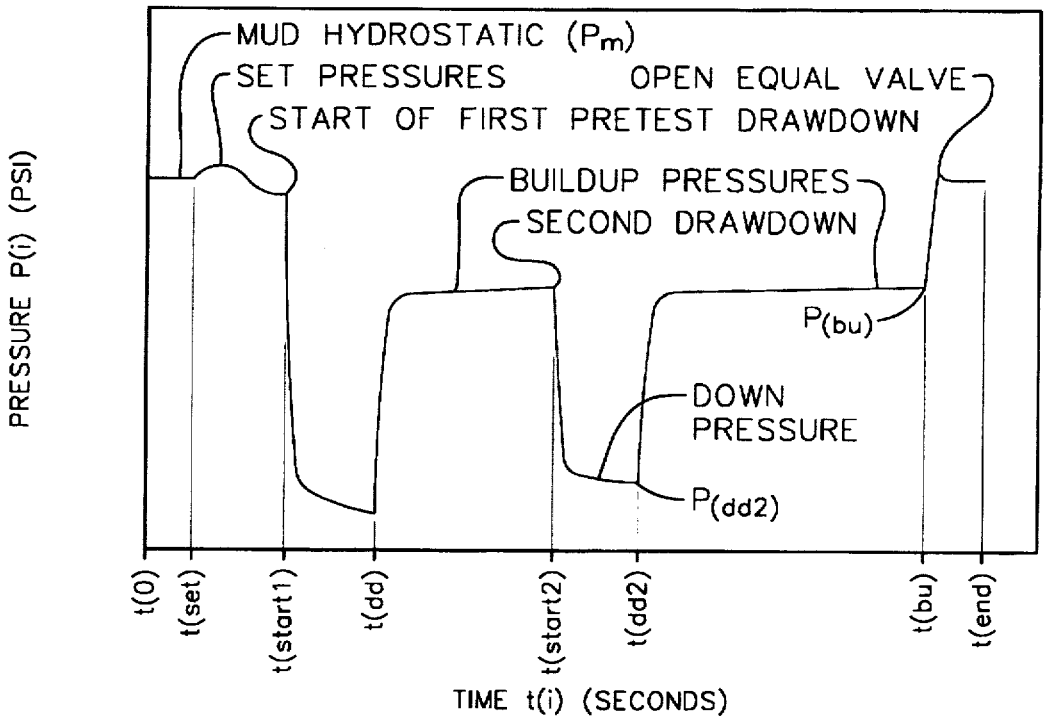
FIG. 4 is a graphical representation of typical pressure measurements vs. time of a typical pretest sequence taken in a permeable zone of a formation by the formation tester having no flow line storage effects.

Although FIG. 3 illustrates a pretest sequence having a single drawdown and buildup phase, the formation test sequence may include various drawdown and/or buildup phases. For permeable zones, i.e., zones having permeabilities from 1 to 1000 millidarcies, the formation fluid production rate at the probe is approximately the volume rate of the pretest piston. The pressure drops rapidly during the first few seconds of the pretest and then stabilizes to a nearly constant drawdown value for the remainder of the pretest. The buildup is also very rapid, with the most dynamic changes occurring during the first few seconds of the buildup. FIG. 4 illustrates this type of pretest behavior. FIG. 4 also illustrates the practice of taking multiple pretests while maintaining the packer seal. The first pretest is usually shorter and creates a greater pressure drop than the second pretest. When the formation tester is set against the formation, the probe traps the mudcake, which is removed during the first pretest. The process of removing mudcake and cleaning the area around the probe tends to distort the pressure curve. This makes the second pretest preferable to use for drawdown and buildup pressure analysis.

Multiple pretests for tight zones are usually not practical, however, due to the long buildup times. In tight zones, the rate of pressure buildup is slowed, primarily due to the flow line storage effect. Because the flow line storage effect can last for most of the buildup time, this portion of the pressure vs. time data is not suitable for a Horner type analysis. The distortion in the pressure vs. time data due to flow line storage effects does not dissipate until the difference in the recorded pressure and the final buildup pressure is small. It may be difficult to identify this distortion on a Horner type plot, and, if this portion of the data is used, the error in the calculated permeability can be large.

The traditional interpretation models used to solve for formation properties do not account for the volume of fluid in the tool in contact with the formation which is usually referred to as the flow line volume. In practice, if this is not considered, the pressure drawdown and buildup curves do not follow the expected buildup or decline models until the effects of flow line storage have dissipated. This can take considerable time for many test conditions and is difficult to recognize in the pressure data. The new method uses a closed form solution developed for spherical flow satisfying exact boundary conditions.

It should be noted that all currently known models are presented in Laplace space and inverted numerically to provide timewise behavior because a closed form solution could not be determined. While the Laplace space formulation has been used to generate solutions for spherical flow, its usefulness is limited by inaccurate numerical techniques and cumbersome presentation of computed results.

The exact closed form pressure solution of spherical flow with storage effects and assuming a continuously acting constant $Q_0$ is given in equations 1 and 3 (see Appendix I for derivation). By using direct curve matching techniques, the drawdown and buildup pressures described by equations 1 and 2 are used to find formation properties from wireline formation pressure tests. The physical pressure at the effective probe or well radius ($R_w$) is:

$$P(R_w,t) - P_0 = p(r_w,t)\left(\frac{VCQ_0\mu}{16\pi^2 R_w^4 k\phi c}\right) \tag{1}$$

As indicated above, Equation 1 is the solution for the drawdown stage of the test and assumes a constant rate ($Q_0$ greater than 0) drawdown only, beginning at time t=0 and lasting indefinitely. In practice, production is shut-in after a time $t_{pro}$, and no fluids are produced. To represent the complete drawdown and buildup process, Equation 2, which is obtained by linear superposition, is used.

$$P'(R_w,t = P(R_w,t;\, Q_0) + \begin{bmatrix} P(r_W,t - t_{pro};\, -Q_0), & t > t_{pro} \\ 0, & t < t_{pro} \end{bmatrix} \tag{2}$$

where the dimensionless pressure-time relationship is given by:

$$p(r_w,t) = \left(\frac{1}{\beta_1 - \beta_2}\right)\begin{pmatrix} +\beta_1^{-1} - \beta_1^{-1} e^{(\beta_1^2 t)}\, erfc(\beta_1\sqrt{t}) \\ -\beta_2^{-1} + \beta_2^{-1} e^{(\beta_2^2 t)}\, erfc(\beta_2\sqrt{t}) \end{pmatrix} \tag{3}$$

The complex constants $\beta_1$ and $\beta_2$ satisfy:

$$\beta_1 = +\frac{1}{2} - \frac{1}{2}\sqrt{1 - \frac{4}{r_w}} \tag{4}$$

$$\beta_1 = +\frac{1}{2} + \frac{1}{2}\sqrt{1 - \frac{4}{r_w}} \tag{5}$$

and the dimensionless radius and time is given by:

$$r_w = 4\pi\frac{R_w^3\phi c}{VC}(1+\gamma) \tag{6}$$

-continued and $$t = t\left(\frac{16\pi^2 R_w^4 k\phi c}{V^2 C^2 \mu}\right) \tag{7}$$

The "bore hole shape factor" $\gamma$ has been added to the exact solution developed in Appendix I to account for non-spherical cylindrical borehole boundary effects (see Equation 6). The solution developed in Appendix I is for a perfect spherical problem. The borehole represents an interruption to sphericity and can be accounted for with the shape factor introduced in Equation 6. The shape factor is determined using full three-dimensional finite difference or finite element modeling methods. The specific dimensional effects of a cylindrical borehole is modeled in an infinite formation and the shape factor is determined by comparing the exact solution (Equations 1 and 2) to the modeled solution. If the borehole radius is zero there are no borehole effects and $\gamma=0$ yields the exact solution for spherical flow given in Appendix I. For a borehole of infinite radius the shape factor is $\gamma=1$ which is the exact solution for hemispherical flow. In practice the borehole is large with respect to the formation tester probe radius, and the flow factor is nearly 1.

The constants in the equations are:

$R_w$=radius of well or probe of production (cm)

$P_o$=initial and formation pressure (atm)

$P(R_w,t)$=pressure at the probe (atm)

t=test time (sec)

$r_w$=dimensionless radius (nondimensional)

$p(r_w,t)$=dimensionless pressure (nondimensional)

t=dimensionless time (nondimensional)

V=volume of the flow line (cc)

C=compressibility of the flow line fluid (1/atm)

c=compressibility of the formation fluid (1/atm)

$\gamma$=borehole hemispherical shape factor $Q_o$=injection or production flow rate (cc/sec)

$\mu$=viscosity of formation fluid (cp)

k=permeability of formation (darcy)

$\phi$=porosity of formation (nondimensional)

While the primary constants determined from traditional models are the permeability k and initial formation pressure $P_o$, equation 1 can be used to solve for additional properties such as compressibility of the flow line fluid and formation fluid, C and c, respectively. However, in practice c and C are approximately equal and simplifies the determination of compressibility.

An approximation to equation 2 can also be used (See Appendix I for derivation):

$$p(r_w,t) = r_w\left(1 - \frac{r_w}{\sqrt{\pi t}}\right)(1 - e^{(-d/r_w)}). \tag{8}$$

Equation 8 has been found to closely match the exact solution given in equation 3 over the operating range of t and $r_w$ of interest to wireline formation testers. Furthermore, equation 9 provided below may be used in situations where it cannot be assumed that the flow rate $Q_o$ is constant. Instead, time dependent rates F(t) may be considered, where equation 9 reduces to equation 1 when F(t)=1 (see Appendix I for derivation).

$$p(r_w,t) = \{1/(\beta_1-\beta_2)\}x\int_0^t F(\tau)\{\beta_2\exp(\beta_2^2(t-\tau))erfc\beta_2\sqrt{(t-\tau)} - \beta_1\exp(\beta_1^2(t-\tau))erfc\beta_1\sqrt{(t-\tau)}\}d\tau. \tag{9}$$

By using equation 2 with equations 3, 8, or 9 to match pressure data from formation pressure tests, a more precise technique has been developed to determine formation properties such as formation pressure and permeability. Because the entire pressure time history is matched, rather than only a small late time segment, it is unnecessary for the person making the estimates to determine what portion of the data is to be used since virtually all the data is used for curve matching. Because all of the pressure time history is used in the curve matching technique, the speed that formation properties are determined can be increased and the test time shortened.

Figure 5:
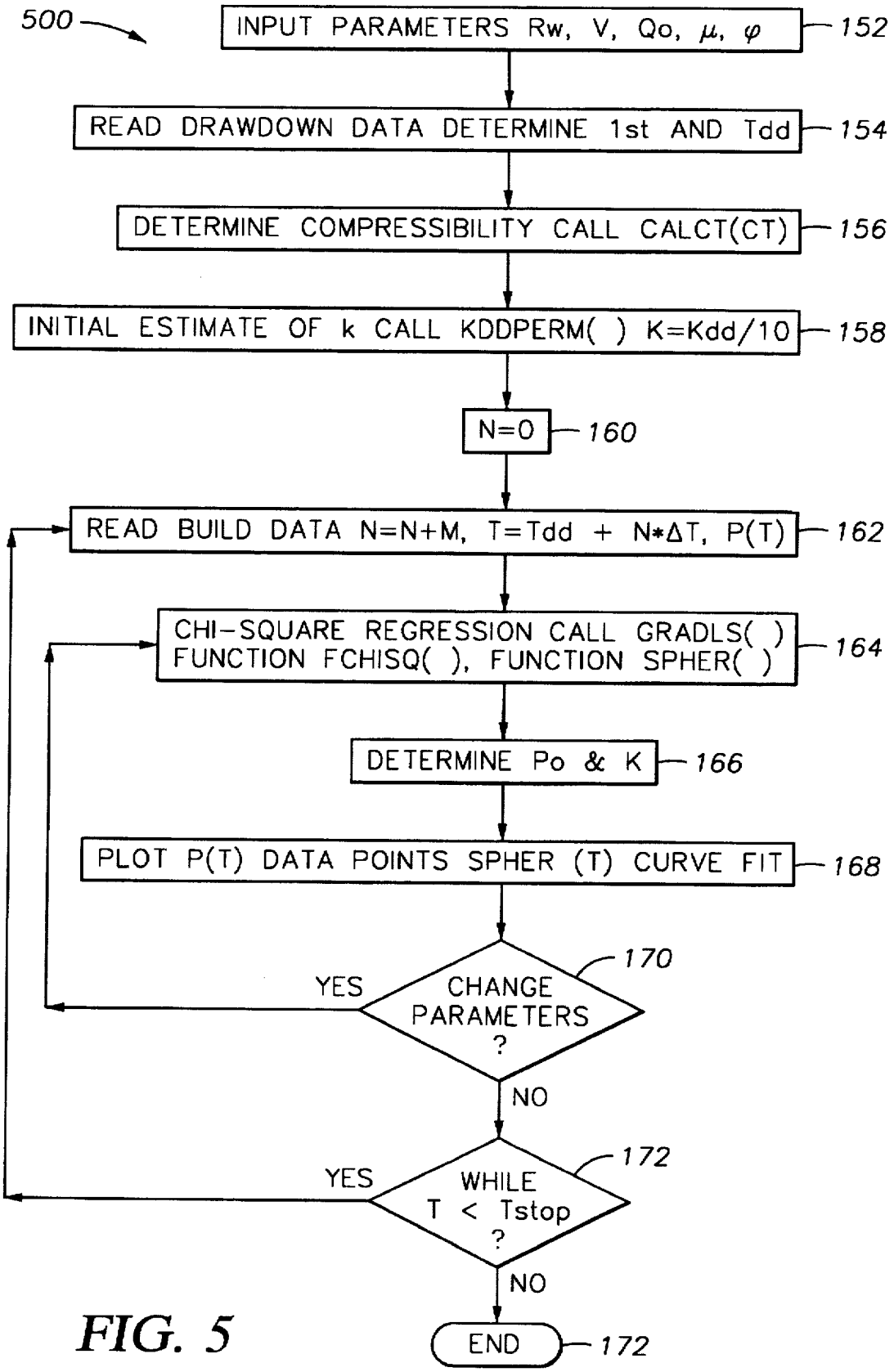
FIG. 5 is a flowchart representing a preferred, electronically-implemented method of determining formation properties using the pressure measurements obtained by a formation tester.

The flowchart 150 illustrated in FIG. 5 describes an electronically implemented method for determining formation properties using the pressure plots obtained by the formation tester. While the flowchart 150 is provided and described for ease of illustration, it should be understood that it is based on an electronic implementation, such as the computer program listed in Appendix II which is loaded into the memory of a suitable processor and executed as is well known by those skilled in the art. Of the constants listed above, the radius of the well $R_w$, the volume of the flow line V, the injection of production flow rate $Q_O$, the viscosity of the formation fluid $\mu$, and the porosity of the formation $\phi$ are known parameters. In the block 152, these parameters are input into the program. In the block 154, the program receives the pressure data being measured by the formation tester. As illustrated, the drawdown data is read first, and the beginning drawdown cycle $t_{start}$ and the beginning of the buildup cycle $t_{dd}$ are determined. Thus, referring to the constants listed above, the pressure at the probe $P(R_w,t)$ and the test time t are measured by the formation tester and utilized by the program.

In the block 156, the compressibility of the flow line fluid C and the compressibility of the formation fluid c, which are normally assumed to be the same, are determined. As stated in the flowchart, the program calls the subroutine CALCT (CT) as given in the program listing attached hereto as Appendix II. During the initial drawdown time period, the fluid in the flowline is decompressed by the pretest piston movement. When the drawdown pressure drops below the sandface pressure, the mudcake at the probe is pulled away by the sudden start of fluid being extracted from the formation (assuming a permeable zone). Since the volume of the fluid in the flowline is known ($V_{fl}$) and the rate of decompression ($Q_O$) is known, the compressibility of the flowline fluid can be determined by comparing the pressure derivative to the rate of volume change created by the pretest chamber. The flowline fluid compressibility can be determined by locating the minimum (negative value) of the pressure derivative from the time period $t_{start}$ to $t_{dd}$.

The discrete pressure time derivative is defined as follows:

$$\left(\frac{\Delta P}{\Delta T}\right)_n = \frac{P_n - P_{n+1}}{T_n - T_{n+1}} \tag{10}$$

The index of the minimum pressure derivative n=n* is determined during the drawdown time period:

$n = n^*$
when:

$$\left(\frac{\Delta P}{\Delta T}\right)_{n^*} = \min\left\{\left(\frac{\Delta P}{\Delta T}\right)_i\right\}_{i=start}^{i=dd} \quad (11)$$

The flowline fluid compressibility can be estimated as follows:

$$C = \frac{Q_0}{V_{f1}\left(\frac{\Delta P}{\Delta T}\right)_{n^*}} \quad (12)$$

It should be noted that C is recorded on the first minimum pressure derivative. This is because the most accurate estimate of compressibility occurs just prior to the likely removal of the mudcake by the probe. This is also confirmed by equation A-40 in Appendix I.

In block 158, an initial estimate of the permeability of the formation k is determined. As illustrated, a subroutine KDDPERM is called, and the estimate of the permeability k is determined, where k=kdd/10. By referring to the subroutine KDDPERM described in the attached Appendix II, it can be seen that if the pretest were to continue for an extended time (i.e., $t_{pro} \rightarrow \infty$) equation 1 is used to determine the steady state drawdown pressure.

$$P(R_w, t \rightarrow \infty) = P_{DD} = r_w \frac{VCQ_0\mu}{16\pi^2 R^4 K\Phi C} = \frac{Q_0\mu}{4\pi R_w K}(1+\gamma) \quad (13)$$

And the drawdown permeability $K_{DD}$ can be estimated by solving for K.

$$K = K_{DD} = \frac{Q_0\mu}{4\pi R_w P_{DD}}(1+\gamma) \quad (14)$$

An initial estimate of the permeability k is provided because the formation pressure $P_o$ and the permeability of the formation k are determined iteratively using regression analysis. To begin this iterative analysis, a counter N is set to zero in the block 160. In the block 162, the program reads the buildup pressures being measured by the formation tester. The counter N is incremented by M, where M represents a block of data read. The time T, which begins at time $t_{bu}$, is incremented by the counter times the change in time Δt between measurements. In block 164, the program performs a chi-square regression analysis by calling the subroutine GRADLS, set forth in Appendix II attached hereto. With the help of the functions FCHISQ and SPHER, the subroutine GRADLS, using equation 1, 7, or 8 (in this case equation 7) determines the formation pressure $P_0$ and the permeability k, as set forth in the block 166.

In the block 168, the pressure data being measured by the formation tester is plotted on a monitor (not shown), along with the calculated curve fit. As will be described in more detail in reference to the later figures, the calculated curve fit provides a projection which estimates future pressure readings. Thus, as the buildup cycle progresses, the calculated curve fit becomes more and more accurate. When the curve fit ceases to change in any meaningful manner as more data points are collected from the measured pressures, the formation test may be stopped because the parameters of interest have been determined accurately by the curve fit. The operator may stop the test by a determination he makes by viewing the plotted curve vs. the pressure data, or the program may make the determination and signal the operator to terminate the test.

However, it is possible that the parameters input in the block 152 or the parameters subsequently determined or estimated in the blocks 154, 156, or 158 are inaccurate in some regard, causing the calculated curve fit to deviate significantly from the plot of measured pressure data. If this is the case, parameters may be changed in the block 170. Once changed, the steps described in the blocks 164, 166, and 168 are repeated with the new parameters.

If the parameters are not changed, control of the program is passed to the block 172 where the program inquires to whether the test has been terminated at $t_{stop}$. Thus, while the analysis proceeds, the block 172 transfers control back to the block 162 to perform another iteration. Once the analysis is complete, control transfers to the block 174 where the program ends.

The term $t_{stop}$, generally refers to a signal input by the operator indicating that the analysis of the pressure data is complete. In other words, the following scenarios may exist. First, the analysis may take place real time, with the calculated curve fit being plotted against the measured pressure data. Once the operator or program determines that the calculated curve accurately depicts the parameters of the formation, the analysis may be terminated although the pressure test may continue. Second, the operator may terminate the pressure test, at which time the analysis would terminate accordingly. Third, the analysis may be performed on pressure data prerecorded from previous pressure tests. In this case, the analysis would terminate at the end of the pressure test or when the program determines that the curve fit accurately depicts the parameters of the formation before the termination of the pressure test.

Figure 6:
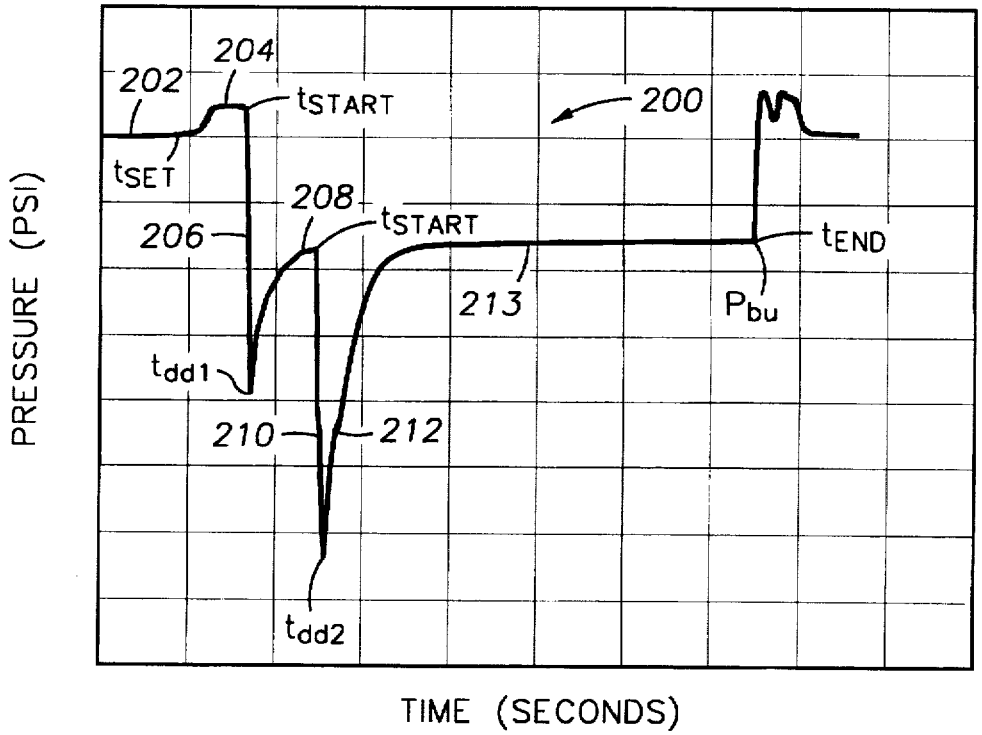
FIG. 6 is an exemplary plot of measured pressure data vs. time taken during a first exemplary pretest sequence.

FIGS. 6, 10, 14, and 18 illustrate four exemplary pretest sequences. The data plot 200 illustrated in FIG. 6 shows an example of a pretest sequence performed in a high permeability formation. The first drawdown/buildup cycle is primarily used for clearing the mudcake from the probe. The second drawdown/buildup cycle is analyzed to determine characteristics of the formation. The curve portion 202 illustrates the hydrostatic pressure in the borehole while the formation tester is being positioned. At about $t_{ser}$, the pressure rise illustrated by the curve portion 204 indicates that the probe has been placed against the wall of the borehole. At $t_{start}$, the first drawdown cycle begins, as illustrated by the curve portion 206. At $t_{dd1}$, the first buildup cycle begins, as illustrated by the curve portion 208. It should be noticed that the first buildup cycle is prematurely terminated before the final buildup pressure is permitted to stabilize, primarily because the first drawdown/buildup cycle is intended to clear the mudcake from the borehole wall to facilitate a second, more accurate, drawdown/buildup cycle. This second drawdown cycle begins at $t_{start2}$, as illustrated by the curve portion 210. The second buildup cycle begins at $t_{start2}$, as illustrated by the curve portions 212 and 213. As can be seen, the pressure is allowed to build until the measured pressure stabilizes at $p_{bu}$. At $t_{end}$, the probe is removed from the wall of the borehole, as indicated by the curve portion 214.

Figure 7:
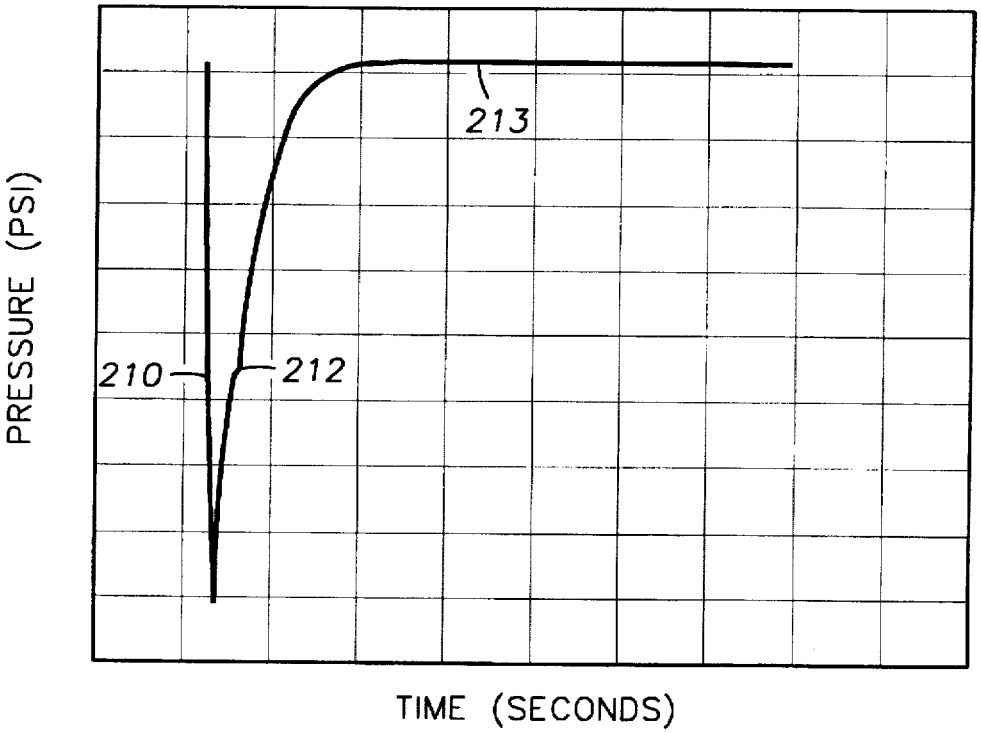
FIG. 7 is a magnified portion of the plot illustrated in FIG. 6.
Figure 8:
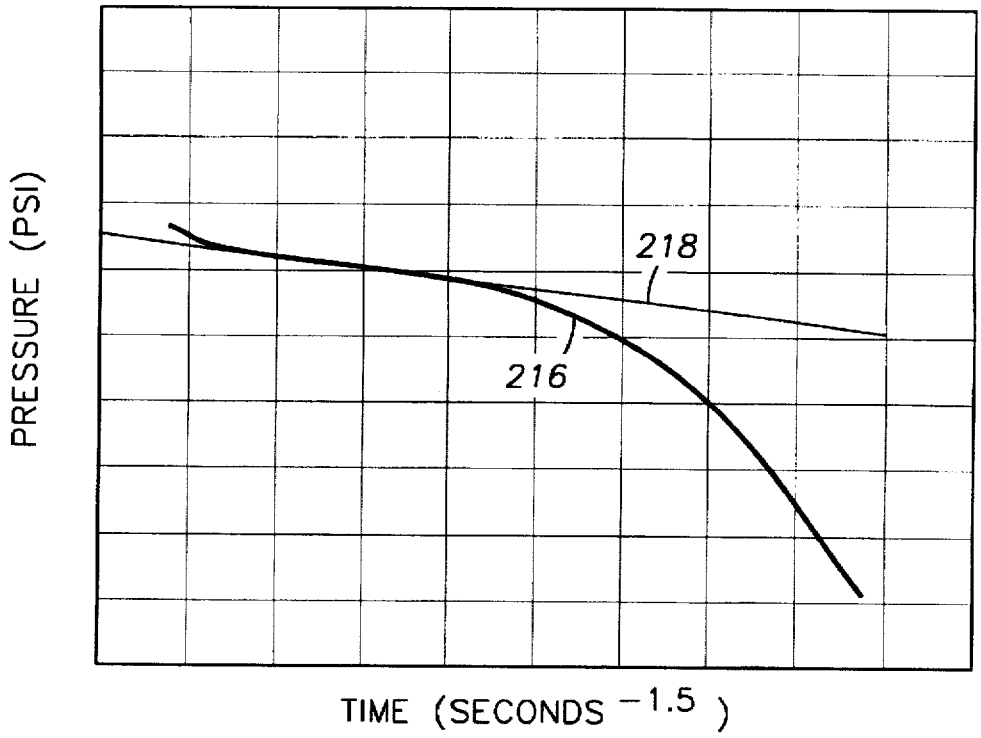
FIG. 8 is a plot of measured pressure data, taken from the plot of FIG. 6, vs. $time^{-1.5}$ showing a straight line that is curve-fitted to the data.
Figure 9:
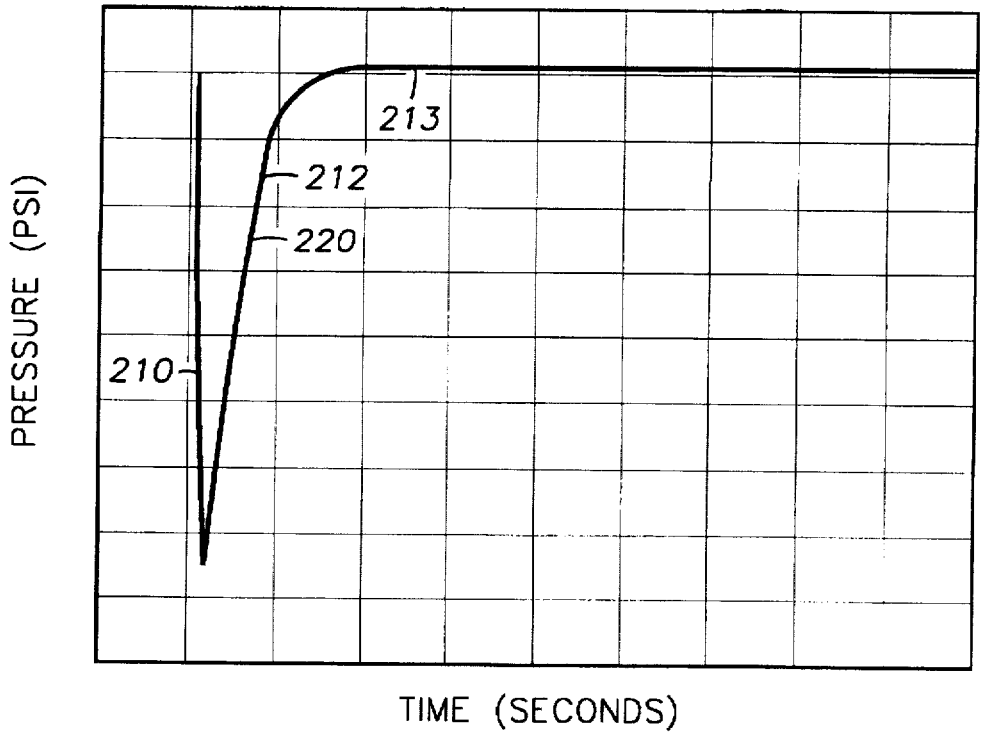
FIG. 9 is a magnified portion of the plot of FIG. 6 showing a type-curve that is curve-fitted to the data in accordance with the present invention.

The second drawdown/buildup cycle is illustrated in greater detail in FIG. 7, as indicated by the curve portions 210, 212, and 213. Using conventional type-curve matching techniques, the end portion of the curve portion 213 is plotted as shown by the curve portion 216 in FIG. 8, and a straight line 218 is curve-fitted to a linear portion of the curve portion 216. Thus, it can be seen that only a very small portion of the total data collected in the plot 200 is actually used to determine the permeability and formation pressure of the formation. However, as illustrated in FIG. 9, using the new technique described herein, the CPId generates a type curve 220 which matches the entire second drawdown/buildup cycle, thus making all of the data making up the curve portions 210, 212, and 213 usable in determining the characteristics of the formation.

Figure 10:
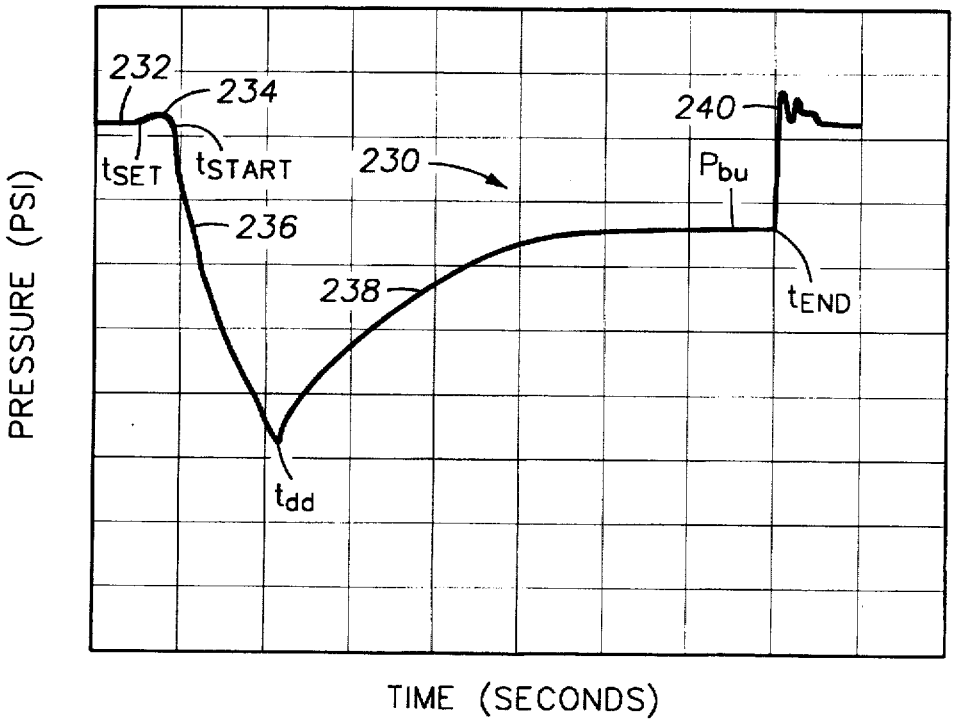
FIG. 10 is an exemplary plot of measured pressure data vs. time taken during a second exemplary pretest sequence.

The data plot 230 illustrated in FIG. 10 shows an example of a pretest sequence performed in a low permeability formation. In a low permeability formation, a drawdown/buildup cycle may take over an hour before the measured pressure stabilizes at $p_{bu}$. Therefore, a first drawdown/buildup cycle is typically not performed. Thus, even though the mudcake may affect the measured pressure, the first, and only, drawdown/buildup cycle is analyzed to determine characteristics of the formation.

As shown in FIG. 10, the curve portion 232 illustrates the hydrostatic pressure in the borehole while the formation tester is being positioned. At about $t_{set}$, the pressure rise illustrated by the curve portion 234 indicates that the probe has been placed against the wall of the borehole. At $t_{start}$, the drawdown cycle begins, as illustrated by the curve portion 236. At $t_{dd}$, the buildup cycle begins, as illustrated by the curve portion 238. As can be seen, the pressure is allowed to build until the measured pressure levels at $p_{bu}$. At $t_{end}$, the probe is removed from the wall of the borehole, as indicated by the curve portion 240. A comparison of the plot 230 with the plot 200 shows that the pressure drops more slowly and rises more slowly in the low permeability formation as compared with a high permeability formation.

Figure 11:
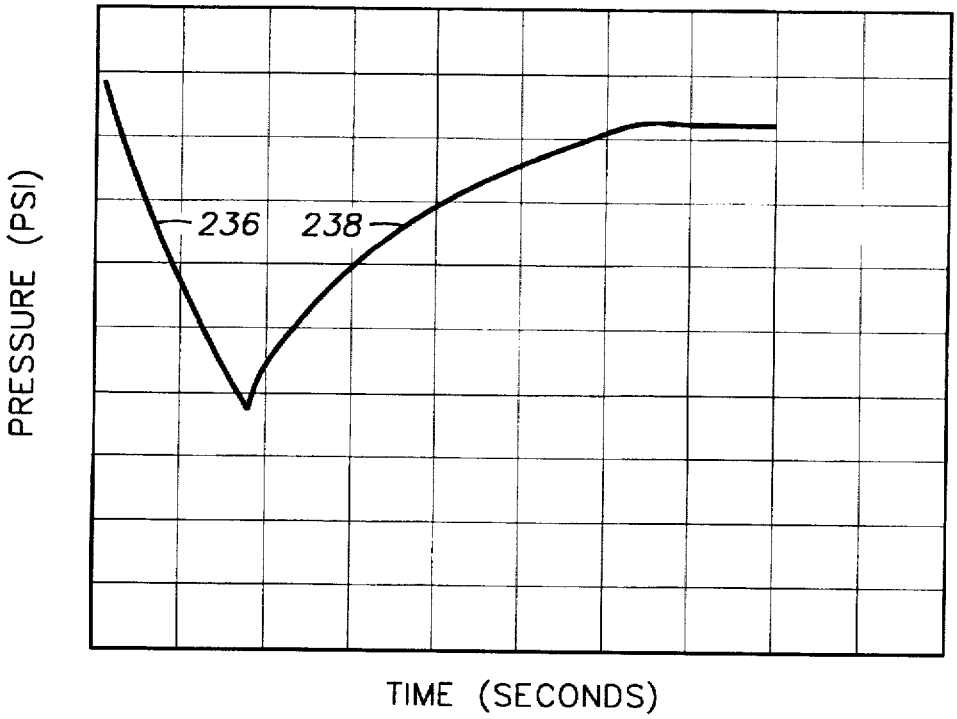
FIG. 11 is a magnified portion of the plot illustrated in FIG. 10.
Figure 12:
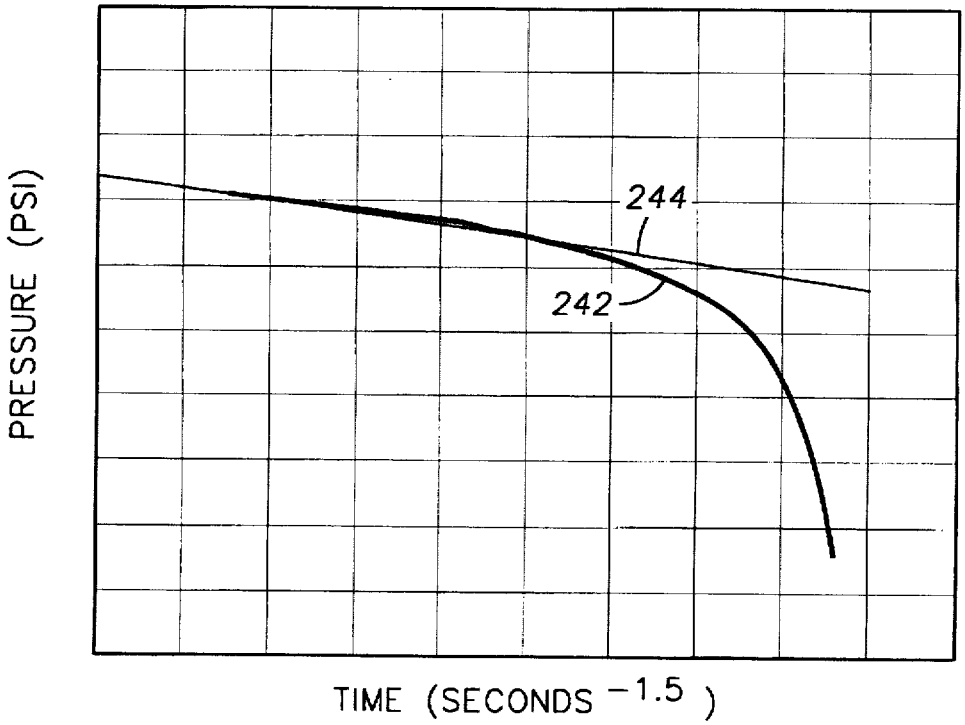
FIG. 12 is a plot of measured pressure data, taken from the plot of FIG. 10, vs. $time^{-1.5}$ showing a straight line that is curve-fitted to the data.
Figure 13:
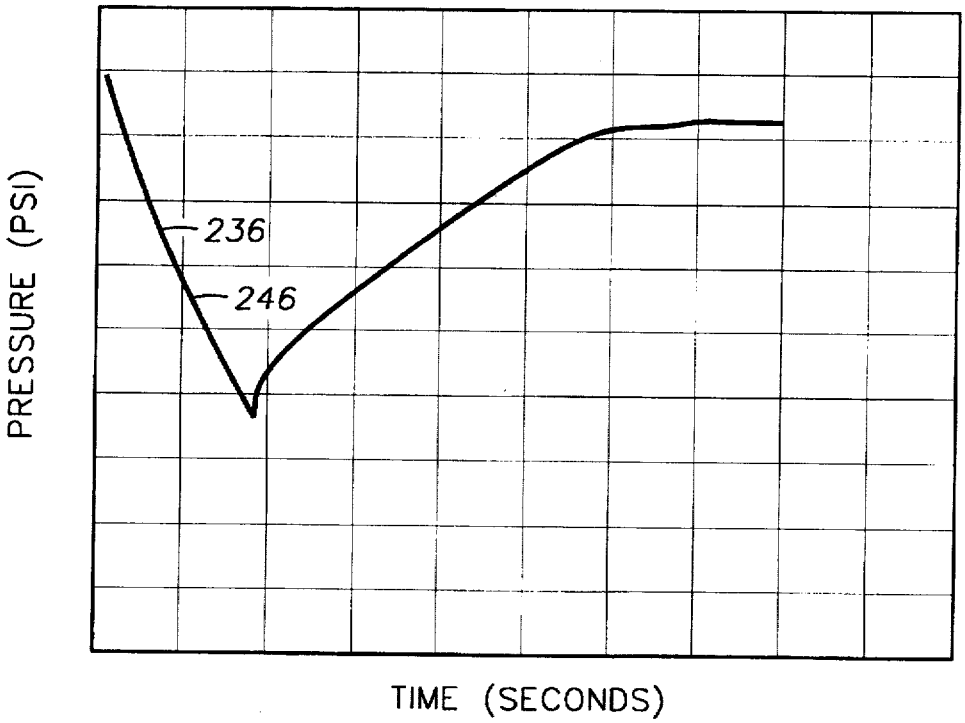
FIG. 13 is a magnified portion of the plot of FIG. 10 showing a type-curve that is curve-fitted to the data in accordance with the present invention.
Figure 14:
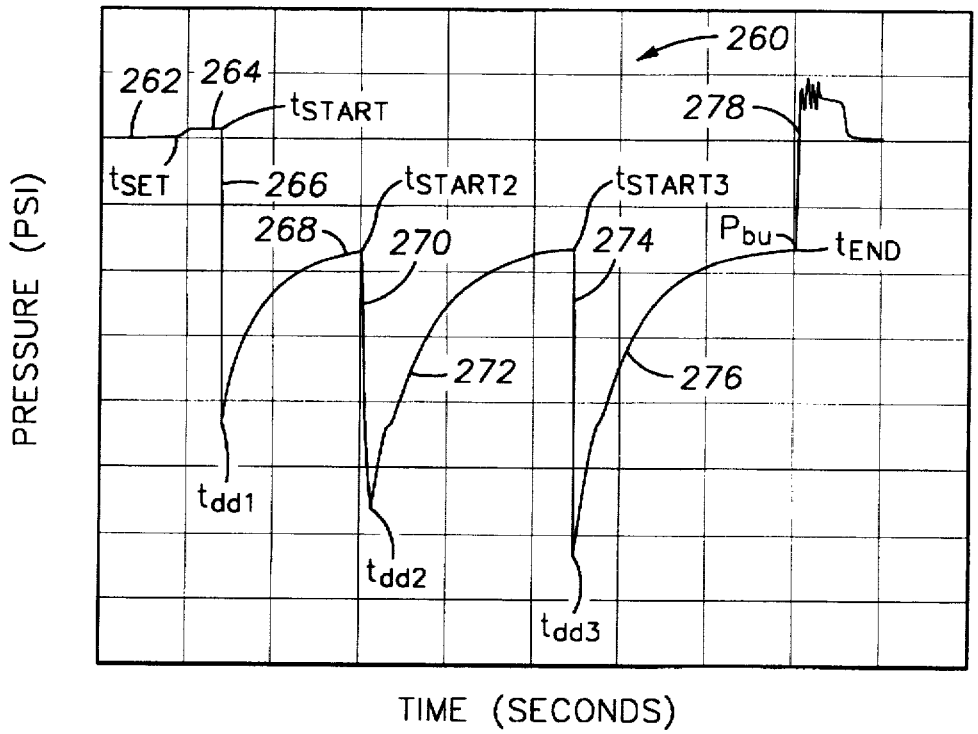
FIG. 14 is an exemplary plot of measured pressure data vs. time taken during a third exemplary pretest sequence.

The drawdown/buildup cycle is illustrated in greater detail in FIG. 11, as indicated by the curve portions 236 and 238. Using conventional type-curve matching techniques, the end portion of the curve portion 238 is plotted as shown by the curve portion 242 in FIG. 12, and a straight line 244 is curve-fitted to a linear portion of the curve portion 242. Thus, it can be seen that only a very small portion of the total data collected in the plot 230 is actually used to determine the permeability and formation pressure of the formation. However, as illustrated in FIG. 13, using the new technique described herein, the CPU generates a type curve 246 which matches the entire drawdown/buildup cycle, thus making all of the data making up the curve portions 236 and 238 usable in determining the characteristics of the formation.

Because the new technique makes use of all of the measured data, the pressure during the buildup cycle need not stabilize at the formation pressure. All that is generally recommended is that the pressure be measured in the buildup cycle until sufficient data is acquired to determine an accurate curve fit. Thus, the pretest sequence may be substantially shortened or revised. For instance, as illustrated by the plot 260 in FIG. 14, several drawdown/buildup cycles may be performed in low permeability formations in the time previously allocated to a single drawdown/buildup cycle.

The first drawdown/buildup cycle is primarily used for clearing the mudcake from the probe. The curve portion 262 illustrates the hydrostatic pressure in the borehole while the formation tester is being positioned. At about $t_{set}$, the pressure rise illustrated by the curve portion 264 indicates that the probe has been placed against the wall of the borehole. At $t_{start}$, the first drawdown cycle begins, as illustrated by the curve portion 266. At $t_{dd1}$, the first buildup cycle begins, as illustrated by the curve portion 268. It should be noticed that the first buildup cycle is prematurely terminated before the final buildup pressure is permitted to stabilize, primarily because the first drawdown/buildup cycle is intended to clear the mudcake from the borehole wall to facilitate a second, more accurate, drawdown/buildup cycle.

The second drawdown cycle begins at $t_{start2}$, as illustrated by the curve portion 270. However, as can be seen from a study of the curve portion 270, the pressure fluctuates during the drawdown cycle. This fluctuation may indicate that the tester is partially clogged. The second buildup cycle begins at $t_{dd2}$, as illustrated by the curve portion 272. The pressure builds until the measured pressure begins to level off at the formation pressure. However, because of the uncertainty of the second cycle, the operator chooses to perform a third drawdown/buildup cycle, which begins at $t_{start3}$, as illustrated by the curve portion 274. The third drawdown cycle appears much smoother than the second drawdown cycle, indicating that the blockage of the tester has been cleared. The third buildup cycle begins at $t_{dd3}$, as indicated by the curve portion 276. Again, the pressure builds until the measured pressure begins to level off at $p_{bu}$. At $t_{end}$, the probe is removed from the wall of the borehole, as indicated by the curve portion 278.

Figure 15:
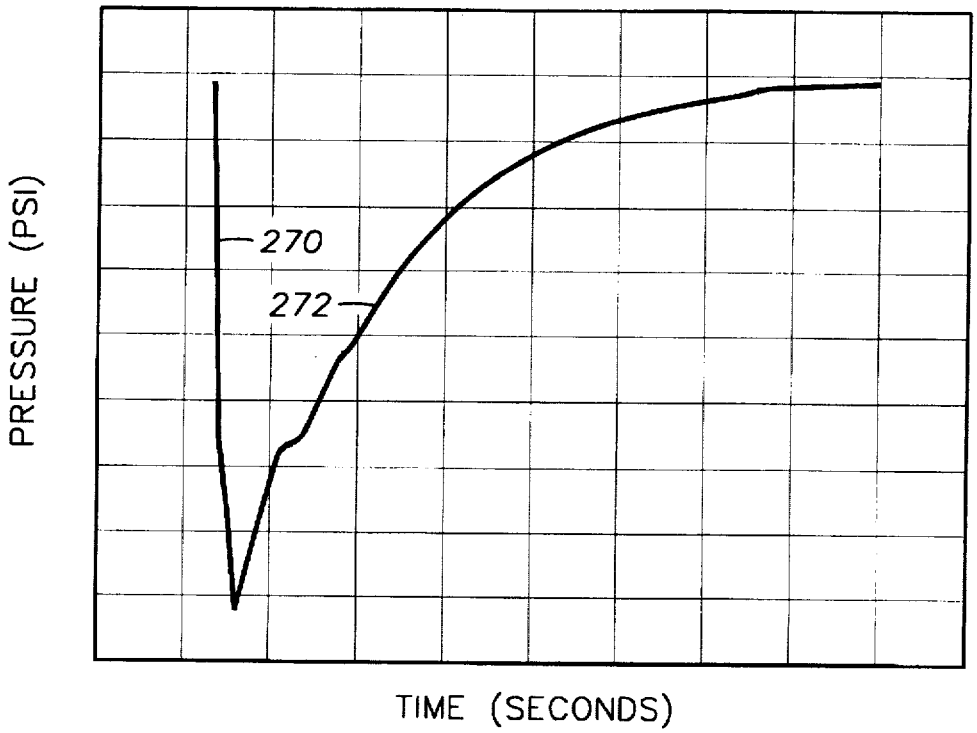
FIG. 15 is a magnified portion of the plot illustrated in FIG. 14.
Figure 16:
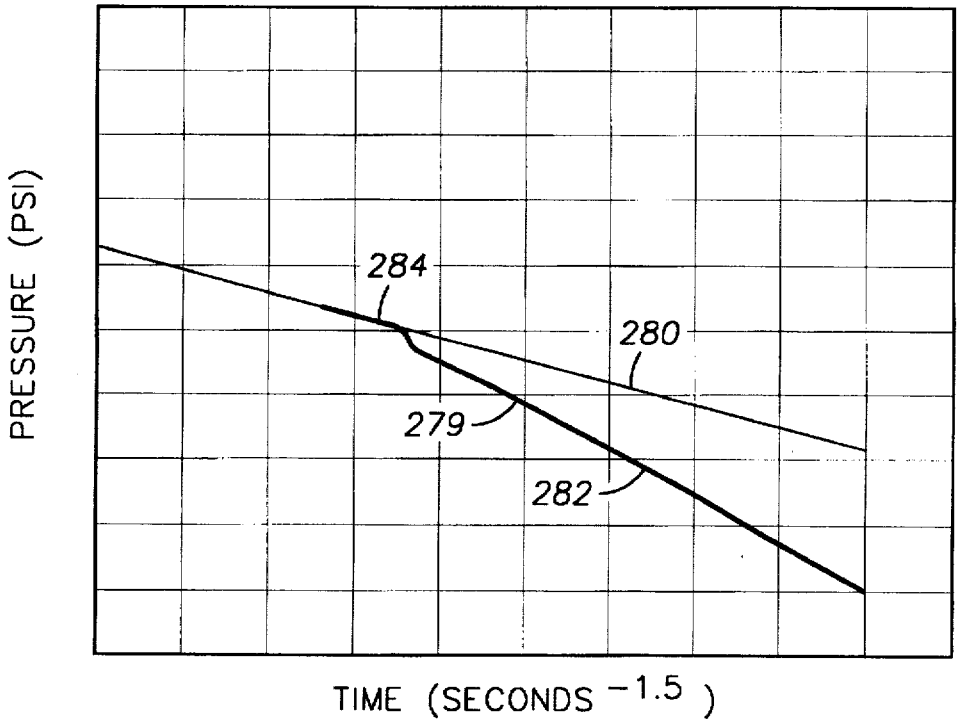
FIG. 16 is a plot of measured pressure data, taken from the plot of FIG. 14, vs. $time^{1.5}$ showing a straight line that is curve-fitted to the data.

Subsequent evaluation indicates that the second drawdown/buildup cycle is analyzed according to the new technique to provide accurate formation information, while analysis using conventional techniques provides inaccurate information. The second drawdown/buildup cycle is illustrated in greater detail in FIG. 15, as indicated by the curve portions 270 and 272. Using conventional type-curve matching techniques, the end portion of the curve portion 272 is plotted as shown by the curve portion 279 in FIG. 16, and a straight line 280 is curve-fitted to a linear portion of the curve portion 279. However, it can be seen that the curve portion 279 contains two linear portions, 282 and 284. The straight line 280 is curve-fitted to the linear portion 284, but it could just as easily be curve-fitted to the linear portion 282. Obviously, the linear portion 282 or 284 to which the straight line 280 is fitted will greatly affect the information provided by the second buildup cycle.

Figure 17:
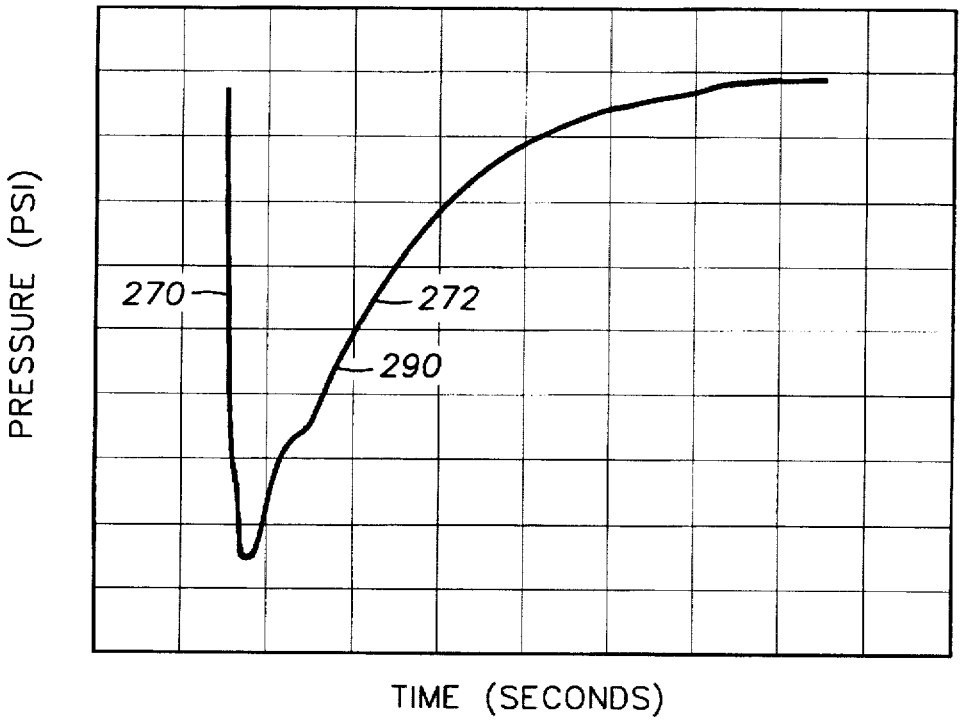
FIG. 17 is a magnified portion of the plot of FIG. 15 showing a simulated curve that is curve-fitted to the data in accordance with the present invention.

However, as illustrated in FIG. 17, using the new technique described herein, the CPU generates a type curve 290 which matches the entire second drawdown/buildup cycle, thus making all of the data making up the curve portions 270 and 272 usable in determining the characteristics of the formation. Thus, the fluctuation in the pressure measured toward the end of the second buildup cycle barely affects the accuracy of the information provided by the type curve 290.

Figure 18:
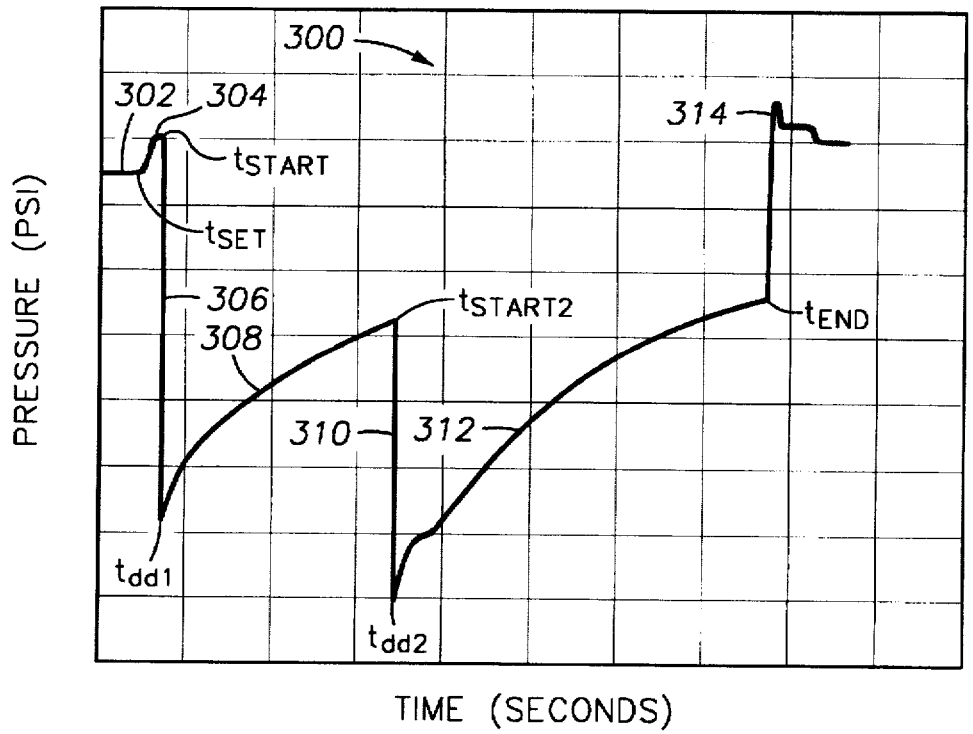
FIG. 18 is an exemplary plot of measured pressure data vs. time taken during a fourth exemplary pretest sequence.

As previously mentioned, all that is generally recommended is that the pressure be measured in the buildup cycle after sufficient data is acquired to determine an accurate curve fit. Thus, the buildup cycle may be terminated before the pressure even begins to stabilize near the formation pressure, thus further shortening the pretest sequence. Such a pretest sequence is illustrated by the plot 300 shown in FIG. 18. Although only a single drawdown/buildup cycle need be performed, FIG. 18 illustrates two such cycles, where the first cycle is primarily intended to clear the mudcake from the probe. The second drawdown/buildup cycle is analyzed to determine characteristics of the formation. The curve portion 302 illustrates the hydrostatic pressure in the borehole while the formation tester is being positioned. At about $t_{set}$, the pressure rise illustrated by the curve portion 304 indicates that the probe has been placed against the wall of the borehole. At $t_{start}$, the first drawdown cycle begins, as illustrated by the curve portion 306. At $t_{dd1}$, the first buildup cycle begins, as illustrated by the curve portion 308. The first buildup cycle is prematurely terminated before the final buildup pressure is permitted to stabilize, primarily because the first drawdown/buildup cycle is intended to clear the mudcake from the borehole wall to facilitate a second, more accurate, drawdown/buildup cycle. This second drawdown cycle begins at $t_{start2}$, as illustrated by the curve portion 310. The second buildup cycle begins at $t_{dd2}$, as illustrated by the curve portion 312.

As with the first buildup cycle, the second buildup cycle is terminated before the final buildup pressure is permitted to stabilize in order to shorten testing time. At $t_{end}$, the probe is removed from the wall of the borehole, as indicated by the curve portion 314.

Figure 20:
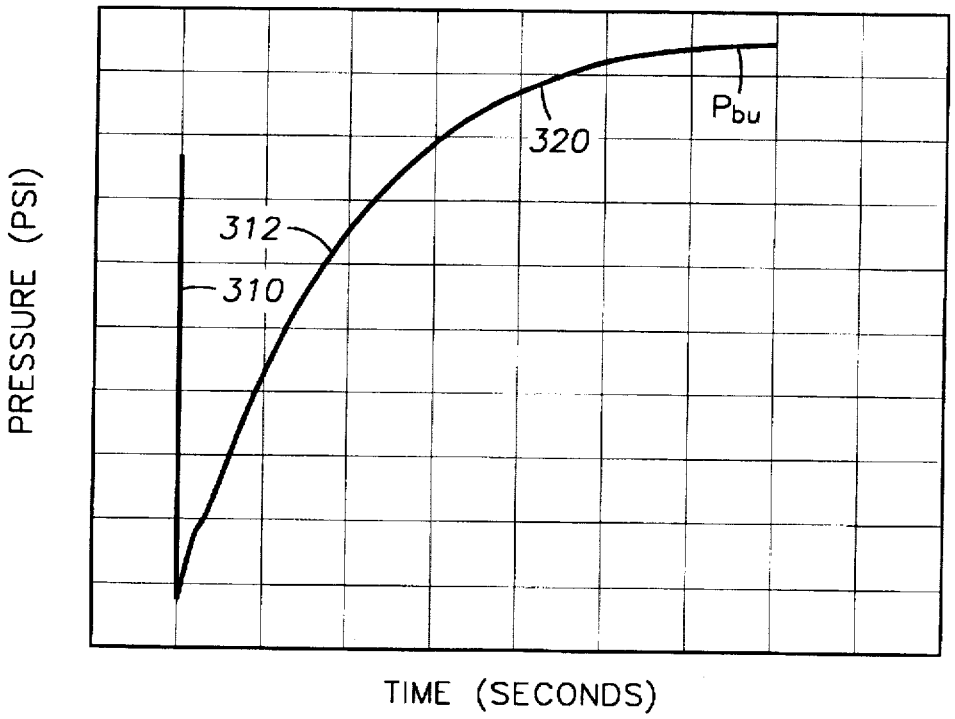
FIG. 20 is a magnified portion of the plot of FIG. 18 showing a type-curve that is curve-fitted to the data in accordance with the present invention.
Figure 19:
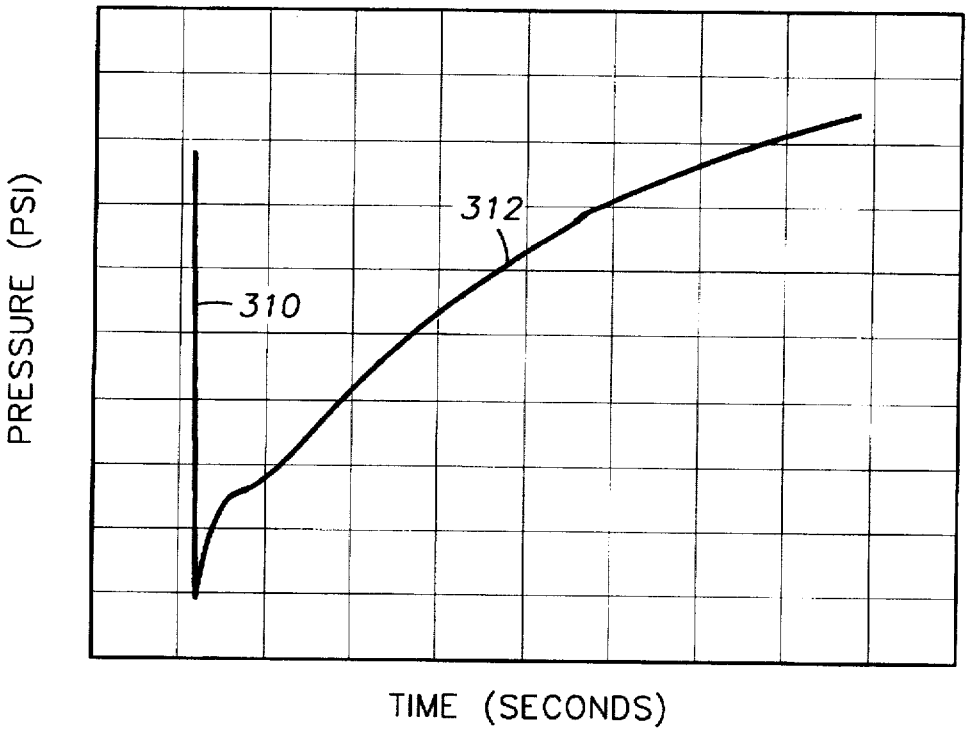
FIG. 19 is a magnified portion of the plot illustrated in FIG. 18.

The second drawdown/buildup cycle is illustrated in greater detail in FIG. 19, as indicated by the curve portion 310 and 312. Conventional type-curve matching techniques cannot be used on such data because buildup pressure has not been allowed to reach formation pressure. Thus, any straight line curve-fitter to the data as previously shown would render very inaccurate information. As illustrated in FIG. 20, using the new technique described herein, the CPU generates a type curve 320 which matches the entire second drawdown/buildup cycle and which predicts the ultimate formation pressure, as shown by the portion of the type curve 320 which extends past the last measured pressure data.

The present invention thus provides for an exact spherical flow model which considers the effects of flowline storage for use with formation testers. The generation of the type curve is applicable to accumulated pressure data and may be used to predict formation pressure prior to achieving near steady state values near the formation pressure. Various changes may be made to the disclosed embodiment and inventive concept without departing from the spirit of the claimed invention.

APPENDIX I

Exact Spherical Flow Solution

Let us consider transient, compressible, liquid Darcy flow in a homogeneous, isotropic medium, and specifically study the spherically symmetric flow produced into a "spherical well" of radius $R_w$ from an infinite reservoir. Let P(r,t) represent the fluid pressure, where r and t are radial and time coordinates. Also, let $P_0$ denote the constant initial and farfield pressure, while $\phi$, $\mu$, c, and k, respectively, refer to rock porosity, fluid viscosity, combined rock-matrix and fluid compressibility, and formation permeability. In addition, let V denote the volume associated with the storage capacity of the spherical well, e.g., the flow line volume in the formation tester, with C being the compressibility associated with this volume. Finally, we denote by Q(t) the total volume rate produced by the spherical well, due to sandface production plus volume storage effects. The boundary value problem is completely specified by the mathematical model $$\partial^2 P(r,t)/\partial r^2+2/r\partial P/\partial r=(\phi\mu c/k)\partial P/\partial t \quad \text{(A-1)}$$

$$P(r,t=0)=P_0 \quad \text{(A-2)}$$

$$P(r=\infty,t)=P_0 \quad \text{(A-3)}$$

$$(4\pi R_w^2 k/\mu)\partial P(R_w,t)/\partial r-VC\partial P/\partial t=Q(t) \quad \text{(A-4)}$$

Problem formulation. In order to introduce analytical simplifications and to determine the governing dimensionless parameters in their most fundamental form, we define the nondimensional italicized variables r, t, and p, which are respectively normalized by the quantities r*, t*, and p*, as follows, $$r=r/r^* \quad \text{(A-5)}$$

$$t=t/t^* \quad \text{(A-6)}$$

$$p(r,t)=\{P(r,t)-P_0\}/p^* \quad \text{(A-7)}$$

and take the production (or injection) rate in the form $$Q(t)=Q_0F(t) \quad \text{(A-8)}$$

where $Q_0$ is a positive (or negative) reference flow rate and the dimensionless function F is given. If we now choose $$r^*=VC/(4\pi R_w^2\phi c)>0 \quad \text{(A-9)}$$

$$t^*=V^2C^2\mu/(16\pi^2R_w^4k\phi c)>0 \quad \text{(A-10)}$$

$$p^*=VCQ_0\mu/(16\pi^2R_w^4k\phi c) \quad \text{(A-11)}$$

the boundary value problem reduces to $$\partial^2 p(r,t)/\partial r^2+2/r\partial p/\partial r=\partial p/\partial t \quad \text{(A-12)}$$

$$p(r,0)=0 \quad \text{(A-13)}$$

$$p(\infty,t)=0 \quad \text{(A-14)}$$

$$\partial p(r_w,t)/\partial r-\partial p/\partial t=F(t) \quad \text{(A-15)}$$

which is free of formulation parameters, except for the single dimensionless radius $r_w>0$ given by $$r_w=4\pi R_w^3\phi c/(VC) \quad \text{(A-16)}$$

Solution using Laplace transforms. In order to solve this problem, we introduce the Laplace transform $$p(r,s)=\int\exp(-st)p(r,t)dt \quad \text{(A-17)}$$

where the t integration is taken over $0<t<\infty$, and limits are omitted for brevity, and s>0 is required in order that the integral exist. If we multiply Equation A-12 by exp(−st) throughout and perform the suggested $(0,\infty)$ integration, simple integration-by-parts and transform table look-up leads to $$d^2p(r,s)/dr^2+2/rdp/dr=sp-p(r,0). \quad \text{(A-18)}$$

Similarly, Equation A-14 leads to $$\int\exp(-st)p(\infty,t)dt=\int\exp(-st)0dt=0$$

or $$p(\infty,s)=0 \quad \text{(A-19)}$$

while Equation A-15 becomes $$dp(r_w,s)/dr-sp+p(r_w,0)=F(s) \quad \text{(A-20)}$$

where $F(s)=\int\exp(-st)F(t)\,dt$ is the Laplace transform of F(t). Now, since Equation A-13 requires that p(r,0)=0, Equations A-18 and A-20 respectively simplify to $$d^2p(r,s)/dr^2+2/rdp/dr-sp=0 \quad \text{(A-21)}$$

$$dp(r_w,s)/dr-sp=F(s). \quad \text{(A-22)}$$

Equation A-21 is a special case of Bessel's equation having the solution $$p(r,s)=r^{-1/2}\{C_1I_{1/2}(rs^{1/2})+C_2I_{-1/2}(rs^{1/2})\} \quad \text{(A-23)}$$

where the Bessel functions $I_{1/2}$ and $I_{-1/2}$ are conventionally given as $$I_{1/2}(rs^{1/2})=\sqrt{\{2/(\pi rs^{1/2})\}}\sinh(rs^{1/2}) \quad \text{(A-24)}$$

$$I_{-1/2}(rs^{1/2})=\sqrt{\{2/(\pi rs^{1/2})\}}\cosh(rs^{1/2}). \quad \text{(A-25)}$$

However, in applying the farfield regularity condition, we observe that the functions $\sinh(rs^{1/2})$ and $\cosh(rs^{1/2})$ both increase indefinitely as $|rs^{1/2}|\to\infty$, so that it is impossible to directly satisfy $p(\infty,s)=0$. In order to use the solution in Equation A-23, we need to recognize that sinh $(rs^{1/2})=\frac{1}{2}\{e^{r\sqrt{s}}-e^{-r\sqrt{s}}\}$ and cosh $(rs^{1/2})=\frac{1}{2}\{e^{r\sqrt{s}}+e^{-r\sqrt{s}}\}$, which allows us to equivalently express Equation A-23 in the form $$p(r,s)=r^{-1}\{C_3e^{r\sqrt{s}}+C_4e^{-r\sqrt{s}}\} \quad \text{(A-26)}$$

where the "s"'s 's of Equations A-24 and A-25 have been absorbed into the definition of $C_3$ and $C_4$. Now, the requirement from Equation A-19 that $p(\infty,s)=0$ is easily enforced by taking $C_3=0$, which leaves $$p(r,s)=C_4r^{-1}e^{-r\sqrt{s}}. \quad \text{(A-27)}$$

Substitution of Equation A-27 in Equation A-22 leads to an expression for the integration constant $C_4$, namely $$C_4(s)=-\{F(s)r_w^2 \exp(r_ws^{1/2})\}/\{r_ws+r_ws^{1/2}+1\}. \quad \text{(A-28)}$$

Hence, Equation A-27 takes the final form $$p(r,s)=-\{F(s)r_w^2 \exp(r_ws^{1/2})\}\{r^{-1} \exp(-rs^{1/2})/\{r_ws+r_ws^{1/2}+1\} \quad \text{(A-29)}$$

which applies to all values of r. In this appendix, though, we will only be interested in values of r at the sandface, that is, at $r=r_w$. Evaluating Equation A-29 there, we have the final pressure transform at the well $$p(r_w,s)=-F(s)/(s+s^{1/2}+r_w^{-1}). \quad \text{(A-30)}$$

Build-up or drawdown example. We illustrate the solution technique by considering the simple case when $$Q(t)=Q_0F(t)=Q_0 \quad \text{(A-31)}$$

that is, F(t)=1. where $Q_0>0$ for production (pressure drawdown) and $Q_0<0$ for production (pressure buildup). Thus, it follows that $$F(s)=1/s \quad \text{(A-32)}$$

$$p(r_w,s)=-1/\{s(s+s^{1/2}+r_w^{-1})\}. \quad \text{(A-33)}$$

Equation A-33 can be more conveniently written using partial fraction expansions as $$\begin{aligned} p(r_w,s) &= -1/\{s(\beta_1+s^{1/2})(\beta_2+s^{1/2})\} \quad \text{(A-34)} \\ &= \{1/(\beta_1-\beta_2)\}\{1/(s(\beta_1+s^{1/2}))-1/(s(\beta_2+s^{1/2}))\} \end{aligned}$$

where the complex constants $\beta_1$, and $\beta_2$ satisfy $$\beta_1=+\tfrac{1}{2}-\tfrac{1}{2}\sqrt{(1-4r_w^{-1})} \quad \text{(A-35)}$$

$$\beta_2=+\tfrac{1}{2}+\tfrac{1}{2}\sqrt{(1-4r_w^{-1})}. \quad \text{(A-36)}$$

If we now apply the transform-inverse relationship $$1/(\beta+s^{1/2}))\rightarrow\beta^{-1}\,erfc\,(0)-\beta^{-1}\exp(\beta^2t)\,erfc\,(\beta\sqrt{t}) \quad \text{(A-37)}$$

and use the fact that $$erfc\,(0)=1 \quad \text{(A-38)}$$

we obtain the exact dimensionless transient pressure function as $$p(r_w,t)=\{1/(\beta_1-\beta_2)\}\{\beta_1^{-1}-\beta_1^{-1}\exp(\beta_1^2t)\,erfc\,(\beta_1\sqrt{t})-\beta_2^{-1}+\beta_2^{-1}\exp(\beta_2^2t)erfc(\beta_2\sqrt{t})\} \quad \text{(A-39)}$$

which is exact for all time t and all $r_w$.

Validation. To show that this reduces to known conventional results at small and large times, we can introduce small time Taylor series and large time asymptotic expansions for the exponential and complementary error functions in Equation A-39. This straightforward procedure yields, on returning to dimensional variables, $$P(R_w,t)=P_0-Q_0t/(VC) \quad \text{(A-40)}$$

at small times, and reproduces a known linear dependence on time that depends on flow-line storage properties only. For production, $Q_0>0$ leads to pressure drawdown, while the pressure buildup is consistently obtained for the injection limit. For large times, Equation A-39 reduces to $$P(R_w,t)=P_0-Q_0\mu/(4\pi R_wk)+\{Q_0\mu/(4\pi k)\}\sqrt{\{\phi\mu c/(\pi kt)\}} \quad \text{(A-41)}$$

which is independent of flow-line storage, depending only upon transport properties such as viscosity and permeability. Equation A-41 also reproduces the known algebraic "square-root" decline in pressure.

Approximate Solution

If equation A-33 is simplified by eliminating the lower order term $s^{1/2}$, then the Laplace space solution becomes $$p(r_w,s)=-1/\{s(s+r_w^{-1})\} \quad \text{(A-42)}$$

Equation (A-42) can be more conveniently written as $$p(r_w,s)=-r_w\{1/s-1/(s+r_w^{-1})\} \quad \text{(A-43)}$$

Now applying inverse Laplace transforms we obtain $$p(r_w,t)=r_w\{1-e^{-(t/rw)}\} \quad \text{(A-44)}$$

Exponential equations similar to A-44 have been used to model wellbore storage. Their derivations are based on empirical observations of typical well bore behavior and are not scientifically rigorous (i.e., van Everdingen, A. F.: "The Skin Effect and Its Influence on the Production Capacity of a Well," Trans., AIME (1953) 198, 171 and Hurst, W.: "Establishment of the Skin Effect and Its Impediment to Fluid Flow into a Wellbore," Pet. Eng. (Oct. 1953) B6.). To the best of our knowledge, the rigorous derivation of equation A-44 result starting from first principles has not been presented in the literature. The derivations given here show that equation A-44 itself represents an approximation to the more complete and exact solution derived earlier.

Now we observe that equation A-41 expressed in dimensionless units becomes $$p(r_w,t)=r_w\{1-r_w/\sqrt{(\pi t)}\} \quad (45)$$

Combining equations A-43 and A-45 yields the approximate formula that closely matches the exact solution given in equation A-39.

$$p(r_w,t)=r_w\{1-r_w/\sqrt{(\pi t)}\}\{1-e^{-(t/rw)}\} \quad (46)$$

The formulas in equations A-44 and A-46 are convenient for fast, approximate calculations, but when high accuracy is required, the exact solution in equation A-39 can be used.

Variable Flow Rates

The above formulation, identical to Brigham's classic wireline formation tester model ("The Analysis of Spherical Flow with Wellbore Storage," SPE Paper 9294, 1980), among others, assumes constant total flow rate injection (or production), where this net flow consists of sandface flow rate and storage expansion effects.

In practice, constant rates may not be realizable in downhole testers, thus time-dependent rates F(t) should be considered instead. The following explains how the exact solution has been extended to handle arbitrarily prescribed flow rates. Using the same dimensionless notation as before, the pressure solution governing the more general problem is $$p(r_w,t) = \{1/(\beta_1 - \beta_2)\} \times \int_0^t F(\tau)\{\beta_2 \exp(\beta_2^2(t-\tau)) erfc\beta_2\sqrt{(t-\tau)} - \beta_1 \exp(\beta_1^2(t-\tau)) erfc\beta_1\sqrt{(t-\tau)}\}d\tau. \quad \text{(A-47)}$$

This reduces to earlier results when F(t)=1, and as before, implicitly contains all "type curve" results that are conventionally given numerically in plots and tables.

Exact Spherical Solution For Complete Reservoir

This section presents a solution for the same spherical flow boundary value problem presented previously with the advantage of solving the problem for all values of r (new nomenclature is introduced where appropriate). This solution enables remote monitoring probes in the reservoir to be used for pressure buildup analysis in addition to the sink probe. Another advantage of this second solution is the fact that conventional dimensionless parameters are used that are familiar to petroleum engineers. This solution follows the same problem formulation and conventions of Brigham's classic wireline formation tester model ("The Analysis of Spherical Flow with Wellbore Storage," SPE Paper 9294, 1980). Restating the basic spherical flow partial differential equation:

$$\frac{\partial^2 p}{\partial r^2} + \frac{2}{r}\frac{\partial p}{\partial r} = \frac{\phi\mu c}{k}\frac{\partial p}{\partial t} \quad \text{(A-48)}$$

The dimensionless parameters are defined in a similar manner as in Brigham's paper:

dimensionless radius:

$$r_D = \frac{r}{r_{sw}} \quad \text{(A-49)}$$

dimensionless time:

$$t_D = \frac{kt}{\phi c\mu r_{sw}^2} \quad \text{(A-50)}$$

dimensionless pressure:

$$p_D(r_D,t_D) = \frac{4\pi r_{sw}(p_o - p)}{Q\mu} \quad \text{(A-51)}$$

dimensionless storage:

$$C_D = \frac{VC}{4\pi\phi c r_{sw}^3} \quad \text{(A-52)}$$

where $r_{sw}$ is defined as the pseudo spherical wellbore radius and Q is a constant volume flow rate. Introducing the dimensionless identifies into the spherical flow equation transforms equation (A-48) into the dimensionless form:

$$\frac{\partial^2 p_D}{\partial r_D^2} + \frac{2}{r}\frac{\partial p_D}{\partial r_D} = \frac{\partial p_D}{\partial t_D} \quad \text{(A-53)}$$

Brigham introduced the additional dimensionless variable $b_d$, a product of $p_d$ and $r_d$ to facilitate the solution:

$$b_D(r_D,t_D) = r_D p_D = \frac{4\pi r(p_o - p)}{Q\mu}. \quad \text{(A-54)}$$

Substituting equation (A-54) into equation (A-53) yields:

$$\frac{\partial^2 b_D(r_D,t_D)}{\partial r_D^2} = \frac{\partial b_D(r_D,t_D)}{\partial t_D}. \quad \text{(A-55)}$$

The initial and outer boundary conditions may be stated as follows:

$$b_D(r_D,0) = 0 \quad \text{(A-56)}$$

$$\lim_{r_D \to \infty}(b_D(r_D,t_d) = 0 \quad \text{(A-57)}$$

and the inner boundary condition is:

$$C_D\frac{\partial b_D}{\partial t_D} - \left(\frac{\partial b_D}{\partial r_D} - b_D\right)\Big|_{r_D=1} = 1. \quad \text{(A-58)}$$

Talking the Laplace transform of the partial differential equation (A-55), it is converted to an ordinary differential equation:

$$\frac{\partial^2 \overline{b_D}(r_D,s)}{\partial r_D^2} = s\overline{b_D}(r_D,s). \quad \text{(A-59)}$$

Then the general solution of this equation for an infinite system can be stated as:

$$\overline{b_D}(r_D,s) = C_1 e^{-r_D\sqrt{2}} \quad \text{(A-60)}$$

where $C_1$ is an arbitrary constant.

Brigham shows that the particular solution in Laplace space can be derived by:

$$\overline{b_D}(r_D,s,C_D) = \frac{e^{-\sqrt{s}(r_D-1)}}{s(1+\sqrt{s}+sC_D)}. \quad \text{(A-61)}$$

From this point Brigham and others used numerical techniques to invert equation (A-61). An exact solution is instead developed by examining this equation and applying an inverse Laplace transform. By rearranging terms in equation (A-61), the Laplace space solution can be expressed as follows:

$$\overline{b_D}(r_D,s,C_D) = \frac{e^{-\sqrt{s}(r_D-1}}{sC_D(\sqrt{s}+\beta_1)(\sqrt{s}+\beta_2)} \quad \text{(A-62)}$$

where:

$$\beta_1 = \frac{1-\sqrt{1-4C_D}}{2C_D} \quad \text{(A-63)}$$

$$\beta_2 = \frac{1+\sqrt{1-4C_D}}{2C_D}. \quad \text{(A-64)}$$

Equation (A-62) can be rewritten as:

$$\overline{b_D}(r_D,s,C_D) = \frac{1}{C_D(\beta_2-\beta_1)}\left\{\frac{e^{-\sqrt{s}(r_d-1)}}{s(\sqrt{s}+\beta_1)} - \frac{e^{-\sqrt{s}(r_D-1)}}{s(\sqrt{s}+\beta_2)}\right\}. \quad \text{(A-65)}$$

Using the inverse Laplace transform from "The Handbook of Mathematical Functions" by M. Abramowitz and I.

A. Stegun (10th printing, December 1972, Equation 29.3.89, page 1027):

$$L^{-1}\left[\frac{e^{-\sqrt{s}\,(r_D-1)}}{s(\sqrt{s}+\beta)}\right]=\frac{1}{\beta}\,erfc\left(\frac{r_D-1}{2\sqrt{t_D}}\right)-\frac{1}{\beta}\cdot e^{\beta(r_D-1)}\cdot e^{\beta^2 t_D}\cdot erfc\left(\beta\sqrt{t_D}+\frac{r_D-1}{2\sqrt{t_D}}\right) \tag{A-66}$$

Equation (A-65) can now be solved and the exact spherical flow solution stated as:

$$p_D(r_D,t_D;C_D)=\frac{1}{r_D C_D(\beta_2-\beta_1)}\left\{\sum_{(n=1)}^{2}\frac{(-1)^{n+1}}{\beta_n}\left[erfc\left(\frac{r_D-1}{2\sqrt{t_D}}\right)-e^{\beta_n(r_D-1)}\cdot e^{\beta_n^2 t_D}\cdot erfc\left(\beta_n\sqrt{t_D}+\frac{r_D-1}{2\sqrt{t_D}}\right)\right]\right\} \tag{A-67}$$

This equation is a general solution for the entire formation and can be used for all values of wellbore radius greater than the pseudo spherical wellbore radius or sink radius (i.e., $r>r_{sw}$). If this equation is evaluated at the pseudo spherical wellbore radius (i.e., $r=r_{sw}$), this solution becomes identical to the solution presented in equation A-39 with the advantage of using standard dimensionless parameters such as $C_D$ and $r_D$ (equation A-39 is advantageous in that no storage or radius parameters explicitly appear). Other improvements can be made to this solution to include anisotropy and skin corrections. These improvements follow the same procedures used by Brigham and others. The main advantage of using equation (A-62) as well as other equations that can be easily derived from it, is that it is an exact solution which makes parameter matching in the data collection and computing systems much faster and more accurate than methods currently used in wireline formation tester logging systems.

Another form of the exact solution shown in equations A-49, A-50, A-51, and A-67 can be developed for the complete drawdown and buildup process. Equation A-49 can be expressed as:

$$p(r_{SW},t;Q_o)=P_o+p_D(r_D,t_D)\left(\frac{Q_o\mu}{4\pi r_{SW}}\right) \tag{A-68}$$

$$p'(r_{SW},t)=p(r_{SW},t;Q_o)+\begin{bmatrix} p(r_{SW},t-t_{pro};-Q_o) & , & t>t_{pro} \\ 0 & , & t<t_{pro}\end{bmatrix} \tag{A-69}$$

where:

$$p_D(r_D,t_D;C_D)=\frac{1}{r_D C_D(\beta_2-\beta_1)}\left\{\sum_{(n=1)}^{2}\frac{(-1)^{(n+1)}}{\beta_n}\left[erfc\left(\frac{r_D-1}{2\sqrt{t_D}}\right)-e^{\beta_n(r_D-1)}\cdot e^{\beta_n^2 t_D}\cdot erfc\left(\beta_n\sqrt{t_D}+\frac{r_D-1}{2\sqrt{t_D}}\right)\right]\right\} \tag{A-70}$$

$$r_D=\frac{r}{r_{SW}} \tag{A-71}$$

$$t_D=\frac{kt}{\phi c\mu r_{SW}^2} \tag{A-72}$$

$$C_d=\frac{VC}{4\pi\phi c r_{SW}^3} \tag{A-73}$$

This more general form, valid for multiple spaced points, has the advantage of using measured date from several pressure probes. This can be used to approximate the ratio of horizontal to vertical permeability or formation anisotropy.

APPENDIX II

```
      SUBROUTINE SPHERFLO(WSID,PMIN)

C*********************************************************************
C
C             Exact Spherical Flow Interpretation Program
C
C             By: Mark A. Proett  Date: 10/3/94,      HOUSTON, TEXAS
C
C*********************************************************************

$INCLUDE: 'noimp.inc'
$INCLUDE: 'xconst.inc'
$INCLUDE: 'igsys.inc'
$INCLUDE: 'trkdef.inc'
$INCLUDE: 'horner.inc'
$INCLUDE: 'icon.inc'
$INCLUDE: 'pltdef.inc'
$INCLUDE: 'cntrl.inc'

      INTEGER WSID, WNID, TRKID, I, NX, NY, LENX, LENY, TRN
c      INTEGER STATUS, TDDIDX, TFUIDX, TSTIDX, STIDX, DOSLOP
      INTEGER STATUS, DOSLOP
      INTEGER ID, TSTPIK, TSTSTA, SLMAN, SLSEMI, SLAUTO, SLCONT
      INTEGER ISTRT, IEND, SLERAS
      INTEGER THEEND, LENGTH, IER, NSTP

      INTEGER NTERMS, MPASS, NSIG
      REAL SPHER, FCHISQ, A, DELTAA, EPSILON, CHISQR, Ph, ALP

c      REAL TDD, TFU, TSTOP, XMINSC, XMAXSC, YMINSC, YMAXSC, YMAX

      REAL XMINSC, XMAXSC, YMINSC, YMAXSC, YMAX
      REAL STEP, XAMT, YAMT, XDATA, YDATA, HX(2), HY(2), X, Y
      REAL DELTIM, PX(5), PY(5), NXX, NYY, TEMP, LSTPX, LSTPY
      REAL LINSLO, SLOPE, INTCPT, PTST, DUMMY, PMIN

      CHARACTER*4  FONT
      CHARACTER*8  LBLPI
      CHARACTER*6  XAXIS, YAXIS
      CHARACTER*7  PILBL
      CHARACTER*30 XTITL, YTITL
      CHARACTER*50 MESSAG

      dimension a(3), DELTAA(3)
      common istrt,iend,nterms,a, Ph, YMAX

      external FCHISQ

      LOGICAL ERASE

      DATA SLAUTO /5/
      DATA SLSEMI /4/
      DATA SLMAN  /3/
      DATA SLERAS /2/
      DATA SLCONT /1/

c      TSTOP  = TSTOP
c      TDDIDX = TDDIDX
c      TFUIDX = TFUIDX
```

```
c       TFU     = TFU

      IF (Ct  .LT. 1E-8) CALL CALCT(CT)

      ISTRT=STIDX
      IEND=TSTIDX

      DOSLOP = 0
      FONT = 'BLOK'
      SLOPE = 0.0
      INTCPT = 0.0
      ERASE = .FALSE.

cw      open(unit=25,file='linhor.out')

cw      write(25,*)'1',DOHOR,DOSPH,DOFSRT,DOFAST
cw      write(25,*)'2',tfuidx,stidx,tstidx

c*** Set Automatic Calcluation to Yes Initially

c       TSTAUTO= 1
      CALL KDDPERM(PFU,PSTOP)
      TSTPIK = 5
      KTIZ=KDD/10

 200  CALL XCLRWK (WSID, XALWAY)


C*** GET A GP TRACK

      HX(1) = 0.0
      HX(2) = 0.0
      HY(1) = 0.0
      HY(2) = 0.0
      LSTPX = HX(1)
      LSTPY = HY(1)

c 200  CALL XCLRWK (WSID, XALWAY)

C*************************
C       PLOT DATA
C*************************

C*** GET A GP TRACK ***

C
C AUTOMATIC SLOPE IS PICKED
C
      IF (TSTPIK .EQ. SLAUTO) THEN
c      IF (TSTAUTO .EQ. 1) THEN


c     Test for minimum value of Pressure differential

      YMAX = HORY(TSTIDX)
      DO I = TFUIDX,TSTIDX
       YDATA = HORY(I)
       IF (YDATA .GT. YMAX) YMAX=YDATA
      END DO

cw      write(25,*)'        tfuidx     stidx    tstidx     ymax'
cw      write(25,*)'7',tfuidx,stidx,tstidx,ymax

      PTST=0
```

```
      STIDX=TSTIDX
cw      write(25,*)'          stidx        tstidx       ptst       hory'
      DO WHILE (PTST.GE.0.and.STIDX.GE.TFUIDX)
         STIDX=STIDX-1
         PTST=PMIN-(YMAX-HORY(STIDX))
c         STIDX=STIDX-1
c         PTST=PMIN-(HORY(STIDX)-PFU)
cw       write(25,*)'6',stidx, tstidx, ptst, hory(stidx)
      END DO

      IF ((TSTIDX-STIDX) .LE. 10) STIDX=TSTIDX-10
      IF (STIDX .LT. TFUIDX) STIDX=TFUIDX

      write(*,*)'istrt =',istrt
      istrt=stidx
      write(*,*)'stidx =',stidx
      write(*,*)'iend  =',iend

C*********************** NEW

C     Definition of Terms

c     A(1)=Po/10          - Initial Formation Pressure (psi)
c     A(2)=k                    - Permeability (mdarcy)

C     Initial estimates

      Ph=(PHYD1-PHYD2)/2

        if (Ph.le.hory(iend)) Ph=hory(iend)*1.2

      nterms = 3

      A(1) = YMAX/1E4
      A(2) = KTIZ
      A(3) = TIMPRO

      DELTAA(1) = a(1)/100
      DELTAA(2) = a(2)
      DELTAA(3) = a(3)/10

       MPASS    =20
       NSIG     =3
         EPSILON =0.001

       CALL GRADLS (FCHISQ,
     &                      NTERMS, A, DELTAA, MPASS, NSIG,
     &                       EPSILON, CHISQR)

      write(*,*)'Po    =  ',a(1)*1E4
      write(*,*)'Ph    =  ',Ph
      write(*,*)'Ktz   =  ',a(2)
      write(*,*)'TPRO  =  ',a(3)

       PUDST =A(1)*1E4
       KTIZ  =A(2)
       TIMPRO=A(3)
       TFU=TDD-TIMPRO

       alp = 14696*UO*CT*VFL/(2*3.14159265359*BNOR*2.54*KTIZ

       DELTIM = HORX(istrt)-TDD
       LINSLO = -(PUDST-
```

60

```
     1    SPHER(DELTIM,TIMPRO,VOL,PUDST,KTIZ,CT,VFL,PHI,UO,SHOT,FLO)/
     2    /exp(-(HORX(istrt)-TFU)/alp)

C*********************************************

      IF(LINSLO .EQ. 0.0) THEN
         MESSAG = 'CANNOT CALCULATE VALID SLOPE, TRY MANUAL'
         CALL ERRMSG (WSID, WNID, MESSAG, 40)
         GOTO 101
      END IF
      SLOPE = LINSLO
      INTCPT = PUDST

      write(*,*)'SLOPE  ',SLOPE
      write(*,*)'INTCPT ',INTCPT

C************************ NEW

C***************************
C PLOT THE LINEAR MODEL
C***************************

C*** FIND APPROPRIATE SCALE VALUES ***
C*** TIME IN SECONDS ***

      DELTIM = HORX(STIDX)-TFU

C      XMINSC = (1./(DELTIM**0.5)) - (1./((DELTIM+TFU)**0.5))
c      XMINSC = DELTIM**FSTSLO

      XMINSC = EXP(-DELTIM/ALP)

      XMAXSC = XMINSC

      YMINSC = HORY(STIDX)
c      YMAXSC = YMINSC

C*** Set Maximum Pressure to Automatic Calculation of Pi
      YMAXSC = PUDST

      DO I = STIDX, TSTIDX

       DELTIM = HORX(I)-TFU

C         XDATA = (1./(DELTIM**0.5))-(1 /((DELTIM+TFU)**0.5))
C       XDATA = DELTIM**FSTSLO
          XDATA = EXP(-DELTIM/ALP)

       IF (XDATA .LT. XMINSC) XMINSC=XDATA
       IF (XDATA .GT. XMAXSC) XMAXSC=XDATA

       YDATA = HORY(I)

       IF (YDATA .LT. YMINSC) YMINSC=YDATA
       IF (YDATA .GT. YMAXSC) YMAXSC=YDATA

      END DO

      YMAX = YMAXSC

C*** A LITTLE LEEWAY FOR X SCALES ***

      NX = 10
      STEP = (XMAXSC-XMINSC)/NX
```

```
      XMAXSC = XMAXSC + STEP
      XMINSC = 0.0
c      XMAXSC = XMAXSC*ENGPAR

      CALL SCLADJ(XMINSC,XMAXSC,NX,0)

      NXX = FLOAT(NX)

C*** A LITTLE LEEWAY FOR Y SCALES ***

      NY = 10
      STEP = (YMAXSC-YMINSC)/NY
      if (step.lt.1.0) step=1.0
      YMAXSC = YMAXSC + (3.*STEP)
      YMINSC = YMINSC - STEP

      IF (YMINSC .LT. 0.0) YMINSC = 0.0

      CALL SCLADJ(YMINSC,YMAXSC,NY,0)

      NYY = FLOAT(NY)

C*** DEFINE PLOT ENVIRONMENT ***

      XTITL  =' t^n '
      LENX   = LEN_TRIM(XTITL)
      XAXIS  ='LIN   '

      YTITL  = 'PRESSURE (PSIA)'
      LENY   = LEN_TRIM(YTITL)
      YAXIS  ='LIN   '

      ID = 8

      TSTNAM(ID) = 'LINHOR'

cw      write(25,*)'9',SLAUTO,LENGTH,DUMMY,IER,PMIN

      CALL NUMTXT(PMIN,TSTPAR(ID, SLAUTO),2)
      TSTPAR(ID, SLSEMI) = ' N '
      TSTPAR(ID, SLMAN)  = ' N '
      TSTPAR(ID, SLERAS) = ' N '
      TSTPAR(ID, SLCONT) = ' N '


      END IF
C
C*************************************************************
C

C******** Define the Menu ********************

cw      write(25,*)'10',PMIN

      TSTEX(ID, SLAUTO) = 'AUTO  PSI '
      TSTEX(ID, SLSEMI) = 'SEMI AUTO '
      TSTEX(ID, SLMAN)  = '  MANUAL  '
      TSTEX(ID, SLERAS) = 'ERASE MENU'
      TSTEX(ID, SLCONT) = ' CONTINUE '

      TSTYP(ID, SLAUTO) = NRML
      TSTYP(ID, SLSEMI) = TOGL
      TSTYP(ID, SLMAN)  = TOGL
      TSTYP(ID, SLERAS) = TOGL
```

```
      TSTYP(ID, SLCONT) = TOGL

      TSTCOR(ID, 1) = 0.83
      TSTCOR(ID, 2) = 0.99
      TSTCOR(ID, 3) = 1.50
      TSTCOR(ID, 4) = 0.90

C*************************************************************

      CALL SETTRK(WSID,GPTRK,'LINEAR',XMINSC,XMAXSC,NX,XAXIS,
     1  XMINSC,CNECT,YMINSC,YMAXSC,NY,YAXIS,0.0,CNECT,0.05,0.95,
     1  0.05,0.95,XMINSC,YMINSC)

      CALL GPTRCK(WSID,'LINEAR', XTITL, ' ', YTITL, ' ', 1,
     1                    XAMT,YAMT, TRKID, WNID)

C*** X AXIS ***

      CALL TICMRK(WSID,TRKID,XMINSC,XMAXSC,NX,1,
     1                    YMINSC,SOLID,'LIN    ',1, 0)
      CALL LABTIC(WSID,TRKID, WNID, XMINSC,XMAXSC,
     1                    (YMINSC-YAMT/2.),
     1                    (YMINSC-YAMT/4.), 1, 7, 7)
c     1                    (YMINSC-YAMT/4.), 1, 3, 7)

C*** Y AXIS ***

      CALL TICMRK(WSID,TRKID,YMINSC,YMAXSC,NY,1,
     1                    XMINSC,SOLID,'LIN    ',0, 0)
      CALL LABTIC(WSID,TRKID, WNID, YMINSC,YMAXSC,(XMINSC
c     1                    -XAMT),XMINSC,0, 1, 6)
     1                    -XAMT),XMINSC,0, 0, 5)

      CALL SELTRN(WSID,WNID)

C*** PLOT THE LINEAR DATA ***

      CALL XSMK(MRKTYP)


      open(unit=54,file='cal.pi')
      write(54,*)'istrt =',istrt
      write(54,*)'iend  =',iend
      write(54,*)'alp=14696*UO*CT*VFL/(2*3.14159265359*SNOR*2.54*KTIZ)'
      write(54,*)'alp   =',alp
      write(54,*)'UO    =',uo
      write(54,*)'CT    =',ct
      write(54,*)'VFL   =',vfl
      write(54,*)'SNOR  =',snor
      write(54,*)'Q     =',Q
      write(54,*)'PHI   =',phi
      write(54,*)'UO    =',uo
      write(54,*)'TIMPRO=',timpro
      write(54,*)'KTIZ  =',ktiz

      DO I = STIDX,TSTIDX
       DELTIM = HORX(I) -TPU
c         XDATA = (L. (DELTIM**(1.5))-(1.)*(DELTIM+TPU)**(1.5)
c       XDATA = DELTIM**PSTSLO
        XDATA = EXP(-DELTIM/ALP)
       YDATA = HORY(I)
       IF (XDATA .LT. XMAXSC) THEN
          CALL XPM(1,XDATA,YDATA)
       END IF
```

```
      write(54,*)deltim,xdata,ydata

      END DO

C*** DRAW THE LINE DEFINED BY LOCATOR CALL ***

      IF (SLOPE .NE. 0.0) THEN
       HY(2) = YMINSC
       HX(2) = (HY(2) - PUDST)/LINSLO
       IF (HX(2) .GT. XMAXSC) THEN
           HX(2) = XMAXSC
           HY(2) = LINSLO*HX(2) + PUDST
       ENDIF
       IF (PHOR .GT. YMAXSC) THEN
           HY(1) = YMAXSC
           HX(1) = (HY(1) - PUDST)/LINSLO
       ELSE
           HX(1) = 0.0
           HY(1) = PUDST
       END IF

       IF (HX(2) .LT.0) THEN
           HX(2) = XMAXSC
           HY(2) = LINSLO*HX(2) + PUDST
       ENDIF

       write(54,*)hx(1),hy(1)
       write(54,*)hx(2),hy(2)
         close(54)

       CALL SELTRN(WSID,WNID)

       CALL XSPLCI(BLUE)
       CALL XPL(2,HX,HY)
       CALL XSPLCI(BLACK)

C***   Simulate Plot

      open(unit=55,file='cal.li')

       nstp=4
       do i=istrt,iend,nstp
       DELTIM=HORX(i)-TFU
       HX(1)=exp(-DELTIM/alp)
       DELTIM=HORX(i)-TDD
       HY(1)=SPHER(DELTIM,TIMPRO,VOL,PUDST,KTIZ,CT,VFL,PHI,UO,snor,FLO)
       DELTIM=HORX(i+nstp)-TFU
       HX(2)=exp(-DELTIM/alp)
       DELTIM=HORX(i+nstp)-TDD
       HY(2)=SPHER(DELTIM,TIMPRO,VOL,PUDST,KTIZ,CT,VFL,PHI,UO,snor,FLO)
       call xpl(2,HX,HY)
       write(55,*)      i,HX(1),HY(1),HORX(i      ),HORY(i      )
       write(55,*)i-nstp,HX(2),HY(2),HORX(i-nstp),HORY(i-nstp)
       enddo

       close(55)

C*** PI LABEL ***

       PX(1) = (XMINSC + 1.5*(XMAXSC-XMINSC)/NXX)
       PX(2) = (XMINSC + 3.0*(XMAXSC-XMINSC)/NXX)
       PX(3) = PX(2)
```

```
      PX(4) = PX(1)
      PX(5) = PX(1)
      PY(1) = (YMINSC + 1.0*(YMAXSC-YMINSC)/NYY)
      PY(2) = PY(1)
      PY(3) = (YMINSC + 2.0*(YMAXSC-YMINSC)/NYY)
      PY(4) = PY(3)
      PY(5) = PY(1)

      CALL XSFAIS(XSOLID)
      CALL XSFACI(YELLOW)
      CALL XFA(5,PX,PY)

      LBLPI = ' Pi  ='
      PY(1) = PY(1) + (.2 * (PY(3) - PY(1)))
      CALL TEXT(WSID,WNID,LBLPI,0.0,0.0,'Y','N',
     1            PX(1),PX(2),PY(1),PY(3),
     2            'C',0.03,0,'H',FONT,1)

C*** REPORT PI ***

      PX(1) = (XMINSC+3.*(XMAXSC-XMINSC)/NXX)
      PX(2) = (XMINSC+4.5*(XMAXSC-XMINSC)/NXX)
      PX(3) = PX(2)
      PX(4) = PX(1)
      PX(5) = PX(1)
      PY(1) = (YMINSC+1.0*(YMAXSC-YMINSC)/NYY)
      PY(2) = PY(1)
      PY(3) = (YMINSC+2.0*(YMAXSC-YMINSC)/NYY)
      PY(4) = PY(3)
      PY(5) = PY(1)

      CALL XSFAIS(XSOLID)
      CALL XSFACI(YELLOW)
      CALL XFA(5,PX,PY)

      CALL NUMTXT(PUDST,PILBL,2)
      PY(1) = PY(1) + (.2 * (PY(3) - PY(1)))
      CALL TEXT(WSID,WNID,PILBL,0.0,0.0,'Y','N',
     1            PX(1),PX(2),PY(1),PY(3),
     2            'C',0.03,0,'H',FONT,1)
     ENDIF

C
C CALL BCNTRL TO FIND OUT HOW THE USER WANTS TO PICK THE SLOPE
C
     IF (ERASE) THEN
      MESSAG = 'CLICK  ON  MENU  BUTTON  TO  CONTINUE'
      CALL PROMPT(WSID,' ',MSGCLR,0.0)
      CALL PROMPT(WSID,MESSAG,MNUOUT,0.0)
      CALL LOCATOR(WSID,WNID,X,Y,LSTPX,LSTPY,XLOCDF,
     &                STATUS, TRN)
      IF (STATUS .EQ. 2) GO TO 900
      CALL WINDO (WSID,TRN)
      IF (DUMP) THEN
         CALL SCRDMP(WSID)
         ERASE = .FALSE.
         CALL DALLOC (WSID, WNID)
         GOTO 200
      ELSEIF (REDO .OR. EXTFLG) THEN
         GOTO 900
      ELSEIF (REDRAW) THEN
         ERASE = .FALSE.
      ENDIF
     ENDIF
```

```
101   CONTINUE
      TSTSTA = 99
      CALL BCNTRL(WSID, ID, 5, 5, TSTPIK, TSTSTA)
      IF (TSTSTA .EQ. 77) THEN
        REDO = .TRUE.
        GOTO 900
      ELSE IF (TSTSTA .EQ. 88) THEN
        EXTFLG = .TRUE.
        GOTO 900
      ENDIF

C
C IF CONTINUE IS PICKED ON THE CONTROL MENU
C
      IF (TSTPIK .EQ. SLCONT) GOTO 500
C
C IF ERASE MENU IS PICKED ON THE CONTROL MENU
C
      IF (TSTPIK .EQ. SLERAS) THEN
       TSTPAR(ID, SLERAS) = ' Y '
       ERASE = .TRUE.
C
C NOW CHECK BCNTRL PICK IF MANUAL SLOPE IS PICKED
C
      ELSE IF (TSTPIK .EQ. SLMAN) THEN
       TSTPAR(ID, SLMAN)  = ' Y '
       TSTPAR(ID, SLSEMI) = ' N '

         CALL PROMPT(WSID,' ',MSGCLR,0.0)
         MESSAG = 'PICK 2 POINTS FOR THE SLOPE'
         CALL PROMPT(WSID,MESSAG,MSGOUT,0.0)

C*** FIND 2 PTS TO CALCULATE A SLOPE ***

         CALL LOCATOR(WSID,WNID,X,Y,HX(1),HY(1),XLOCDF,
     &                    STATUS,TRN)
         IF (STATUS .EQ. 2) GO TO 500
         CALL WINDO (WSID,TRN)
         IF (DUMP) THEN
            CALL SCRDMP(WSID)
            CALL DALLOG (WSID, WNID)
            GOTO 200
         ELSEIF (REDO .OR. EXTFLG) THEN
            GOTO 900
         ENDIF

          HX(1) = X
          HY(1) = Y

         CALL LOCATOR(WSID,WNID,X,Y,HX(1),HY(1),XLOCRB,
     &                    STATUS,TRN)
         IF (STATUS .EQ. 2) GO TO 500

          HX(2) = X
          HY(2) = Y

C*** CALCULATE THE SLOPE ****

        IF (HX(2) .EQ. HX(1)) THEN
            MESSAG = 'SLOPE  IS  UNDEFINED,  TRY  AGAIN'
            CALL DALLOG (WSID, WNID)
            CALL XRBELL(WSID, 0)
```

```
            GOTO 200
        ENDIF
        LINSLO = (HY(2) - HY(1)) / (HX(2) - HX(1))
        IF (LINSLO .EQ. 0.0) THEN
            MESSAG = 'SLOPE  CANNOT  BE  EQUAL  TO  0.0'
            CALL DALLOG (WSID, WNID)
            CALL XRBELL(WSID, 0)
            GOTO 200
        ENDIF

C*** CALCULATE THE Y-INTERCEPT ****

        PUDST = HY(2) - LINSLO*HX(2)
        IF (PUDST .LE. YMAX) THEN
            MESSAG = 'SLOPE  IS  INVALID,  TRY  AGAIN'
            CALL DALLOG (WSID, WNID)
            CALL XRBELL(WSID, 0)
            GOTO 200
        ENDIF
        SLOPE = LINSLO
        INTCPT = PUDST
C
C IF SEMI-AUTOMATIC SLOPE IS PICKED
C
      ELSE IF (TSTPIK .EQ. SLSEMI) THEN

cw      write(25,*)'11',SLAUTO,LENGTH,DUMMY,IER,PMIN

       TSTPAR(ID, SLSEMI) = ' Y '
         TSTPAR(ID, SLMAN)  = ' N '
       CALL PROMPT(WSID,' ',MSGCLR,0.0)
       MESSAG = 'PICK STARTING POINT FOR DATA'
       CALL PROMPT(WSID,MESSAG,MSGOUT,0.0)

       CALL LOCATOR(WSID,WNID,X,Y,HX(1),HY(1),XLOCDF,
     &                  STATUS, TRN)
       IF (STATUS .EQ. 2) GO TO 900
       CALL WINDO (WSID,TRN)
       IF (DUMP) THEN
          CALL SCRDMP(WSID)
          GOTO 101
       ELSEIF (REDO .OR. EXTFLG) THEN
          GOTO 900
       ENDIF
       LSTPX = X
       LSTPY = Y
       ISTRT = STIDX
       DO I = TSTIDX, STIDX, -1
          DELTIM = HORX(I)-TFU
C            TEMP = (1./(DELTIM**0.5))-(1./((DELTIM-TFU)**0.5))
C          TEMP = DELTIM**FSTSLO
           TEMP = EXP(-DELTIM/ALP)
          IF (TEMP .GE. X) THEN
            ISTRT = I
            GOTO 600
          END IF
       END DO
 600     CONTINUE

       CALL PROMPT(WSID,' ',MSGCLR,0.0)
       MESSAG = 'PICK ENDING POINT FOR DATA'
       CALL PROMPT(WSID,MESSAG,MSGOUT,0.0)

       CALL LOCATOR(WSID,WNID,X,Y,LSTPX,LSTPY,XLOCDF,
```

```
     &                    STATUS, TRN)
      IF (STATUS .EQ. 2) GO TO 900
      CALL WINDO (WSID,TRN)
      IF (DUMP) THEN
         CALL SCRDMP(WSID)
         GOTO 101
      ELSEIF (REDO .OR. EXTFLG) THEN
         GOTO 900
      ENDIF
      IEND = TSTIDX
      DO I = TSTIDX, STIDX, -1
         DELTIM = HORX(I)-TPU
C           TEMP = (1./(DELTIM**0.5))-(1./((DELTIM+TPU)**0.5))
C         TEMP = DELTIM**FSTSLO
           TEMP = EXP(-DELTIM/ALP)
         IF (TEMP .GE. X) THEN
           IEND = I
           GOTO 700
         END IF
      END DO
 700    CONTINUE
c     CALL LINSLP (ISTRT, IEND, TDD, LINSLO, PUDST)
c     CALL LINSLP (ISTRT, IEND, LINSLO, PUDST)

C************************ NEW

C     Definition of Terms

c     A(1)=Po/10          - Initial Formation Pressure (psi)
c     A(2)=k                    - Permeability (mdarcy)

C     Initial estimates

      Ph=(PHYD1-PHYD2)/2

        if (Ph.le.hory(iend)) Ph=hory(iend)*1.2

      nterms = 3

      A(1) = YMAX/1E4
      A(2) = KTIZ
      A(3) = TIMPRO

      DELTAA(1) = a(1)/100
      DELTAA(2) = a(2)
      DELTAA(3) = a(3)/10

       MPASS    =20
       NSIG     =4
         EPSILON =0.001

       CALL GRADLS (FCHISQ,
     &                     NTERMS, A, DELTAA, MPASS, NSIG,
     &                      EPSILON, CHISQR)

      write(*,*)'Po   =  ',a(1)*1E4
      write(*,*)'Ph   =  ',Ph
      write(*,*)'Ktz  =  ',a(2)
      write(*,*)'TPRO =  ',a(3)

       PUDST =A(1)*1E4
       KTIZ  =A(2)
       TIMPRO=A(3)
```

```
      TFU=TDD+TIMPRO

      alp = 14696*UO*CT*VFL/(2*3.14159265359*SNOR*2.54*KTIZ.

      DELTIM = HORX(istrt)-TDD
      LINSLO= -(PUDST-
     1   SPHER(DELTIM,TIMPRO,VOL,PUDST,KTIZ,CT,VFL,PHI,UO,SNOR,FLO))
     2   /exp(-(HORX(istrt)-TFU)/alp)

      IF(LINSLO .EQ. 0.0) THEN
         MESSAG = 'SLOPE IS INVALID, TRY AGAIN'
         CALL ERRMSG (WSID, WNID, MESSAG, 27)
         GOTO 101
       END IF
       SLOPE = LINSLO
       INTCPT = PUDST

C*********************** NEW

C
C Ask for Minimum Psi Limit
C

      ELSE IF (TSTPIK .EQ. SLAUTO) THEN
         LENGTH = THEEND(TSTPAR(ID,SLAUTO))
         IF (LENGTH .GT. 7) LENGTH = 7

cw       write(25,*)'12',SLAUTO,LENGTH,DUMMY,IER,PMIN

       CALL ASCFLT(TSTPAR(ID,SLAUTO)(1:LENGTH),LENGTH,DUMMY,IER)

cw       write(25,*)'13',SLAUTO,LENGTH,DUMMY,IER,PMIN

       PMIN = DUMMY
       IF (PMIN .LE.0 ) PMIN=10.0
       CALL NUMTXT(PMIN,TSTPAR(ID, SLAUTO),2)
c         TSTAUTO = 1

      END IF

cw       write(25,*)'14',SLAUTO,LENGTH,DUMMY,IER,PMIN

      CALL DALLOG (WSID, WNID)
      GO TO 200

 500  CONTINUE
C*********************************************************

 900   CONTINUE

      CALL CALTIZ(WSID,TEMP,DOSLOP)

      IF (DOSLOP .EQ. 1) THEN
         CALL DALLOG (WSID, WNID)
         GOTO 200
      ENDIF

       TFU=HORX(TFUIDX)

       CONTINUE
       CALL DALLOG (WSID, WNID)

       RETURN
```

```
        END

C*****************************************************************

      FUNCTION FCHISQ()
c      FUNCTION FCHISQ(istrt,iend,nterms)
      implicit real (a-h,o-z)

$INCLUDE: 'horner.inc'

      real a, Ph, t
      dimension a(3)
      common istrt,iend,nterms,a, Ph, YMAX

      ysum=0

c     a(1) = Min(a(1)*1E4 , Ph )/1E4
      a(1) = Max(a(1)*1E4 , YMAX)/1E4

      a(3) = Max(a(3),1.0)

      n=iend-istrt+1

      DO i=istrt,iend

        t = HORX(i)-TDD

c        y=SPHER(t,TIMPRO,VOL,a(1)*1E4,a(2),CT,VFL,PHI,UO,snor)
        y=SPHER(t,a(3),VOL,a(1)*1E4,a(2),CT,VFL,PHI,UO,snor,FLO)

c     ysum=ysum+((y-hory(i))/10)**2
c     ysum=ysum+((y-hory(i))*i/n)**2
      ysum=ysum+((y-hory(i))**2)*i/n

      enddo

c     FCHISQ=ysum

      FCHISQ=ysum/(n-nterms)

c      write(*,*)'Po    =  ',a(1)*1E4
c      write(*,*)'Ph    =  ',Ph
c      write(*,*)'Ktz   =  ',a(2)
c      write(*,*)'terms=  ',nterms

      return
      end

C*****************************************************************

      FUNCTION SPHER(t,tend,vpro,Po,kk,com,svol,phi,vis,sr,FLO)
      implicit real (a-h,o-z)
      real t,tend,vpro,Po,Pss,Psl,kk,com,svol,phi,vis,sr

      pi  = 3.14159265359

      kk   = Max(kk  ,1.0E-04)

      com = Min(com,1.0E-04)
      com = Max(com,1.0E-10)

C***  Time Constant for Flow Line Storage
```

```
      a    = 14696*vis*com*svol*(1+FLO)/(4*pi*sr*2.54*kk)
C***  Steady State Pressure Differential
      Pss = (14696*vpro*vis*(1+FLO)/(4*pi*tend*sr*2.54*kk))
C***  Long Time Pressure Constant
C***  Clt = Long time flow factor (i.e., variation from ideal)
      Clt = 1.177
      Psl = Clt*(sr*2.54*(14696*phi*com*vis/(pi*kk))**0.5)/2
      if (t.le.tend) then
C***  Drawdown Function
         SPHER =-Pss*(1.0-Psl/t**0.5)*(1.0-exp(-t/a))
C***  Check for roundoff errors
C***     SPHER =-Pss*(1.0-exp(-t/a))
c        spt2 =-Pss*(1.0-exp(-t/a))
c        if(SPHER.gt.spt2) SPHER=spt2
         else
C***  Buildup Function
         SPHER =-Pss*(1.0-Psl/t**0.5)*(1.0-exp(-t/a))
     1          +Pss*(1.0-Psl/(t-tend)**0.5)*(1.0-exp(-(t-tend)/a))
C***  Check for roundoff errors
C***     SPHER = Pss*(exp(-t/a)-exp(-(t-tend)/a))
c        spt2 = Pss*(exp(-t/a)-exp(-(t-tend)/a))
c        if(SPHER.gt.spt2) SPHER=spt2
      endif
      if (SPHER. gt .0.0) SPHER=0
      if (sp .lt. -Pss) sp=-Pss
      SPHER= Po+SPHER
      return
      end

*****************************************************************
*     SUBROUTINE : GRADLS
*
*     PURPOSE : Make a gradient-search least-squares-fit to data
*               using an external function to calculate chi-square
*
*     USAGE : CALL GRADLS (FCHISQ, NTERMS, A, DELTAA, MPASS, NSIG,
*                          EPSILON, CHISQR)
*
*     DESCRIPTION OF PARAMETERS :
*
*             FCHISQ - External function that calculates a reduced
*                      chi-square. It is called as FCHISQ (NTERMS, A).
```

```
*
*               NTERMS - The number of parameters. If more than 20
*                        parameters are required, the DIMENSION statement
*                        in GRADLS must be changed.
*
*               A      - Array of parameters. It must contain the initial
*                        estimates of the parameters when GRADLS is
*                        called. The final values represent the best fit.
*
*               DELTAA - Array of initial step sizes of the parameters.
*                        These values are changed by GRADLS, and the
*                        final values are a good estimate of the step
*                        sizes appropriate for the final parameter
*                        values.
*
*               MPASS -  The maximum number of passes allowed before the
*                        program terminates.
*
*               NSIG     The number of significant decimal places
*                        required before the program is terminated.
*                        Setting NSIG to 3 should provide accuracies to
*                        .001 in all parameters. It may be beneficial to
*                        scale the parameters so that they are all about
*                        the same size.
*
*               EPSILON - The program terminates when the difference in
*                        chi-square between two successive passes is less
*                        than epsilon in magnitude.
*
*               CHISQR - The reduced chi-square corresponding to the best
*                        fit.
*
*       TERMINATION : Occurs when either of the MPASS, NSIG, or EPSILON
*                     conditions have been met. It can also occur if
*                     DELTAA is much, much too large.
*****************************************************************************

      SUBROUTINE GRADLS (FCHISQ,
     &                   NTERMS, A, DELTAA, MPASS, NSIG,
     &                    EPSILON, CHISQR)

      implicit real (a-h,o-z)

      DIMENSION A(1), DELTAA(1), GRAD(20), B(20)

      NPASS = 0
*****************************************************************************
*     Evaluate chi-square at beginning
*****************************************************************************
200   CHISQ0 = FCHISQ ()
      CHISQ1 = CHISQ0
      DO 210 I = 1, NTERMS
210   B(I) = A(I)
*****************************************************************************
*     Evaluate gradient of chi-square
*****************************************************************************
310   SUM = 0
      IPASS = 0
320   DO 390 J = 1, NTERMS
330   DELTA = .2* DELTAA(J)
      A(J) = A(J) + DELTA
      CHISQ2 = FCHISQ ()
      IF (CHISQ2 .LT. CHISQ1) THEN
```

```
          A(J) = A(J) - DELTA
          GRAD(J) = CHISQ1 - CHISQ2
          GOTO 390
        ELSE
          A(J) = A(J) - 2*DELTA
          CHISQ3 = CHISQ2
          CHISQ2 = FCHISQ ()
          IF (CHISQ2 .LT. CHISQ1) THEN
            A(J) = A(J) + DELTA
            GRAD(J) = CHISQ2 - CHISQ1
            GOTO 390
          ELSE
C---
C       Move from last minimum to prevent independent variations
C       and their associated problems. Also, decrease step size.
C---
            IF(CHISQ3 .LT. CHISQ2) THEN
              A(J) = A(J)+2*DELTA
              GRAD(J) = CHISQ1-CHISQ3
              CHISQ1=CHISQ3
            ELSE
              GRAD(J) = CHISQ2-CHISQ1
              CHISQ1 = CHISQ2
            END IF
            DELTAA(J) = DELTAA(J)/2
          END IF
        END IF
390     SUM = SUM + GRAD(J)**2

        IF(SUM .LT. 1.E-15) GOTO 1190
C---
C       Calculate gradient
C---
410     DO 420 J = 1, NTERMS
420     GRAD(J) = DELTAA(J) * GRAD(J)/SQRT(SUM)
*****************************************************************
*       Evaluate chi-square at new point
*****************************************************************
        ICOUNT = 0
510     DO 520 J = 1, NTERMS
520     A(J) = A(J) + GRAD(J)
521     CHISQ2 = FCHISQ ()
*****************************************************************
*       If chi-square does not decrease, decrease step size by factor
*       of two
*****************************************************************
        ICOUNT=ICOUNT+1
        IF(ICOUNT .GT. 3) GOTO 310
610     IF (CHISQ1 .GT. CHISQ2) GOTO 700
        DO 620 J = 1, NTERMS
        GRAD(J)=GRAD(J)/2
620     A(J) = A(J) - GRAD(J)
        GOTO 521
*****************************************************************
*       Increment parameters until chi-square starts to increase
*****************************************************************
700     IPASS = 0
710     DO 720 J = 1, NTERMS
720     A(J) = A(J) + GRAD(J)
750     CHISQ3 = FCHISQ ()
760     IF (CHISQ3 .GE. CHISQ2) GOTO 910
        IPASS = IPASS + 1
        IF (IPASS .GE. 4) GOTO 830
        CHISQ1 = CHISQ2
```

```
820     CHISQ2 = CHISQ3
        GOTO 710
C---
C       If several consecutive increments are made in the same direction,
C       double the step size .
C---
830     CHISQ2 = CHISQ3
        DO 840 J = 1, NTERMS
840     GRAD(J) = 2*GRAD(J)
        GOTO 700
*****************************************************************
*       Find minimum of parabola defined by last three points
*****************************************************************
910     IF (ABS(CHISQ3 - CHISQ2) .LE. 1.E-10) THEN
          DELTA = .5
        ELSE
          DELTA = 1/(1 + (CHISQ1 - CHISQ2)/(CHISQ3 - CHISQ2)) - .5
        END IF

        DO 930 J = 1, NTERMS
930     A(J) = A(J) - DELTA * GRAD(J)
        CHISQR = FCHISQ ()
1010    IF (CHISQ2 .GE. CHISQR) GOTO 1100
1020    DO 1030 J = 1, NTERMS
1030    A(J) = A(J) + (DELTA - 1) * GRAD(J)
1060    CHISQR = CHISQ2
1100    CONTINUE
*****************************************************************
*       Vary the step sizes depending on how much the parameters changed
*****************************************************************
        DO 1110 J = 1, NTERMS
1110    DELTAA(J) = (DELTAA(J) + ABS( A(J) - B(J) ))/2
        WRITE (*,*)    ' Chi-square = ',CHISQR
1150    FORMAT (5(2X,F7.4))
*****************************************************************
*       Evaluate termination criteria
*****************************************************************
C---
C       Check number of passes
C---
        NPASS = NPASS + 1
        IF (NPASS .GE. MPASS) THEN
          WRITE(*,*) 'Termination due to number of passes.'
          GOTO 1190
        ENDIF
C---
C       Check significant figures
C---
        DO 1160 J = 1, NTERMS
        IF (ABS(A(J) - B(J)) .GT. .2/10**NSIG) GOTO 1170
1160    CONTINUE
        WRITE(*,*) 'Termination due to significant digits in parameters'
        GOTO 1190
C---
C       Check change in chi-square
C---
1170    IF (ABS(CHISQR - CHISQ2) .LE. EPSILON) THEN
          WRITE(*,*) 'Termination due to small changes in chi-square'
          GOTO 1190
        ENDIF
        DO 1180 J = 1, NTERMS
1180    B(J) = A(J)
        GOTO 200
```

```
1190    IF (CHISQ0 .LT. CHISQR) THEN
          DO 1200 J = 1, NTERMS
1200      A(J) = B(J)
        END IF
        CHISQR = FCHISQ ()

        RETURN
        END

C*****************************************************************************

          SUBROUTINE KDDFST(WSID)

$INCLUDE: 'noimp.inc'
$INCLUDE: 'horner.inc'
$INCLUDE: 'icon.inc'
$INCLUDE: 'cntrl.inc'

c       INCLUDE 'noimp.inc'
c       INCLUDE 'horner.inc'
c       INCLUDE 'icon.inc'
c       INCLUDE 'cntrl.inc'

c       REAL TDD, PDD, TFU, PFU, TSTOP, PSTOP
       REAL DDT, DDP, BUT

       INTEGER WSID, ID
       INTEGER PVOL, PSNOR, PFLO, PCONT, PKDD
c       INTEGER PVOL, PSNOR, PFLO, PUO, PCONT, PKDD
       INTEGER PPHYD1, PPHYD2
       INTEGER PDDP, PDDT, PPSTOP, PBUT
       INTEGER ITEM, TSTPIK, TSTSTA

       INTEGER LENGTH, THEEND, IER

       CHARACTER*6 TRNAME
C*** Check for Initialization of Constants

       IF (Uo  .LE. 0) Uo   = 1.0
c       IF (Ct  .LE. 0) Ct   = 3E-6
       IF (Vol .LE. 0) Vol  = 5.0
       IF (Vfl .LE.30) VFL  = 30.0
c       IF (Ct  .LE. 0) CALL CALCT(CT)
       IF (Bo  .LE. 0) Bo   = 1.0
       IF (Flo .LE. 0) Flo  = 0.688
       IF (SNOR.LE. 0) Snor = 0.25
       IF (PHI .LE. 0 .OR. PHI .GE. 1.0) PHI  = 0.15

       DDT  = TFU - TDD
       DDP  = PSTOP - PFU
       BUT  = TSTOP - TFU
       Q    = VOL / DDT

       CALL KDDPERM(PFU,PSTOP)

c       KDD  = (460.4*(FLO+1)*UO*Q)/(SNOR*DDP)

       ID = 7
       TSTNAM(ID) = 'KDDFST'

C*** INDEXES ***

       ITEM = 11
```

```
      PVOL    = 11
      PSNOR   = 10
      PFLO    = 9
C      PUO     = 8
      PCONT   = 8
      PKDD    = 7
      PPHYD1   = 6
      PPHYD2   = 5
      PDDP    = 4
      PDDT    = 3
      PPSTOP  = 2
      PBUT    = 1

C*** TEXT LABELS ***

      TSTEX(ID,PVOL)     =  'Pretest, Vol   '
      TSTEX(ID,PSNOR)    =  'Rsnorkel (IN) '
      TSTEX(ID,PFLO)     =  'Flow Factor    '
C      TSTEX(ID,PUO)      =  ' Uo (CP)        ' '
      TSTEX(ID,PCONT)    =  'Continue       '
      TSTEX(ID,PKDD)     =  'Mdd(mDarcy/cp)'
      TSTEX(ID,PPHYD1)   =  'Phyd1  (PSI)   '
      TSTEX(ID,PPHYD2)   =  'Phyd2  (PSI)   '
      TSTEX(ID,PDDP)     =  'Pstop-Pfu(PSI)'
      TSTEX(ID,PDDT)     =  'Tfu-Tdd (Sec) '
      TSTEX(ID,PPSTOP)   =  'Pstop   (PSI) '
      TSTEX(ID,PBUT)     =  'Tstop-Tfu(Sec)'

C*** DEFAULT PARAMETERS ***

      CALL NUMTXT(VOL,TSTPAR(ID,PVOL),3)
      CALL NUMTXT(SNOR,TSTPAR(ID,PSNOR),3)
      CALL NUMTXT(FLO,TSTPAR(ID,PFLO),3)
C      CALL NUMTXT(UO,TSTPAR(ID,PUO),3)
      TSTPAR(ID,PCONT) = 'N       '
      CALL NUMTXT(PHYD1,TSTPAR(ID,PPHYD1),3)
      CALL NUMTXT(PHYD2,TSTPAR(ID,PPHYD2),3)
      CALL NUMTXT(DDP,TSTPAR(ID,PDDP),3)
      CALL NUMTXT(DDT,TSTPAR(ID,PDDT),3)
      CALL NUMTXT(PSTOP,TSTPAR(ID,PPSTOP),3)
      CALL NUMTXT(BUT,TSTPAR(ID,PBUT),3)

C*** READONLY FIELDS ***

      TSTYP(ID,PVOL)     = NRML
      TSTYP(ID,PSNOR)    = NRML
      TSTYP(ID,PFLO)     = NRML
C      TSTYP(ID,PUO)      = NRML
      TSTYP(ID,PCONT)    = TOGL
      TSTYP(ID,PKDD)     = RDONLY
      TSTYP(ID,PPHYD1)   = RDONLY
      TSTYP(ID,PPHYD2)   = RDONLY
      TSTYP(ID,PDDP)     = RDONLY
      TSTYP(ID,PDDT)     = RDONLY
      TSTYP(ID,PPSTOP)   = RDONLY
      TSTYP(ID,PBUT)     = RDONLY

C*** NDC'S OF CONTROL MENU ***

C      TSTCOR(ID,1) = 0.70
      TSTCOR(ID,1) = 0.90
      TSTCOR(ID,2) = 1.00
      TSTCOR(ID,3) = 0.10
      TSTCOR(ID,4) = 0.70
```

```
C*************************
C    BUILD CONTROL MENU
C*************************

  100 CONTINUE

      CALL KDDPERM(PFU,PSTOP)
C      KDD  = (460.4*(FLO+1)*UO)/(SNOR*(PSTOP-PFU))*Q
      CALL NUMTXT(KDD,TSTPAR(ID,PKDD),3)

      CALL BCNTRL(WSID,ID,ITEM,ITEM,TSTPIK,TSTSTA)
      IF (TSTSTA .EQ. 77) THEN
         REDO = .TRUE.
         GOTO 900
      ELSEIF (TSTSTA .EQ. 88) THEN
         EXTFLG = .TRUE.
         GOTO 900
      ENDIF

      IF (TSTPIK .EQ. PVOL) THEN

         LENGTH = THEEND(TSTPAR(ID,PVOL))
         IF (LENGTH .GT. 7) LENGTH = 7
         CALL ASCFLT(TSTPAR(ID,PVOL)(1:LENGTH),LENGTH,VOL,IER)

         Q = VOL / DDT

      ELSE IF (TSTPIK .EQ. PSNOR) THEN

         LENGTH = THEEND(TSTPAR(ID,PSNOR))
         IF (LENGTH .GT. 7) LENGTH = 7
         CALL ASCFLT(TSTPAR(ID,PSNOR)(1:LENGTH),LENGTH,SNOR,IER)

      ELSE IF (TSTPIK .EQ. PFLO) THEN

         LENGTH = THEEND(TSTPAR(ID,PFLO))
         IF (LENGTH .GT. 7) LENGTH = 7
         CALL ASCFLT(TSTPAR(ID,PFLO)(1:LENGTH),LENGTH,FLO,IER)

C      ELSE IF (TSTPIK .EQ. PUO) THEN

C         LENGTH = THEEND(TSTPAR(ID,PUO))
C         IF (LENGTH .GT. 7) LENGTH = 7
C         CALL ASCFLT(TSTPAR(ID,PUO)(1:LENGTH),LENGTH,UO,IER)

      ELSE IF (TSTPIK .EQ. PCONT) THEN

         TRNAME = TSTNAM(ID)
         RETURN

      END IF

      GO TO 100

  900 CONTINUE
      RETURN
      END

C*****************************************************************

          SUBROUTINE KDDPERM(P1,P2)

$INCLUDE: 'noimp.inc'
$INCLUDE: 'horner.inc'
```

```
$INCLUDE: 'cntrl.inc'

c            REAL PMIN,TDD,TFU,P,PE
          REAL P1,P2
c            INTEGER PKDD, 1, MYPTS, ID
c          INTEGER ID

C*** Check for Initialization of Constants

      IF (Uo  .LE. 0) Uo   = 1.0
      IF (Vol .LE. 0) Vol  = 10.0
      IF (Bo  .LE. 0) Bo   = 1.0
      IF (Flo .LE. 0) Flo  = 0.688
      IF (SNOR.LE. 0) Snor = 0.25

      Q = VOL / (Tfu-Tdd)

c      KDD  = (460.4*(FLO+1)*UO*Q)/(SNOR*DDP)

      KDD = 460.4*Bo*(FLO-1)*Q*UO/((P2-P1)*(SNOR))

C*** CHANGED PER HAMPTON ***

C***          RE = 0.3077*((VOL*FLO/PHI)**(1./3.))
C***          KDD= (921.3*FLO*Q*UO*(1.-(SNOR/RE)))
C***     1          / ((P-PMIN)*SNOR)

c      CALL NUMTXT(KDD,TSTPAR(ID,PKDD), 4)

         RETURN
         END

c*****************************************************************

           SUBROUTINE CALCT(CCT)

$INCLUDE: 'noimp.inc'
$INCLUDE: 'horner.inc'
$INCLUDE: 'cntrl.inc'

      REAL CCT,YDATA,YMIN

      INTEGER I,CTIDX

      open(unit=51,file='cal.ct')

      IF (Vfl .LE.30) VFL  = 30.0

       YMIN = 0.0
         Q = VOL / (Tfu-Tdd)

      DO I = TDDIDX, TFUIDX

       YDATA = ((HORY(I+1)- HORY(I)))/(HORX(I-1)-HORX(I))

       IF (YDATA.LT.0) THEN
         IF (YDATA .LT. YMIN) THEN
             YMIN=YDATA
           CTIDX=I
         ENDIF
           CCT= -Q/(VFL*YDATA)
       ENDIF

       write(51,*)HORX(I)-TDD,CCT
```

```
      END DO

c      CCT=1/ABS(((VFL/VOL)*(HORX(TFUIDX)-HORX(TDDIDX))
c     1        +HORX(CTIDX)-HORX(TFUIDX))*YMIN)

      CCT=ABS(-Q/(VFL*YMIN))

      IF (CCT.EQ.0) CCT=2.5E-9

      write(51,*)'   TIME  ','   CCT'
      write(51,*)HORX(CTIDX)-TDD,CCT

      close(51)

      RETURN
      END

c*****************************************************************

        SUBROUTINE CALTIZ(WSID,KTEMP,DOSLOP)

$INCLUDE: 'noimp.inc'
$INCLUDE: 'horner.inc'
$INCLUDE: 'icon.inc'
$INCLUDE: 'cntrl.inc'

c       REAL TDD, TFU, KFST, KTEMP
       REAL KTEMP, DDT, DDP, DDPfst, BUT, PHYD

c       INTEGER TDDIDX, TFUIDX
c       INTEGER I, WSID, ID, ITEM, TSTPIK, TSTSTA, PVOL, PCT, PUO
       INTEGER I, WSID, ID, ITEM, TSTPIK, TSTSTA, PVOL, PCT
       INTEGER PSNOR, PFLO, PSLO, PEXIT, PKDD, PVFL
       INTEGER PPSTOP, PDDP, PDDT, PBUT, PPHYD
       INTEGER PKTIZ, PPTIZ, LENGTH, THEEND, IER, DOSLOP

       CHARACTER*6 TRNAME

       IF (DOSLOP .EQ. 0) THEN

       open(unit=42,file='caltiz.out')

       PTIZ=PUDST

Check for Values of Tdd, Pdd, Tfu, Pfu, Tstop, Pstop

C*** If Tdd is undefined Set Tdd to the First Index

       IF(TDD.LE.0) THEN
         TDDIDX=1
         TDD=HORX(TDDIDX)
         PDD=HORY(TDDIDX)
       ENDIF

C*** If Tstop is undefined Set Tstop to the Last Test Index TSTIDX

       IF(TSTOP.LE.TDD) THEN
         TSTOP=HORX(TSTIDX)
         PSTOP=HORY(TSTIDX)
       ENDIF
```

```
C*** If Tfu is undefined Set Tfu to the Lowest Pressure between TDD and Tstop

      IF(TFU.LE.TDD) THEN
         PFU = HORY(TDDIDX)
         DO I = TDDIDX,TSTIDX
           IF (HORY(I) .LT. PFU) THEN
             PFU=HORY(I)
                TFUIDX=I
           END IF
         END DO
         PFU = HORY(TFUIDX)
         TFU = HORX(TFUIDX)
      ENDIF

      write(42,*)TDD,TFU,KTIZ,DOSLOP,PTIZ,PUDST

C*** Check for Initialization of Constants

      IF (Uo  .LE. 0) Uo   = 1.0
      IF (Vol .LE. 0) Vol  = 10.0
      IF (Vfl .LE.30) Vfl  = 10.0
      IF (Ct  .LE. 0) CALL CALCT(CT)
c      IF (Ct  .LE. 0) Ct   = 3E-6
      IF (Bo  .LE. 0) Bo   = 1.0
      IF (Flo .LE. 0) Flo  = 0.688
      IF (Phi .LE. 0) Phi  = 0.15
      IF (HT  .LE. 0) HT   = 1.00
      IF (SNOR.LE. 0) Snor = 0.25

      DDT     = TFU   - TDD
      DDP     = PSTOP - PFU
      DDPfst  = Pfst  - PFU
      BUT     = TSTOP - TFU
      Q       = VOL / DDT
      PHYD    = (PHYD1+PHYD2)/2

      CALL KDDPERM (PFU,PTIZ)

      write(42,*)Q,VOL,TDD,TFU

      END IF

      ID = 2
      TSTNAM(ID) = 'REPT2 '

C**********************
C SPHERICAL DATA  ONLY
C**********************


C*** INDEXES ***

          ITEM = 15

          PVOL   = 15
        PVFL   = 14
          PCT    = 13
c          PUO    = 13
          PSNOR  = 12
          PFLO   = 11
          PPTIZ  = 10
c          PPHI   = 10
          PKDD   = 9
          PKTIZ  = 8
```

```
          PPSTOP = 7
          PPHYD  = 6
          PDDP   = 5
          PDDT   = 4
          PBUT   = 3
          PSLO   = 2
          PEXIT  = 1

c          PTHK   = -99

C*** TEXT LABELS ***

           TSTEX(ID,PVOL)     =  ' Vol        (CC)'
           TSTEX(ID,PVFL)     =  ' Vfl        (CC)'
           TSTEX(ID,PCT)      =  ' Ct     (1/PSI)'
c           TSTEX(ID,PUO)      =  ' Uo   (CP)     '
           TSTEX(ID,PSNOR)    =  ' Rsnorkel (IN)'
           TSTEX(ID,PFLO)     =  ' Flow Factor   '
           TSTEX(ID,PPTIZ)    =  ' P*tiz    (PSI)'
           TSTEX(ID,PKDD)     =  ' Mdd    (mD/cp)'
           TSTEX(ID,PKTIZ)    =  ' Mtiz   (mD/cp)'
           TSTEX(ID,PPSTOP)   =  ' Pstop    (PSI)'
           TSTEX(ID,PPHYD)    =  ' Phydro   (PSI)'
           TSTEX(ID,PDDP)     =  ' P* - Pfu(PSI)'
           TSTEX(ID,PDDT)     =  ' Tfu-Tdd (Sec)'
           TSTEX(ID,PBUT)     =  'Tstop-Tfu(Sec)'
           TSTEX(ID,PSLO)     =  ' ReSelect      '
           TSTEX(ID,PEXIT)    =  ' Continue      '

C*** DEFAULT PARAMETERS ***

           CALL NUMTXT(VOL    ,TSTPAR(ID,PVOL   ), 3)
           CALL NUMTXT(VFL    ,TSTPAR(ID,PVFL   ), 1)
           CALL NUMTXT(CT     ,TSTPAR(ID,PCT    ),-1)
c           CALL NUMTXT(UO     ,TSTPAR(ID,PUO    ), 3)
           CALL NUMTXT(SNOR   ,TSTPAR(ID,PSNOR  ), 3)
           CALL NUMTXT(FLO    ,TSTPAR(ID,PFLO   ), 3)
c           CALL NUMTXT(PHI    ,TSTPAR(ID,PPHI   ), 3)
           CALL NUMTXT(KDD    ,TSTPAR(ID,PKDD   ), 4)
           CALL NUMTXT(KTIZ   ,TSTPAR(ID,PKTIZ  ), 4)
           CALL NUMTXT(PTIZ   ,TSTPAR(ID,PPTIZ  ), 1)
           CALL NUMTXT(PSTOP  ,TSTPAR(ID,PPSTOP), 1)
           CALL NUMTXT(PHYD   ,TSTPAR(ID,PPHYD) , 1)
           CALL NUMTXT(DDPfst,TSTPAR(ID,PDDP   ), 1)
           CALL NUMTXT(DDT    ,TSTPAR(ID,PDDT   ), 1)
           CALL NUMTXT(BUT    ,TSTPAR(ID,PBUT   ), 1)

           TSTPAR(ID,PSLO)   = 'N        '
           TSTPAR(ID,PEXIT)  = 'N        '

C*** READONLY FIELDS ***

           TSTYP(ID,PVOL)    = NRML
           TSTYP(ID,PVFL)    = NRML
           TSTYP(ID,PCT)     = NRML
c           TSTYP(ID,PUO)     = NRML
           TSTYP(ID,PSNOR)   = NRML
           TSTYP(ID,PFLO)    = NRML
           TSTYP(ID,PPTIZ)   = NRML
c           TSTYP(ID,PPHI)    = NRML
           TSTYP(ID,PKDD)    = RDONLY
           TSTYP(ID,PKTIZ)   = RDONLY
           TSTYP(ID,PPSTOP)  = RDONLY
```

```
            TSTYP(ID,PPHYD )  = RDONLY
            TSTYP(ID,PDDP)    = RDONLY
            TSTYP(ID,PDDT)    = RDONLY
            TSTYP(ID,PBUT)    = RDONLY
            TSTYP(ID,PSLO)    = TOGL
            TSTYP(ID,PEXIT)   = TOGL

             DOSLOP = 0

C*** NDC'S OF CONTROL MENU ***

             TSTCOR(ID,1) = 0.75
             TSTCOR(ID,2) = 1.00
             TSTCOR(ID,3) = 0.10
             TSTCOR(ID,4) = 0.90

C***************************
C    BUILD CONTROL MENU
C***************************

      write(42,*)TDD,TFU,KTIZ,DOSLOP
      write(42,*)KTEMP

C*** Normalize KTEMP for KTIZ Calculation

      KTEMP=KTIZ/KTEMP

      write(42,*)KTEMP

  100       CONTINUE

C*** CALCULATE THE PERM ***

            IF (Vol .LE. 0) Vol  = 10.0
            IF (Vfl .LE.30) Vfl  = 30.0
            IF (Ct  .LE. 0) CALL CALCT(CT)
            IF (Bo  .LE. 0) Bo   = 1.0
            IF (Flo .LE. 0) Flo  = 0.688
            IF (Phi .LE. 0) Phi  = 0.15
            IF (HT  .LE. 0) HT   = 1.00
            IF (SNOR.LE. 0) Snor = 0.25
            IF (PTIZ.LE. 0) PTIZ = PHYD

            CALL NUMTXT(VOL   ,TSTPAR(ID,PVOL  ), 3)
            CALL NUMTXT(VFL   ,TSTPAR(ID,PVFL  ), 1)
            CALL NUMTXT(CT    ,TSTPAR(ID,PCT   ),-1)
            CALL NUMTXT(SNOR  ,TSTPAR(ID,PSNOR ), 3)
            CALL NUMTXT(FLO   ,TSTPAR(ID,PFLO  ), 3)
c            CALL NUMTXT(PHI   ,TSTPAR(ID,PPHI  ), 3)
            CALL NUMTXT(PTIZ  ,TSTPAR(ID,PPTIZ),3)

         write(42,*)ID,PKTIZ,KTEMP
            CALL TIZPERM(ID,PKTIZ,KTEMP)
         write(42,*)ID,PKTIZ,KTEMP

         write(42,*)ID,PKDD,TDD,TFU,PTIZ
c            CALL KDDPERM(ID,PKDD,TDD,TFU,PTIZ)
            CALL KDDPERM(PFU,PTIZ)
         write(42,*)ID,PKDD,TDD,TFU,PTIZ
```

```
CALL NUMTXT(KTIZ   ,TSTPAR(ID,PKTIZ ), 4)
CALL NUMTXT(KDD    ,TSTPAR(ID,PKDD  ), 4)

CALL BCNTRL(WSID,ID,ITEM,ITEM,TSTPIK,TSTSTA)

IF (TSTSTA .EQ. 77) THEN
   REDO = .TRUE.
   GOTO 900
ELSEIF (TSTSTA .EQ. 88) THEN
   EXTFLG = .TRUE.
   GOTO 900
ENDIF


IF (TSTPIK .EQ. PVOL) THEN

  LENGTH = THEEND(TSTPAR(ID,PVOL))
  IF (LENGTH .GT. 7) LENGTH = 7
  CALL ASCFLT(TSTPAR(ID,PVOL)(1:LENGTH),LENGTH,VOL,IER)

  Q = VOL / (TFU-TDD)

ELSE IF (TSTPIK .EQ. PVFL) THEN

  LENGTH = THEEND(TSTPAR(ID,PVFL))
  IF (LENGTH .GT. 7) LENGTH = 7
  CALL ASCFLT(TSTPAR(ID,PVFL)(1:LENGTH),LENGTH,VFL,IER)

c...        CALL CALCT(CT)

ELSE IF (TSTPIK .EQ. PCT) THEN

  LENGTH = THEEND(TSTPAR(ID,PCT))
  IF (LENGTH .GT. 7) LENGTH = 7
  CALL ASCFLT(TSTPAR(ID,PCT)(1:LENGTH),LENGTH,CT,IER)
c   IF (CT .LE. 0) CALL CALCT(CT)
c   CALL NUMTXT(CT     ,TSTPAR(ID,PCT    ),-1)

c ELSE IF (TSTPIK .EQ. PUO) THEN

c   LENGTH = THEEND(TSTPAR(ID,PUO))
c   IF (LENGTH .GT. 7) LENGTH = 7
c   CALL ASCFLT(TSTPAR(ID,PUO)(1:LENGTH),LENGTH,UO,IER)

ELSE IF (TSTPIK .EQ. PSNOR) THEN

  LENGTH = THEEND(TSTPAR(ID,PSNOR))
  IF (LENGTH .GT. 7) LENGTH = 7
  CALL ASCFLT(TSTPAR(ID,PSNOR)(1:LENGTH),LENGTH,SNOR,IER)

ELSE IF (TSTPIK .EQ. PFLO) THEN

  LENGTH = THEEND(TSTPAR(ID,PFLO))
  IF (LENGTH .GT. 7) LENGTH = 7
  CALL ASCFLT(TSTPAR(ID,PFLO)(1:LENGTH),LENGTH,FLO,IER)

ELSE IF (TSTPIK .EQ. PPTIZ) THEN

  LENGTH = THEEND(TSTPAR(ID,PPTIZ))
  IF (LENGTH .GT. 7) LENGTH = 7
  CALL ASCFLT(TSTPAR(ID,PPTIZ)(1:LENGTH),LENGTH,PTIZ,IER)

c ELSE IF (TSTPIK .EQ. PPHI) THEN
```

```
c             LENGTH = THEEND(TSTPAR(ID,PPHI))
c             IF (LENGTH .GT. 7) LENGTH = 7
c             CALL ASCFLT(TSTPAR(ID,PPHI)(1:LENGTH),LENGTH,PHI,IER)

          ELSE IF (TSTPIK .EQ. PSLO) THEN

               DOSLOP = 1
               RETURN

          ELSE IF (TSTPIK .EQ. PEXIT) THEN
               MODFLG = .TRUE.
               TRNAME = TSTNAM(ID)
               RETURN

          END IF


          GO TO 100

 900      CONTINUE
          RETURN
          END

      SUBROUTINE TIZPERM(ID,PKTIZ,KTEMP)

$INCLUDE: 'noimp.inc'
$INCLUDE: 'horner.inc'
$INCLUDE: 'cntrl.inc'

      INTEGER PKTIZ
      INTEGER ID

      REAL KTEMP

c      KTIZ=KTEMP*(14696/(2*3.14159*SNOR*2.54))*CT*(FLO-1)*VFL

      KTIZ=KTEMP*14696*UO*CT*VFL*(FLO+1)/(4*3.14159265359*SNOR*2.54)

      CALL NUMTXT(KTIZ,TSTPAR(ID,PKTIZ), 4)

      RETURN
      END

C*****************************************************************
C                                                                 *
C   NOIMP.INC                                                     *
C  ----------                                                     *
C                                                                 *
C*****************************************************************
        IMPLICIT NONE

C*****************************************************************
C                                                                 *
C  XCONST.INC                                                     *
C  ----------                                                     *
C  Created by Angela Y. Smith                          3-31-91    *
C                                                                 *
C  Include file defining the parametric constants required by the *
C  XGS implementation.  This file should be included in any       *
C  application making calls to the XGS routines.                  *
```

```
C  The name of each constant and its description is given below.          *
C                                                                          *
C  Name        Description                                                 *
C  ------------------------------------------------------------------------*
C  XACTIV      Indicates workstation is ACTIVE.                            *
C  XALWAY      When passed to Clear Workstation, indicates clear           *
C              should always be performed.                                 *
C  XACENT      Indicates Horizontal Text Alignment is CENTRE.              *
C  XAHNOR      Indicates Horizontal Text Alignment is NORMAL.              *
C  XALEFT      Indicates Horizontal Text Alignment is LEFT.                *
C  XARITE      Indicates Horizontal Text Alignment is RIGHT.               *
C  XAST        Indicates marker type is ASTterisk "*".                     *
C  XAVNOR      Indicates Vertical Text Alignment is NORMAL.                *
C  XCHARP      Indicates text precision is CHARACTER.                      *
C  XCLIP       Indicates clip indicator is CLIP.                           *
C  XCOLOR      When returned from Inquire Color Facilities, indicates      *
C              workstation is color.                                       *
C  XCONDI      When passed to Clear Workstation, indicates clear           *
C              should be performed CONDITIONALLY.                          *
C  XCOUR       Indicates desired font is Courier.                          *
C  XHELV       Indicates desired font is Helvetica.                        *
C  XCSCR       Indicates desired font is Complex Script.                   *
C  XDOWN       Indicates text path is DOWN.                                *
C  XDUPLX      Indicates desired font is Duplex Roman.                     *
C  XECHO       When passed to input routines, indicates the echo           *
C              flag is ECHO.                                               *
C  XEMPTY      Indicates workstation surface is EMPTY.                     *
C  XFIXSP      Indicates font file contains Fixed Spaced font.             *
C  XHATCH      Indicates fill area interior style is HATCH.                *
C  XHIGHR      Indicates relative viewport priority is HIGER.              *
C  XHOLLO      Indicates fill area interior style is HOLLOW.               *
C  XINACT      Indicates workstation is INACTIVE.                          *
C  XINP        Indicates input device is INPut only.                       *
C  XINPUT      Indicates workstation category is INPUT.                    *
C  XLCROS      Indicates tracking cross prompt and echo type.              *
C  XLDASD      Indicates linestyle is DASH-DOT.                            *
C  XLDASH      Indicates linestyle is DASHED.                              *
C  XLDOT       Indicates linestyle is DOTTED.                              *
C  XLEFT       Indicates Text Path is LEFT                                 *
C  XLOCAT      Indicates input class is LOCATOR.                           *
C  XLOCDF      Indicates device dependant prompt and echo type.            *
C  XLOCKB      Indicates locator input device is KEYBOARD.                 *
C  XLOCMS      Indicates locator input device is MOUSE.                    *
C  XLOCRB      Indicates a Rubberband prompt and echo type.                *
C  XLOCSB      Stretchy box from initial position.                         *
C  XLOWER      Indicates relative viewport priority is LOWER.              *
C  XLSOLI      Indicates linestyle is SOLID.                               *
C  XMETRE      Indicates DC units to be metres.                            *
C  XMODER      Indicates input device is in the wrong mode.                *
C  XNCLIP      Indicates Clip indicator is NOCLIP.                         *
C  XNECHO      When passed to Input routines, indicates the echo           *
C              flag is NOECHO.                                             *
C  XNEMPT      Indicates workstation surface is NOT EMPTY.                 *
C  XNO         Indicates no release of memory after pixels restored.       *
C  XNOERR      Indicates NO ERROR when returned in ISTAT.                  *
C  XNONE       Indicates input device status is NONE.                      *
C  XOK         Indicates input device status is OK.                        *
C  XOMARK      Indicates marker type is "o".                               *
C  XOTHU       Indicates DC units other than metres.                       *
C  XOUTIN      Indicates workstation category is OUTIN.                    *
C  XOUTPT      Indicates workstation category is OUTPUT.                   *
C  XPAND       Indicates AND pixel writing mode.                           *
C  XPATTR      Indicates fill area interior style is PATTERN.              *
C  XPCOPY      Indicates COPY pixel writing mode (normal).                 *
```

```
C  XPLUS       Indicates marker type is PLUS "+".                          *
C  XPOINT      Indicates marker type is POINT ".".                         *
C  XPOR        Indicates OR pixel writing mode.                            *
C  XPROFF      When passed to input routines, Prompt flag is OFF.          *
C  XPTRAN      When passed to XSPWM, indicates Pixel Writing Mode          *
C              should be Transparent Background.                           *
C  XPXOR       When passed to XSPWM, indicates Pixel Writing Mode          *
C              should be XOR.                                              *
C  XRIGHT      Indicates text path is RIGHT.                               *
C  XRPON       When passed to input routines, indicates Prompt flag        *
C              is on.                                                      *
C  XRASTR      Indicates device type is RASTER.                            *
C  XREQU       When passed to Set input device mode, indicates input       *
C              operating mode is REQUEST.                                  *
C  XRGB        Indicates color representation mode is RED-GREEN-BLUE       *
C  XSAMPL      When passed to Set input device mode, indicates input       *
C              operating mode is SAMPLE.                                   *
C  XSOLID      Indicates fill area interior style is SOLID.                *
C  XSROM       Indicates desired font is Simplex Roman.                    *
C  XSTRDF      Default PET for string input.                               *
C  XSTRP       Indicates text precision is STRING.                         *
C  XTROM       Indicates desired font is Triplex Roman.                    *
C  XUP         Indicates Text Path is UP.                                  *
C  XWSAC       Indicates XGS operating mode is workstation active.         *
C  XWSOP       Indicates XGS operating mode is workstation open.           *
C  XXGCL       Indicates XGS operating mode is closed.                     *
C  XXGOP       Indicates XGS operating mode is open.                       *
C  XXMARK      Indicates marker type is X "x".                             *
C  XYES        Indicates memory to be released after image restored.       *
C                                                                          *
C  Other Constants                                                         *
C  ---------------                                                         *
C  XDC2ND      Indicates XUCT should transform from DC to NDC.             *
C  XDC2WC      Indicates XUCT should transform from DC to WC.              *
C  XIN2D       Indicates input vectors to XUCT are 2-D.                    *
C  XND2DC      Indicates XUCT should transform from NDC to DC.             *
C  XND2WC      Indicates XUCT should transform from NDC to WC.             *
C  XO2D        Indicates XUCT output should be real 2-D.                   *
C  XO2DI       Indicates XUCT output should be integer 2-D.                *
C  XO2DI2      Indicates XUCT output should be integer*2 2-D.              *
C  XPUNIT      Indicates Pixel Units are returned from XUCT.               *
C  XWC2DC      Indicates XUCT should transform from WC to DC.              *
C  XWC2ND      Indicates XUCT should transform from WC to NDC.             *
C*************************************************************************

      INTEGER XACTIV,XALWAY,XAST,XCLIP,XCOLOR,XCONDI,XECHO,XEMPTY
      INTEGER XHATCH,XHOLLO,XINACT,XINP,XINPUT,XLDASD,XLDASH,XLDOT
      INTEGER XLOCAT,XLOCMS,XLSOLI,XNCLIP,XNECHO,XNEMPT,XNOERR,XOK
      INTEGER XOMARK,XOUTIN,XOUTPT,XPAND,XPATTR,XPLUS,XPOINT,XPOR
      INTEGER XPROFF,XPTRAN,XPXOR,XRPON,XRASTR,XREQU,XRGB,XSOLID
      INTEGER XSTRDF,XWSAC,XWSOP,XXGCL,XXGOP,XXMARK,XPCOPY,XLCROS
      INTEGER XHIGHR,XLOWER,XYES,XNO,XMETRE,XOTHU,XSAMPL,XLOCDF
      INTEGER XMODER,XNONE,XLOCRB,XLOCKB,XDOWN,XLEFT,XRIGHT,XUP
      INTEGER XCHARP,XSTRP,XFIXSP,XAMNOR,XALEFT,XACENT,XARITH
      INTEGER XSROM,XTROM,XCSCR,XCOUR,XHELV,XMODRN,XDUPLX,XANNOR
      INTEGER XDC2ND,XDC2WC,XIN2D,XND2WC,XND2DC,XO2D,XO2DI,XO2DI2
      INTEGER XPUNIT,XWC2DC,XWC2ND,XLOCSB

      PARAMETER (XACTIV=0,XALWAY=1,XAST=3,XCLIP=1,XCOLOR=1,XCONDI=0)
      PARAMETER (XECHO=1,XEMPTY=3,XHATCH=3,XHOLLO=0,XINACT=1,XINP=4,
      PARAMETER (XINPUT=1,XLDASD=4,XLDASH=2,XLDOT=3,XLOCAT=1,
      PARAMETER (XLOCMS=1,XLSOLI=1,XNCLIP=0,XNECHO=0,XNEMPT=0)
      PARAMETER (XNOERR=0,XOK=1,XOMARK=4,XOUTIN=2,XOUTPT=0,XPAND=4)
      PARAMETER (XPATTR=2,XPLUS=2,XPOINT=1,XPOR=3,XPROFF=2,XPTRAN=3)
```

```
      PARAMETER (XPXOR=2,XRPON=1,XRASTR=1,XREQU=0,XRGB=0,XSOLID=1)
      PARAMETER (XSTRDF=1,XWSAC=3,XWSOP=2,XXGCL=0,XXGOP=1,XXMARK=5)
      PARAMETER (XPCOPY=1,XHIGHR=0,XLOWER=1,XYES=1,XNO=0,XMETRE=0)
      PARAMETER (XOTHU=1,XSAMPL=1,XLOCDF=1,XLCROS=3,XMODEF=3,XNONE=0)
      PARAMETER (XLOCRB=4,XLOCKB=2,XDOWN=3,XLEFT=1,XRIGHT=0,XUP=2)
      PARAMETER (XCHARP=1,XSTRP=2,XFIXSP=0,XAHNOR=0,XALEFT=1,XACENT=2)
      PARAMETER (XARITE=3,XSROM=1,XTROM=2,XCSCR=3,XCOUR=4,XHELV=5)
      PARAMETER (XMODRN=6,XDUPLX=7,XAVNOR=0,XLOCSB=5)
      PARAMETER (XDC2ND=3,XDC2WC=4,XIN2D=0,XND2DC=2,XND2WC=5,XO2D=0)
      PARAMETER (XO2DI=1,XO2DI2=2,XPUNIT=1,XWC2DC=1,XWC2ND=0)

C*****************************************************************
C                                                                 *
C  IGSYS.inc                                                      *
C  ---------                                                      *
C                                                                 *
C*****************************************************************

C*****************************************************
C     DEFINE NUMBER OF WORK STATION
C*****************************************************

      INTEGER NWS
      PARAMETER (NWS = 1)

C*********************************************************
C     THIS SECTION DEFINE WORK STATION INFORMATION
C*********************************************************
      INTEGER WSSTAT(NWS)
      CHARACTER*6 WSNAME(NWS)

C*****************************************************
C THIS SECTION DEFINES GKS INFORMATION
C*****************************************************

C***  MAXIMUN NUMBER OF TRANSFORM

      INTEGER MXTRN

C*****************************************************
C DEFINE MAXIMUN COLOR IGSYS CAN SUPPORT
C*****************************************************

      INTEGER MXCOLR
      PARAMETER (MXCOLR = 16)

C***  SPECIFY ENGLISH OR METRIC SYSTEM

      INTEGER MEASYS

      INTEGER ENGLSH,METRIC
      PARAMETER (ENGLSH = 0)
      PARAMETER (METRIC = 1)

C*****************************************************
C DEFINE DEPTH USED IN THE IGSYS SYSTEM
C*****************************************************

C***  WELL TOP AND BOTTOM DEPTH

      REAL TOPDEP,BOTDEP

C***  USER SPECIFIED PLOTTING DEPTH
```

```
      REAL TOPPLT,BOTPLT
C***  CURRENT DEPTH THAT HAS BEEN PLOTTED
      REAL CDEPTH
C***  NEXT DEPTH TO BE PLOTTED
      REAL NDEPTH
C***  LAST DEPTH TO BE PLOTTED
      REAL LDEPTH
C***  DEPTH SCALE(240,200,...)
      REAL DPSCAL
C***  DUMMY BEGINNING AND ENDING DEPTH TO BUILD A WINDOW'S WORLD COORD
      REAL DDEPT1,DDEPT2(NWS)
C***  DUMMY DEPTH TO REAL DEPTH TRANSFORMATION
      REAL DRGAIN(NWS),DROFST(NWS)
C***  REAL DEPTH TO DUMMY DEPTH TRANSFORMATION
      REAL RDGAIN(NWS),RDOFST(NWS)
C***  SAMPLE DEPTH INCREMENT
      REAL DPTINC
C***  REMAP FLAG BECAUSE OF DEPTH INTERVAL CHANGEDE
      INTEGER REMPFLG(NWS)

C*****************************************************
C DEFINE DATA STORAGE
C*****************************************************
C***  MAXIMUN DATA BUFFER SIZE (REAL NUMBER)
      INTEGER MXBFSZ
      PARAMETER (MXBFSZ = 4096)
C***  MAXIMUN NUMBER OF BUFFER
      INTEGER MXBFNO
      PARAMETER (MXBFNO = 2)
C***  DATA BUFFER
      REAL BUFX1(MXBFSZ)
      REAL BUFX2(MXBFSZ)
C***  DEPTH BUFFER (Y AXIS)
      REAL BUFY1(MXBFSZ)
      REAL BUFY2(MXBFSZ)
C***  INTEGER BUFFER
```

```
      INTEGER IBUFX1(MXBFSZ)
      INTEGER IBUFX2(MXBFSZ)
      INTEGER IBUFY1(MXBFSZ)
      INTEGER IBUFY2(MXBFSZ)

C****  CHARACTER BUFFER (BYTE)

      CHARACTER*(MXBFSZ*4) CBUFX1
      CHARACTER*(MXBFSZ*4) CBUFX2
      CHARACTER*(MXBFSZ*4) CBUFY1
      CHARACTER*(MXBFSZ*4) CBUFY2

C*************************************************************
C DEFINE INDEX SYSTEM USED TO ALLOCATE SEGMENT,WINDOW.....
C*************************************************************

      INTEGER WN,MN,XP,CRV,TRK,OTHER,ICON
      PARAMETER (WN = 500)
      PARAMETER (MN = 1000)
      PARAMETER (XP = 1500)
      PARAMETER (CRV = 2000)
      PARAMETER (TRK = 2500)
      PARAMETER (OTHER = 3000)
      PARAMETER (ICON = 3500)

C*****************************************
C HIGHEST TRNSFORMATION PRIORITY
C*****************************************

      INTEGER HTRN

C*********************************************
C DEFINE ACTION IN THE PROMPT
C*********************************************

      INTEGER MSGOUT, MSGCLR
      INTEGER MNUOUT, DOTOUT, DOTCLR
      INTEGER ALLCLR

      PARAMETER(MSGOUT = 1)
      PARAMETER(MSGCLR = 5)
      PARAMETER(ALLCLR = 8)
      PARAMETER(MNUOUT = 9)
      PARAMETER(DOTOUT = 10)
      PARAMETER(DOTCLR = 11)

C*************************************************
C MAXIMUN NUMBER OF FILES CAN BE DISPLAYED BY CHOICE
C*************************************************

      INTEGER MXFILE

      PARAMETER(MXFILE = 20)

C*************************************************
C MAXIMUN NUMBER OF CURVES,TRACKS,SHADING THAT
C PCF FILE SPECIFIED
C*************************************************

      INTEGER NOCRV,NOTRK,NOSHD

C*************************************************
C CLS FILE REFERENCE INDEX
C*************************************************
```

```
      INTEGER FRI
C*********************************************
C ASCII FILE REFERENCE INDEX
C*********************************************

      INTEGER ASCFRI
C*********************************************
C LIS FILE REFERENCE INDEX
C*********************************************

      INTEGER LISFRI
C*************************************
C DATA TYPE
C*************************************

      INTEGER SCALER,VECTOR

      PARAMETER (SCALER = 0)
      PARAMETER (VECTOR = 1)
C*****************************************
C DELIMITER TYPE FOR DATA FILE
C*****************************************

      INTEGER DELTYP

      COMMON/IG1/ TOPDEP,BOTDEP,CDEPTH,NDEPTH,DPTINC
      COMMON/IG2/ DDEPT2,DRGAIN,DROFST,RDGAIN,RDOFST
      COMMON/IG3/ BUFX1,BUFY1,BUFX2,BUFY2
      COMMON/IG5/ DDEPT1,LDEPTH,DPSCAL
      COMMON/IG6/ TOPPLT,BOTPLT

      COMMON/IG6/ MEASYS,RMPFLG,HTRN
      COMMON/IG7/ NOCRV,NOTRK,NOSHD,FRI,ASCFRI,LISFRI, MXTRN

      COMMON/WS1/ WSSTAT

      COMMON/WS2/ WSNAME

      COMMON/DAT1/ DELTYP

      EQUIVALENCE (IBUFX1(1), BUFX1(1))
      EQUIVALENCE (IBUFX2(1), BUFX2(1))
      EQUIVALENCE (IBUFY1(1), BUFY1(1))
      EQUIVALENCE (IBUFY2(1), BUFY2(1))
      EQUIVALENCE (CBUFX1(1:), BUFX1(1))
      EQUIVALENCE (CBUFX2(1:), BUFX2(1))
      EQUIVALENCE (CBUFY1(1:), BUFY1(1))
      EQUIVALENCE (CBUFY2(1:), BUFY2(1))
C*****************************************************************
C                                                                 *
C  TRKDEF.INC                                                     *
C  ----------                                                     *
C                                                                 *
C*****************************************************************

C*****************************************
C THIS SECTION DEFINES TRACK INFORMATION
```

```
C*****************************************
C***    MAXIMUN NUMBER OF LOGGING TRACK
      INTEGER MXLTRK
      PARAMETER(MXLTRK = 12)
C***    MAXIMUN NUMBER OF GENERAL PURPOSE TRACK
      INTEGER MXGTRK
      PARAMETER(MXGTRK = 30)

C***    MAXIMUN NUMBER OF TRACK

      INTEGER MXTRK
      PARAMETER (MXTRK = MXLTRK+MXGTRK)

C***    TRACK NAME
      CHARACTER*6 TRKNAM(NWS,MXTRK)
C***    TRACK TYPE (EITHER LOGGING TRACK OR GENERAL PURPOSE)

      INTEGER GPTRK,LGTRK
      PARAMETER (GPTRK = 1)
      PARAMETER (LGTRK = 0)

C***    TRACK ORIGINAL VIEWPORT INDEX

      INTEGER TRKOVP(NWS,MXTRK)

C***    TRACK VIEWPORT INDEX

      INTEGER TRKVP(NWS,MXTRK)

C***    TRACK WINDOW INDEX

      INTEGER TRKWN(NWS,MXTRK)

C***    TRACK BOUNDARY WORLD CORRDINATE

      REAL TRKWCD(NWS,MXTRK,4)

C***    NUMBER OF DIVISION IN X DIRECTION

      INTEGER XDIV(NWS,MXTRK)

C***    NUMBER OF DIVISION IN Y DIRECTION (JUST A FLAG FOR LOGGING TRACK)

      INTEGER YDIV(NWS,MXTRK)

C***    VERTICAL GRID TYPE

      CHARACTER*6 VERGRD(NWS,MXTRK)

C***    HORIZONTAL GRID TYPE (NO USE IN LOGGING TRACK DEFINITION)

      CHARACTER*6 HRZGRD(NWS,MXTRK)

C***    VERTICAL GRID STARTING POINT (ONLY APPLIES TO LOGRITHMIC)

      REAL VERSTA(NWS,MXTRK)

C***    HORIZONTAL GRID STARTING POINT (ONLY APPLIES TO LOGRITHMIC)
```

```
      REAL HRZSTA(NWS,MXTRK)

C***    LINEAR OR LOG GRID

      INTEGER LINGRD,LOGGRD

      PARAMETER (LINGRD = 0)
      PARAMETER (LOGGRD = 1)

C***    VERTICAL AND HORIZONTAL GRID CONNECT METHOD

      INTEGER VCNECT(NWS,MXTRK)
      INTEGER HCNECT(NWS,MXTRK)

      INTEGER CNECT,NCNECT,TICK,LHCNET,RHCNET

      PARAMETER (NCNECT = 0)
      PARAMETER (CNECT = 1)
      PARAMETER (TICK = 2)
      PARAMETER (LHCNET = 3)
      PARAMETER (RHCNET = 4)

C***    FLAG IF TRACK IS FOR A MENU

      LOGICAL NOTMENU

C***    TRACK ALLOCATION TABLE

      INTEGER TRKTAB(NWS,MXTRK)

C***    POINT OF ORIGIN (FOR GENERAL PURPOSE PLOT ONLY)

      REAL XORG(NWS,MXTRK)
      REAL YORG(NWS,MXTRK)


      COMMON/TK1/ TRKWCD,VERSTA,HRZSTA
      COMMON/TK2/ XORG,YORG

      COMMON/TK3/ TRKVP,XDIV,YDIV,TRKTAB,TRKWN
      COMMON/TK4/ VCNECT,HCNECT,TRKOVP, NOTMENU

      COMMON/TK5/ TRKNAM,VERGRD,HRZGRD
C*****************************************************************
C                                                                 *
C  HORNER.INC                                                     *
C  ----------                                                     *
C                                                                 *
C*****************************************************************

C*********************************
C    HORNER PLOT PARAMETERS
C*********************************


        INTEGER     MXHDAT,DOAUTO,DOSPH,DOHOR,DOPAST,DOFSRI
        INTEGER     NUMPTS,PLTFLT,PLTCOL,NUMFLT
        INTEGER     TDDIDX,TFUIDX,TSTIDX,STIDX
        INTEGER     PRINTP, PLTCNT

        PARAMETER (MXHDAT = 8000)
```

```
      REAL        HORX(MXHDAT)
      REAL        HORY(MXHDAT)
      REAL        HORZ(MXHDAT)

C*** HORNER PLOT PARAMETERS/RESULTS ***

      REAL TDD,PDD,TFU,PFU,TSTOP,PSTOP
      REAL VFL,VOL,UO,CT,BO,DIA,HT,PHI,KDD,TIMPRO,Q,
     1     FLO,SNOR

      REAL MODSLO,fstslo,SPHSLO,HORSLO,
     1     PUDST,PSPH,PHOR,PFST,PTIZ,
     2     KSPH,KHOR,KRKZ,KTIZ

      REAL KFST,PW,TW,PHYD1,THYD1,PHYD2,THYD2
      REAL RNGPAR
      CHARACTER*40 TITLES(15)

      COMMON/HOR/ HORX,HORY,HORZ,VFL,VOL,UO,CT,BO,DIA,
     1            HT,PHI,KDD,TIMPRO,Q,FLO,SNOR,
     2            MODSLO,fstslo,SPHSLO,HORSLO,PUDST,
     3            PTIZ,PFST,PSPH,PHOR,KSPH,KHOR,KRKZ,PRINTR,
     4            KTIZ,KFST,PW,TW,PHYD1,THYD1,PHYD2,THYD2,
     5            RNGPAR,DOAUTO,DOSPH,DOHOR,DOFAST,DOFSRT,
     6            NUMPTS,PLTFLT,NUMFLT,TITLES,PLTCOL,
     7            TDDIDX,TFUIDX,TSTIDX,STIDX,PLTCNT,
     8            TDD, PDD, TFU, PFU, TSTOP, PSTOP

C*****************************************************************
C                                                                 *
C   ICON.INC                                                      *
C  ----------                                                     *
C                                                                 *
C*****************************************************************
      INTEGER MRKTYP

      LOGICAL REDO, EXTFLG, MODFLG, DUMP, REDRAW, CONNCT

      COMMON /MARKS/ MRKTYP
      COMMON /ICONS/ REDO, EXTFLG, MODFLG, DUMP, REDRAW, CONNCT

C*****************************************************************
C                                                                 *
C   PLTDEF.INC                                                    *
C  ----------                                                     *
C                                                                 *
C*****************************************************************

C*******************************************************
C DEFINE DRAWING METHOD
C*******************************************************

      INTEGER LINE,FILL,MARKER

      PARAMETER (LINE = 0)
      PARAMETER (FILL = 1)
      PARAMETER (MARKER = 3)

C*********************************************************
C     DEFINE PARAMETER FOR DRAWING BOX
C*********************************************************

C***  FRAME THE BOX
```

```
      INTEGER YFRAME,NFRAME
      PARAMETER (NFRAME = 0)
      PARAMETER (YFRAME = 1)


C*********************************************************
C     DEFINE DRAW LINE PARAMETER
C*********************************************************

C***  LINE STYLE

      INTEGER SOLID,DASH,DOT,DSDT,DS2D
      INTEGER DS3D,LGDS,LSDS,SPDS,SPDT

      PARAMETER (SOLID = 1)
      PARAMETER (DASH = 2)
      PARAMETER (DOT = 3)
      PARAMETER (DSDT = 4)
      PARAMETER (DS2D = 5)
      PARAMETER (DS3D = 6)
      PARAMETER (LGDS = 7)
      PARAMETER (LSDS = 8)
      PARAMETER (SPDS = 9)
      PARAMETER (SPDT = 10)


C*********************************************************
C     DEFINE COLOR INDEX
C*********************************************************

      INTEGER RED,BLUE,YELLOW,GREEN
      INTEGER WHITE,BLACK,MAGENT,CYAN

      PARAMETER (WHITE = 3)
      PARAMETER (BLACK = 4)
      PARAMETER (RED = 5)
      PARAMETER (GREEN = 6)
      PARAMETER (BLUE = 7)
      PARAMETER (CYAN = 8)
      PARAMETER (MAGENT = 9)
      PARAMETER (YELLOW = 10)

C*****************************************
C     DEFINE SHADING PATTERN
C*****************************************

C***  SHADING PATTERN
      INTEGER  BLANK,SAND,GAS,SILT,LIME,DOLO,CLAY,SALT
      INTEGER  META,DOLOM,QUATZ,GYPSM,ANHY,CLAY2,CLAY3
      INTEGER  CALCA,ARKO,EXTR,INTR,COAL,CHERT
      INTEGER  XPAT1,XPAT2,XPAT3,XPAT4
      INTEGER  RHAT, LHAT
      PARAMETER (BLANK = 1)
      PARAMETER (SAND = 2)
      PARAMETER (GAS = 3)
      PARAMETER (SILT = 4)
      PARAMETER (LIME = 5)
      PARAMETER (DOLO = 6)
      PARAMETER (XPAT1 = 7)
      PARAMETER (SALT = 8)
      PARAMETER (META = 9)
      PARAMETER (CLAY = 10)
      PARAMETER (CLAY2 = 11)
```

```
      PARAMETER (CLAY3= 12)
      PARAMETER (XPAT2 = 13)
      PARAMETER (DOLOM = 14)
      PARAMETER (QUATZ = 15)
      PARAMETER (CHERT = 16)
      PARAMETER (GYPSM = 17)
      PARAMETER (ANHY = 18)
      PARAMETER (CALCA = 19)
      PARAMETER (ARKO = 20)
      PARAMETER (EXTR = 21)
      PARAMETER (INTR = 22)
      PARAMETER (XPAT3 = 23)
      PARAMETER (XPAT4 = 24)
      PARAMETER (COAL = 25)
      PARAMETER (RHAT = 26)
      PARAMETER (LHAT = 27)
C*****************************************************************
C                                                                 *
C   CNTRL.INC                                                     *
C   ---------                                                     *
C                                                                 *
C*****************************************************************

C***    PARAMETERS ASSOCIATED WITH CONTROL MENU

C***    MAXIMUN CONTROL MENU

      INTEGER MXTST
      PARAMETER (MXTST = 8)

C***    MAXIMUM NUMBER OF ITEMS IN THE CONTOL MENU

      INTEGER MXITEM
      PARAMETER (MXITEM = 25)

C***    ITEM TYPE

      INTEGER NRML,RDONLY,TOGL

      PARAMETER (NRML = 0)
      PARAMETER (RDONLY = 1)
      PARAMETER (TOGL = 2)

C***    CONTROL MENU LOCATION (NDC COORDINATES)

      REAL          TSTCOR(MXTST,4)

C***    CONTROL MENU NAME

      CHARACTER*6  TSTNAM(MXTST)

C***    ITEM TITLE

      CHARACTER*14 TSTEX(MXTST,MXITEM)

C***    VALUE OF EACH ITEM

      CHARACTER*7 TSTPAR(MXTST,MXITEM)

C***    CHARACTERISTIC OF THE MENU ITEM

      INTEGER       TSTYP(MXTST,MXITEM)
```

```
C***    WHICH MENU IS ACTIVE
      INTEGER TSTACT
C***    ALLOCATION TABLE
      INTEGER TSTTAB(MXTST)

      COMMON/CNTRL1/ TSTCOR,TSTYP
      COMMON/CNTRL2/ TSTPAR
      COMMON/CNTRL3/ TSTNAM,TSTEX
      COMMON/CNTRL4/ TSTACT,TSTTAB
```

What is claimed is:

1. A method of testing an underground formation, said method comprising the steps of:

disposing a formation testing device within a borehole adjacent a portion of said underground formation to be tested, said formation testing device having a probe for collecting fluid from said formation and having a transducer for measuring fluid pressure, said transducer being fluidically coupled to said probe by a flow line;

drawing fluid from said underground formation through said probe and into said formation testing device, and permitting fluid pressure within said formation testing device to build toward fluid pressure within said underground formation;

delivering an electrical signal from said transducer to a signal processor electrically coupled to said formation testing device, said electrical signal being correlative to fluid pressure of said fluid in said formation testing device;

generating an electrical plot in response to receiving said electrical signal, said electrical plot being correlative to fluid pressure of said fluid in said formation testing device over time; and generating an electrical type-curve that approximates said electrical plot wherein said step of generating an electrical type curve comprises the steps of:

delivering signals $R_w$, V, $Q_0$, μ, and φ, corresponding to radius of said borehole, volume of said flowline, rate of fluid flow into said formation testing device, viscosity of said fluid, and porosity of said formation, respectively to said signal processor;

determining compressibility of said fluid, and delivering electrical signals C and c correlative thereto;

estimating permeability of said formation, and delivering an electrical signal k correlative thereto;

determining permeability of said formation and pressure of said formation by altering said electrical signals P, $R_w$, V, $Q_0$, μ, φ, C, c, and k according to:

$$P(R_w,t)-P_0=p(r_w,t)\left(\frac{VCQ_0\mu}{16\pi^2R_w^4k\phi c}\right),\text{ where}$$

$$p(r_w,t)=\left(\frac{1}{\beta_1-\beta_2}\right)\left(\frac{+\beta_1^{-1}-\beta_1^{-1}e^{(\beta_1^2\phi}erfc(\beta_1\sqrt{t})}{-\beta_2^{-1}+\beta_2^{-1}e^{(\beta_2^2\phi}erfc(\beta_2\sqrt{t})}\right);$$

$$\beta_1=+\frac{1}{2}-\frac{1}{2}\sqrt{1-\frac{4}{r_w}};$$

$$\beta_2=+\frac{1}{2}+\frac{1}{2}\sqrt{1-\frac{4}{r_w}};$$

$$r_w=\frac{4\pi R_w^3\phi c}{VC}(1+\gamma);\text{ and}$$

$$t=t\left(\frac{16\pi^2R_w^4k\phi c}{V^2C^2\mu}\right).$$

2. The method of claim 1, further comprising the step of displaying said electrical plot and said electrical type-curve on a monitor.

3. The method as set forth in claim 1, further comprising the step of terminating said testing of said underground formation when said electrical type-curve provides a substantially unchanging estimate of fluid pressure in said underground formation.

4. A method of testing an underground formation, said method comprising the steps of:

disposing a formation testing device within a borehole adjacent a portion of said underground formation to be tested, said formation testing device having a probe for collecting fluid from said formation and having a transducer for measuring fluid pressure, said transducer being fluidically coupled to said probe by a flow line;

drawing fluid from said underground formation through said probe and into said formation testing device, and permitting fluid pressure within said formation testing device to build toward fluid pressure within said underground formation;

delivering an electrical signal from said transducer to a signal processor electrically coupled to said formation testing device, said electrical signal being correlative to fluid pressure of said fluid in said formation testing device;

generating an electrical plot in response to receiving said electrical signal, said electrical plot being correlative to fluid pressure of said fluid in said formation testing device over time; and generating an electrical type-curve that approximates said electrical plot wherein said step of generating an electrical type curve comprises the steps of:

delivering signals $R_w$, V, $Q_0$, μ, and φ, corresponding to radius of said borehole, volume of said flowline, rate of fluid flow into said formation testing device, viscosity of said fluid, and porosity of said formation, respectively to said signal processor;

determining compressibility of said fluid, and delivering electrical signals C and c correlative thereto;

estimating permeability of said formation, and delivering an electrical signal k correlative thereto;

determining permeability of said formation and pressure of said formation by altering said electrical signals P, $R_w$, V, $Q_0$, μ, φ, C, c, and k according to:

$$P(R_w,t)-P_0=p(r_w,t)\left(\frac{VCQ_0\mu}{16\pi^2R_w^4k\phi c}\right),\text{ where}$$

$$p(r_w,t)=r_w\left(1-\frac{r_w}{\sqrt{\pi t}}\right)(1-e^{(-t/r_w)});$$

$$r_w=\frac{4\pi R_w^3\phi c}{VC}(1+\gamma);\text{ and}$$

$$t=t\left(\frac{16\pi^2R_w^4k\phi c}{V^2C^2\mu}\right).$$

5. A method of testing an underground formation, said method comprising the steps of:

disposing a formation testing device within a borehole adjacent a portion of said underground formation to be tested, said formation testing device having a probe for collecting fluid from said formation and having a transducer for measuring fluid pressure, said transducer being fluidically coupled to said probe by a flow line;

drawing fluid from said underground formation through said probe and into said formation testing device, and permitting fluid pressure within said formation testing device to build toward fluid pressure within said underground formation;

delivering an electrical signal from said transducer to a signal processor electrically coupled to said formation testing device, said electrical signal being correlative to fluid pressure of said fluid in said formation testing device;

generating an electrical plot in response to receiving said electrical signal, said electrical plot being correlative to fluid pressure of said fluid in said formation testing device over time; and generating an electrical type-curve that approximates said electrical plot wherein said step of generating an electrical type curve comprises the steps of:

delivering signals $R_w$, V, $Q_O$, μ, and ϕ, corresponding to radius of said borehole, volume of said flowline, rate of fluid flow into said formation testing device, viscosity of said fluid, and porosity of said formation, respectively to said signal processor;

determining compressibility of said fluid, and delivering electrical signals C and c correlative thereto;

estimating permeability of said formation, and delivering an electrical signal k correlative thereto;

determining permeability of said formation and pressure of said formation by altering said electrical signals P, $R_w$, V, $Q_O$, μ, ϕ, C, c, and k according to:

$$P(R_w,t)-P_0=p(r_w,t)\left(\frac{VCQ_0\mu}{16\pi^2R_w^4k\phi c}\right),\text{ where}$$

$$p(r_w,t)=\{1/(\beta_1-\beta_2)\}x-\int_0^t F(\tau)\{3_2\exp(\beta_2^2(t-\tau))erfc\beta_2\sqrt{(t-\tau)}-\beta_1\exp(\beta_1^2(t-\tau))erfc\beta_1\sqrt{(t-\tau)}\}d\tau'$$

where $$\beta_1=+\frac{1}{2}-\frac{1}{2}\sqrt{1-\frac{4}{r_w}}$$

$$\beta_2=+\frac{1}{2}+\frac{1}{2}\sqrt{1-\frac{4}{r_w}}$$

$$r_w=\frac{4\pi R_w^3\phi c}{VC}(1+\gamma);\text{ and}$$

$$t=t\left(\frac{16\pi^2R_w^4k\phi c}{V^2C^2\mu}\right).$$

6. A method of interpreting formation pressure data P electrically recorded by a formation testing device within a borehole adjacent a portion of an underground formation, said formation testing device having a probe for collecting fluid from said formation and having a transducer for measuring fluid pressure, said transducer being fluidically coupled to said probe by a flow line, said method comprising the steps of:

delivering said electrically recorded pressure data P versus time t to a signal processor;

delivering electrical signals $R_w$, V, $Q_o$, μ, and ϕ, corresponding to radius of said borehole, volume of said flow line, rate of fluid flow into said formation testing device, viscosity of said fluid, and porosity of said formation, respectively, to said signal processor;

said signal processor:

determining compressibility of said fluid, and delivering electrical signals C and c correlative thereto;

estimating permeability of said formation, and delivering an electrical signal k correlative thereto;

determining permeability of said formation and pressure of said formation by altering said electrical signals P, $R_w$, V, $Q_o$, μ, ϕ, C, γ, and k according to:

$$P(R_w,t)-P_O=p(r_w,t)\left(\frac{VCQ_O\mu}{16\pi^2R_w^4k\phi c}\right)$$

where:

$$p(r_w,t)=\left(\frac{1}{\beta_1-\beta_2}\right)\begin{pmatrix}+\beta_1^{-1}-\beta_1^{-1}e^{(\beta_1^2\tau)}erfc(\beta_1\sqrt{t})\\-\beta_2^{-1}+\beta_2^{-1}e^{(\beta_2^2\tau)}erfc(\beta_2\sqrt{t})\end{pmatrix};$$

$$\beta_2=+\frac{1}{2}+\frac{1}{2}\sqrt{1-\frac{4}{r_w}};$$

$$r_w=\frac{4\pi R_w^3\phi c}{VC}(1+\gamma);\text{ and}$$

$$t=t\left(\frac{16\pi^2R_w^4k\phi c}{V^2C^2\mu}\right)$$

7. A method of testing an underground formation, said method comprising the steps of:

drilling a borehole into said underground formation;

disposing a formation testing device within said borehole adjacent a portion of said underground formation to be tested, said formation testing device having a probe for collecting fluid from said formation and having a transducer for measuring fluid pressure, said transducer being fluidically coupled to said probe by a flow line;

drawing fluid from said underground formation through said probe and into said formation testing device;

delivering an electrical signal P from said transducer to a signal processor electrically coupled to said formation testing device, said electrical signal P being correlative to fluid pressure of said fluid in said formation testing device;

recording said electrical signal P over time t to generate an electrical plot being correlative to fluid pressure of said fluid in said formation testing device over time;

delivering electrical signals $R_w$, V, $Q_o$, μ, and ϕ, corresponding to radius of said borehole, volume of said flow line, rate of fluid flow into said formation testing device, viscosity of said fluid, and porosity of said formation, respectively, to said signal processor;

determining compressibility of said fluid, and delivering electrical signals C and c correlative thereto;

estimating permeability of said formation, and delivering an electrical signal k correlative thereto;

determining permeability of said formation and pressure of said formation by altering said electrical signals P, $R_w$, V, $Q_o$, μ, ϕ, C, and k according to:

$$P(R_w,t)-P_O=p(r_w,t)\left(\frac{VCQ_O\mu}{16\pi^2R_w^4k\phi c}\right)$$

where:

$$\beta_1=+\frac{1}{2}-\frac{1}{2}\sqrt{1-\frac{4}{r_w}};$$

$$\beta_2=+\frac{1}{2}+\frac{1}{2}\sqrt{1-\frac{4}{r_w}};$$

$$r_w=\frac{4\pi R_w^3\phi c}{VC}(1+\gamma);\text{ and}$$

$$t=t\left(\frac{16\pi^2R_w^4k\phi c}{V^2C^2\mu}\right).$$

* * * * *